US010164360B2

(12) United States Patent
Yoshioka et al.

(10) Patent No.: US 10,164,360 B2
(45) Date of Patent: Dec. 25, 2018

(54) CONNECTOR, AND HEADER AND SOCKET USED IN CONNECTOR

(71) Applicant: Panasonic Intellectual Property Management Co., Ltd., Osaka (JP)

(72) Inventors: Kohsuke Yoshioka, Mie (JP); Yoji Miyazaki, Mie (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 15/327,509

(22) PCT Filed: Aug. 3, 2015

(86) PCT No.: PCT/JP2015/003894
§ 371 (c)(1),
(2) Date: Jan. 19, 2017

(87) PCT Pub. No.: WO2016/021175
PCT Pub. Date: Feb. 11, 2016

(65) Prior Publication Data

US 2017/0365944 A1 Dec. 21, 2017

(30) Foreign Application Priority Data

Aug. 7, 2014 (JP) ..... 2014-161128
Feb. 24, 2015 (JP) ..... 2015-033890

(51) Int. Cl.
*H01R 12/71* (2011.01)
*H01R 12/91* (2011.01)
(Continued)

(52) U.S. Cl.
CPC ..... *H01R 12/716* (2013.01); *H01R 12/71* (2013.01); *H01R 12/73* (2013.01); *H01R 12/737* (2013.01);
(Continued)

(58) Field of Classification Search
CPC ..... H01R 23/725; H01R 9/096
(Continued)

(56) References Cited

U.S. PATENT DOCUMENTS 6,007,352 A 12/1999 Azuma et al.
6,592,409 B1 7/2003 Oehme et al.
(Continued)

FOREIGN PATENT DOCUMENTS

CN 201336479 Y 10/2009
CN 201478494 U 5/2010
(Continued)

OTHER PUBLICATIONS

The Extended European Search Report dated Apr. 24, 2017 for the related European Patent Application No. 15828936.3.
(Continued)

*Primary Examiner* — Gary Paumen
(74) *Attorney, Agent, or Firm* — McDermott Will & Emery LLP

(57) ABSTRACT

In a connector, fitting a socket housing and a header housing to each other brings a socket-side signal terminal and a header-side signal terminal into contact with each other, and brings a socket-side power supply terminal and a header-side power supply terminal into contact with each other. The socket-side signal terminal and the socket-side power supply terminal are disposed along a long side direction of the socket housing. In the long side direction of the socket housing, the socket-side signal terminal is smaller than the socket-side power supply terminal in width.

27 Claims, 66 Drawing Sheets

(51) Int. Cl.

| | |
|---|---|
| ***H01R 12/73*** | (2011.01) |
| ***H01R 13/405*** | (2006.01) |
| ***H01R 24/60*** | (2011.01) |
| *H01R 107/00* | (2006.01) |
| *H01R 13/20* | (2006.01) |

(52) U.S. Cl.
CPC ..... *H01R 12/91* (2013.01); *H01R 13/405* (2013.01); *H01R 24/60* (2013.01); *H01R 13/20* (2013.01); *H01R 2107/00* (2013.01)

(58) Field of Classification Search
USPC ..... 439/74
See application file for complete search history.

(56) References Cited

U.S. PATENT DOCUMENTS

| | | | | |
|---|---|---|---|---|
| 7,195,494 | B2 * | 3/2007 | Ookura | H01R 12/57 439/74 |
| 7,195,495 | B2 * | 3/2007 | Takano | H01R 12/716 439/660 |
| 7,425,158 | B2 * | 9/2008 | Ookura | H01R 12/707 439/660 |
| 7,520,756 | B2 * | 4/2009 | Nagata | H01R 13/41 439/74 |
| 7,553,167 | B2 * | 6/2009 | Zhang | H01R 4/2433 439/497 |
| 8,678,838 | B2 * | 3/2014 | Kim | H01R 13/20 439/61 |
| 2006/0099836 | A1 * | 5/2006 | Ho | H01R 12/725 439/74 |
| 2010/0221928 | A1 * | 9/2010 | Sato | H01R 13/20 439/74 |
| 2010/0291776 | A1 * | 11/2010 | Huang | H01R 13/2457 439/74 |
| 2011/0045679 | A1 * | 2/2011 | Yu | H01R 12/716 439/66 |
| 2011/0195610 | A1 | 8/2011 | Miyazaki et al. | |
| 2012/0135642 | A1 * | 5/2012 | Chang | H01R 9/032 439/630 |
| 2013/0210270 | A1 | 8/2013 | Takeuchi et al. | |
| 2013/0295784 | A1 | 11/2013 | Hasegawa | |
| 2013/0330943 | A1 * | 12/2013 | Sasaki | H01R 13/631 439/74 |
| 2015/0079816 | A1 * | 3/2015 | Suzuki | H01R 12/716 439/74 |
| 2015/0140840 | A1 * | 5/2015 | Nishimura | H01R 12/79 439/74 |
| 2015/0140841 | A1 * | 5/2015 | Watanabe | H01R 12/7011 439/74 |
| 2015/0207248 | A1 * | 7/2015 | Takenaga | H01R 12/716 439/74 |

FOREIGN PATENT DOCUMENTS

| | | | |
|---|---|---|---|
| DE | 19836693 | A1 | 2/2000 |
| JP | 10-050410 | A | 2/1998 |
| JP | 2005-019144 | | 1/2005 |
| JP | 2009-259675 | | 11/2009 |
| JP | 4431674 | B | 3/2010 |
| JP | 2012-009373 | | 1/2012 |
| JP | 2013-232372 | A | 11/2013 |

OTHER PUBLICATIONS

International Search Report of PCT application No. PCT/JP2015/003894 dated Oct. 13, 2015.
Communication pursuant to Article 94(3) EPC dated Jun. 20, 2018 for the related European Patent Application No. 15828936.3.
English Translation of Chinese Search Report dated Aug. 17, 2018 for the related Chinese Patent Application No. 201580040559.X.

* cited by examiner

CONNECTOR, AND HEADER AND SOCKET USED IN CONNECTOR

This application is a U.S. national stage application of the PCT international application No. PCT/JP2015/003894.

TECHNICAL FIELD

The present invention relates to a connector, and a header and a socket used in the connector.

BACKGROUND ART

Conventionally, there is known a connector that has a socket in which a plurality of socket-side terminals are disposed in a socket body and a header in which a plurality of header-side terminals are disposed in a header body (for example, see PTL 1).

In PTL 1, fitting a socket and a header to each other brings corresponding terminals into contact and conduction with each other. Thus, circuit patterns of circuit boards to which the terminals are respectively connected are electrically connected to each other.

Such a connector, in which a plurality of pairs of socket-side terminals and header-side terminals electrically connected to each other are formed, is conventionally known.

Meanwhile, a plurality of pairs of terminals are generally used as signal-use terminals to which a signal line is connected. On the other hand, in some cases, the plurality of pairs of terminals are partially used as power supply-use terminals to which a power supply line is connected.

CITATION LIST

Patent Literature

PTL 1: Unexamined Japanese Patent Publication No. 2005-019144

SUMMARY OF THE INVENTION

The present invention provides a connector achieving a further reduction in size, and a header and a socket used in the connector.

A connector of the present invention includes a socket and a header. The socket has a socket-side signal terminal, a socket-side power supply terminal, and a substantially quadrangular socket housing in which the socket-side signal terminal and the socket-side power supply terminal are disposed. The header has a header-side signal terminal, a header-side power supply terminal, and a substantially quadrangular header housing in which the header-side signal terminal and the header-side power supply terminal are disposed. When the socket housing and the header housing are fitted to each other, the socket-side signal terminal and the header-side signal terminal are brought into contact with each other and the socket-side power supply terminal and the header-side power supply terminal are brought into contact with each other.

In a first connector of the present invention, the socket-side signal terminal and the socket-side power supply terminal are disposed along a long side direction of the socket housing. In the long side direction of the socket housing, the socket-side signal terminal is smaller than the socket-side power supply terminal in width.

In a second connector of the present invention, the header-side signal terminal and the header-side power supply terminal are disposed along a long side direction of the header housing. In the long side direction of the header housing, the header-side signal terminal is smaller than the header-side power supply terminal in width.

Further, a socket of the present invention is the socket used in the connector, and a header of the present invention is the header used in the connector.

The present invention provides a connector achieving a further reduction in size, and a header and a socket used in the connector.

DESCRIPTION OF EMBODIMENTS

Figure 1:
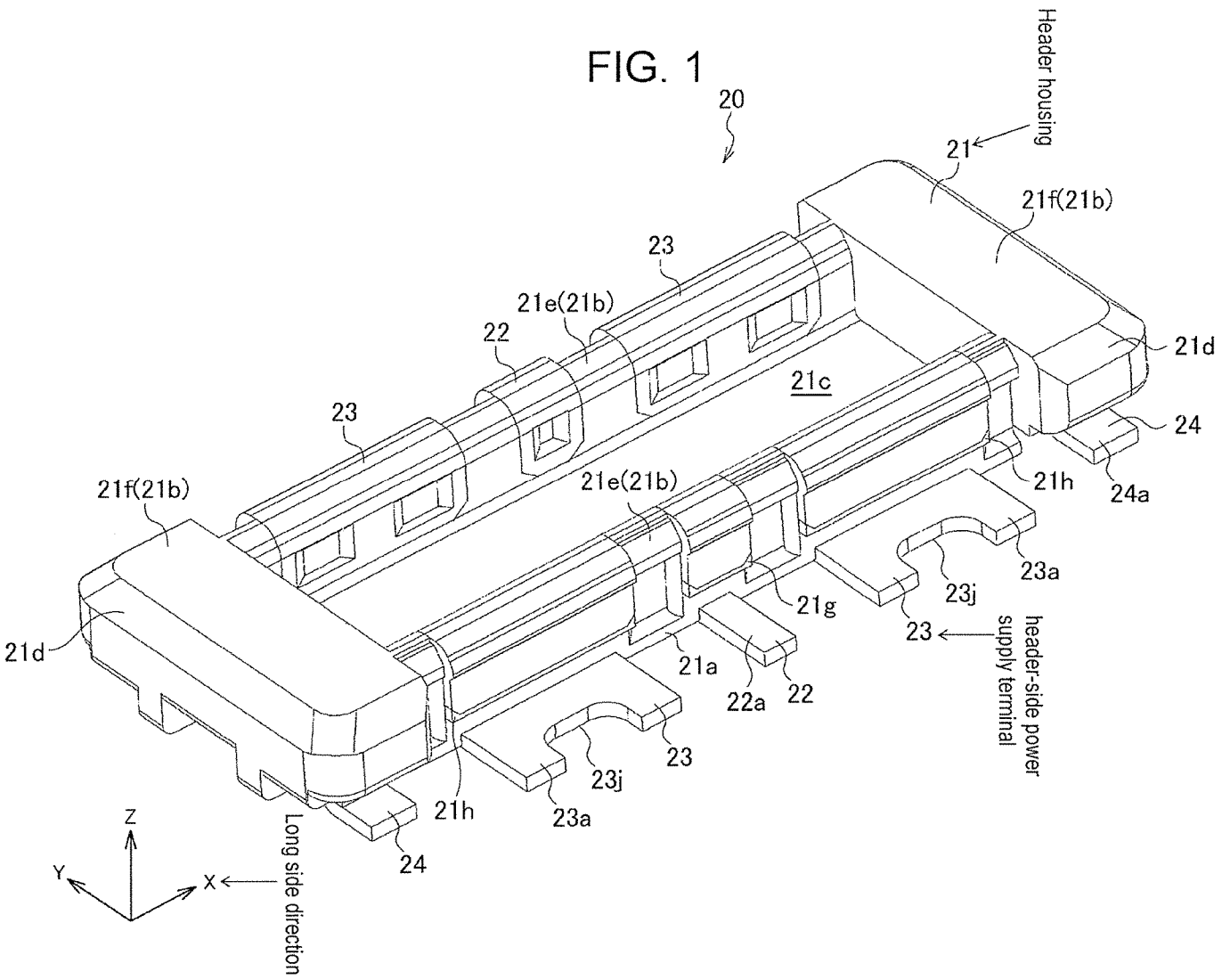
FIG. 1 is a perspective view of a header of a connector according to a first exemplary embodiment of the present invention as seen from the back surface side.
Figure 2:
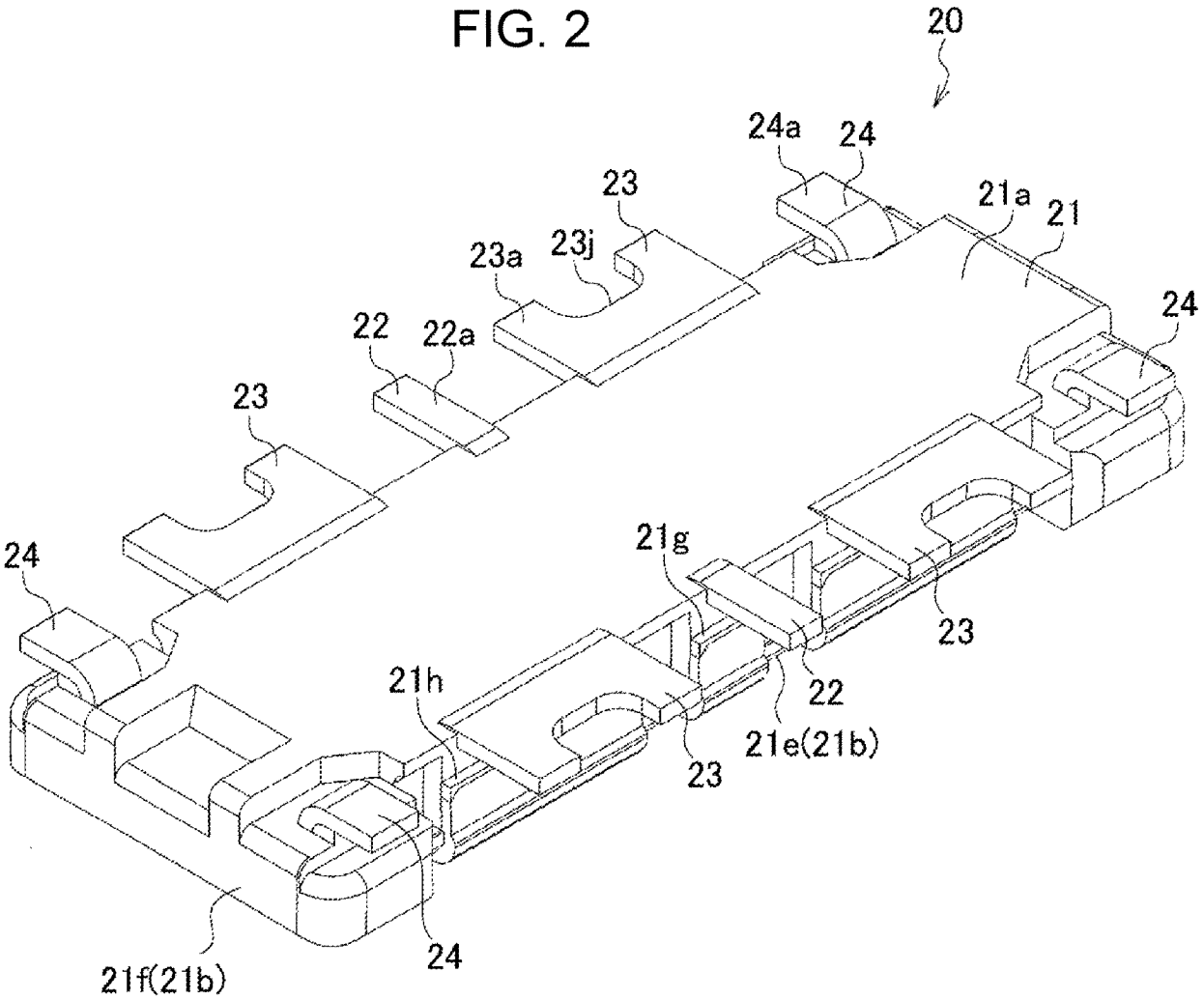
FIG. 2 is a perspective view of the header of the connector according to the first exemplary embodiment of the present invention as seen from the front surface side.
Figure 3:
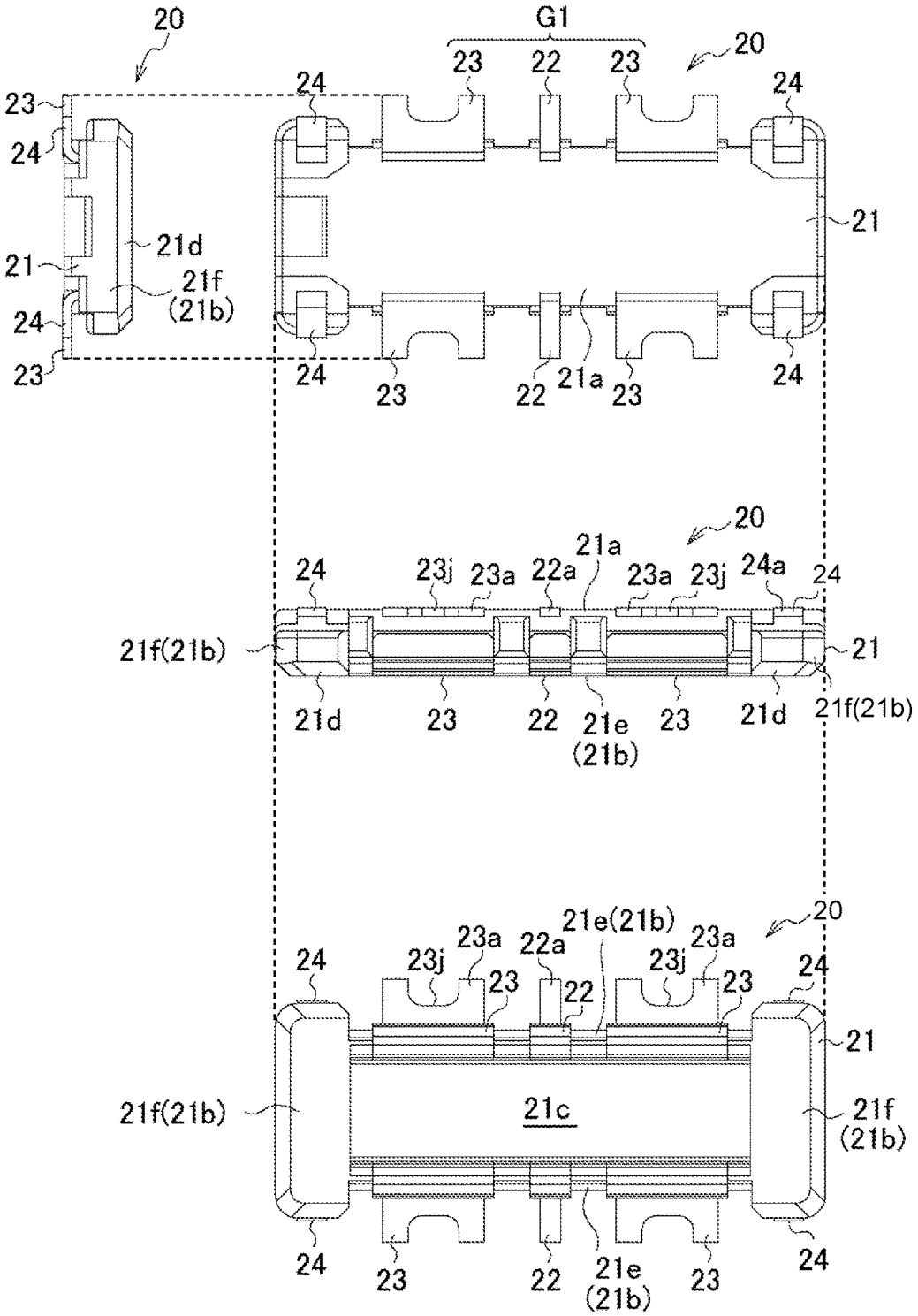
FIG. 3 is a diagram showing the header of the connector according to the first exemplary embodiment of the present invention.

Prior to a description of exemplary embodiments of the present invention, a description will be briefly given of a problem associated with the conventional connector. Current supplied from a power supply line is greater than current supplied from a signal line. Accordingly, in the case where pairs of terminals are partially used as the power supply-use terminals, a plurality of terminals must be combined on each of the socket side and the header side to serve as one power supply-use terminal in order to secure required current-carrying capacity. Such use of a plurality of terminals which are disposed to be spaced apart from each other on each of the socket side and the header side as the power supply-use terminal disadvantageously invites an increase in size of the connector.

In the following, with reference to the drawings, a detailed description will be given of exemplary embodiments of the present invention.

First Exemplary Embodiment

In the following, a description will be given based on that the long side direction of a connector (a header housing and a socket housing) is X direction, the width direction (a short side direction) of the connector (the header housing and the socket housing) is Y direction, and the top-bottom direction of the connector in FIGS. 29 to 32 is Z direction. Further, a description will be given of the socket and the header based on that the top side (the front surface side) in the state shown in FIGS. 29 to 32 is the top side in the top-bottom direction, and the bottom side (the back surface side) is the bottom side in the top-bottom direction.

Firstly, with reference to FIGS. 29 to 32, the overview of connector 10 according to the present exemplary embodiment will be described.

As shown in FIGS. 29 to 32, connector 10 according to the present exemplary embodiment has header 20 and socket 30 that fit to each other. In the present exemplary embodiment, header 20 has header housing 21 in which header-side signal terminals 22 and header-side power supply terminals 23 are disposed. On the other hand, socket 30 has socket housing 31 in which socket-side signal terminals 32 and socket-side power supply terminals 33 are disposed.

Fitting header housing 21 and socket housing 31 to each other brings header-side signal terminals 22 and socket-side signal terminals 32 into contact with each other, and brings header-side power supply terminals 23 and socket-side power supply terminals 33 into contact with each other.

Note that, socket 30 is mounted on second circuit board 40, and header 20 is mounted on first circuit board 60.

Accordingly, fitting header 20 and socket 30 to each other electrically connects second circuit board 40 on which header 20 is mounted and first circuit board 60 on which socket 30 is mounted to each other.

Specifically, mounting header 20 according to the present exemplary embodiment on second circuit board 40 electrically connects header-side signal terminals 22 and header-side power supply terminals 23 to circuit pattern 41 on second circuit board 40. Second circuit board 40 may be a printed circuit board (PCB) or a flexible printed circuit (FPC).

Further, mounting socket 30 according to the present exemplary embodiment on first circuit board 60 electrically connects socket-side signal terminals 32 and socket-side power supply terminals 33 to circuit pattern 61 on first circuit board 60. First circuit board 60 may also be a printed circuit board (PCB) or a flexible printed circuit (FPC).

Note that, connector 10 according to the present exemplary embodiment is assumed to be used for electrically connecting between circuit boards in an electronic device as a mobile terminal such as a smartphone. However, so long as the connector of the present invention is used in an electronic device, the connector may be used for electrically connecting between any components.

Next, with reference to FIGS. 1 to 14, a description will be given of the structure of header 20 used in connector 10.

As described above, header 20 has header housing 21. In the present exemplary embodiment, header housing 21 is molded with insulating synthetic resin to be quadrangular (rectangular) as a whole in a plan view (see FIGS. 1 to 6).

In header housing 21, metal-made header-side signal terminals 22 and metal-made header-side power supply terminals 23 are disposed. Header-side signal terminals 22 are electrically connected to a signal line for transmitting signals. On the other hand, header-side power supply terminals 23 are electrically connected to a power supply line for supplying power.

In the present exemplary embodiment, one header-side signal terminal 22 and two header-side power supply terminals 23 are juxtaposed to each other while being spaced apart from each other, along one long side of header housing 21. One header-side signal terminal 22 and two header-side power supply terminals 23 juxtaposed to each other on one side in width direction (short side direction) Y of header housing 21 form header-side terminal group G1.

Further, along the other long side of header housing 21 also, one header-side signal terminal 22 and two header-side power supply terminals 23 are juxtaposed to each other while being spaced apart from each other. One header-side signal terminal 22 and two header-side power supply terminals 23 juxtaposed to each other on the other side in width direction (short side direction) Y of header housing 21 also form header-side terminal group G1.

In this manner, in the present exemplary embodiment, in header housing 21, two lines (a plurality of lines) of header-side terminal groups G1 are disposed, each of header-side terminal groups G1 being formed by header-side signal terminal 22 and header-side power supply terminals 23 disposed along long side direction X of header housing 21.

Further, in header-side terminal group G1 of one line, header-side power supply terminals 23 are respectively disposed at the opposite ends of header-side signal terminal 22. In other words, header-side power supply terminals 23 are disposed at opposite ends in long side direction X of header housing 21, and header-side signal terminal 22 is disposed between header-side power supply terminals 23. In this manner, in the present exemplary embodiment, header-side power supply terminals 23 are disposed on the outer side in long side direction X of header housing 21 relative to header-side signal terminal 22.

Further, in the present exemplary embodiment, metal-made header-side retainers 24 are disposed at the opposite ends in long side direction X of header housing 21. Header-side retainers 24 are used for enhancing the strength of header housing 21, and fixing fixed terminals 24*a* of header-side retainers 24 to the above-described second circuit board 40.

Figure 4:
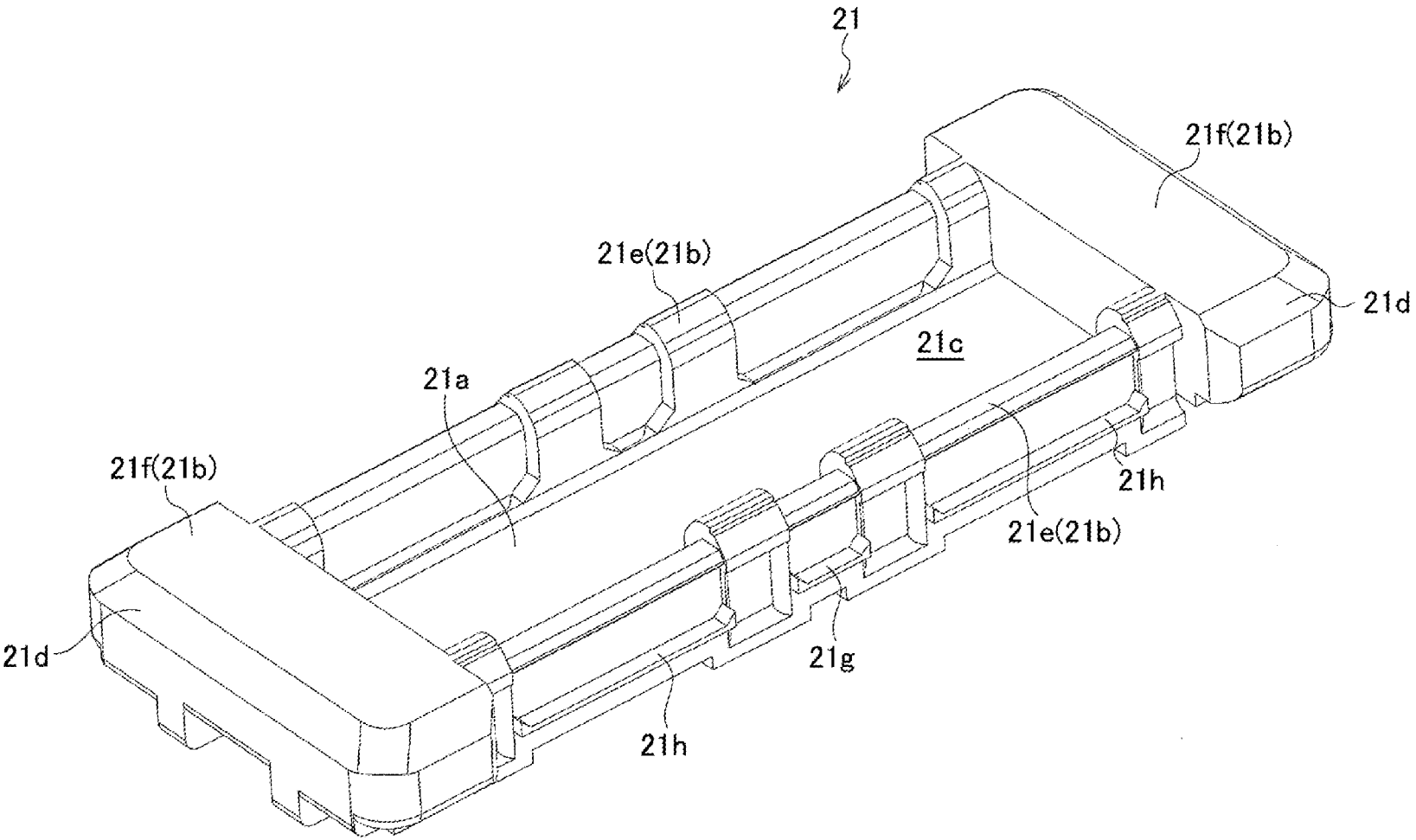
FIG. 4 is a perspective view of a header housing of the connector according to the first exemplary embodiment of the present invention as seen from the back surface side.

Next, with reference to FIGS. 4 to 6, a description will be given of the structure of header housing 21.

Figure 5:
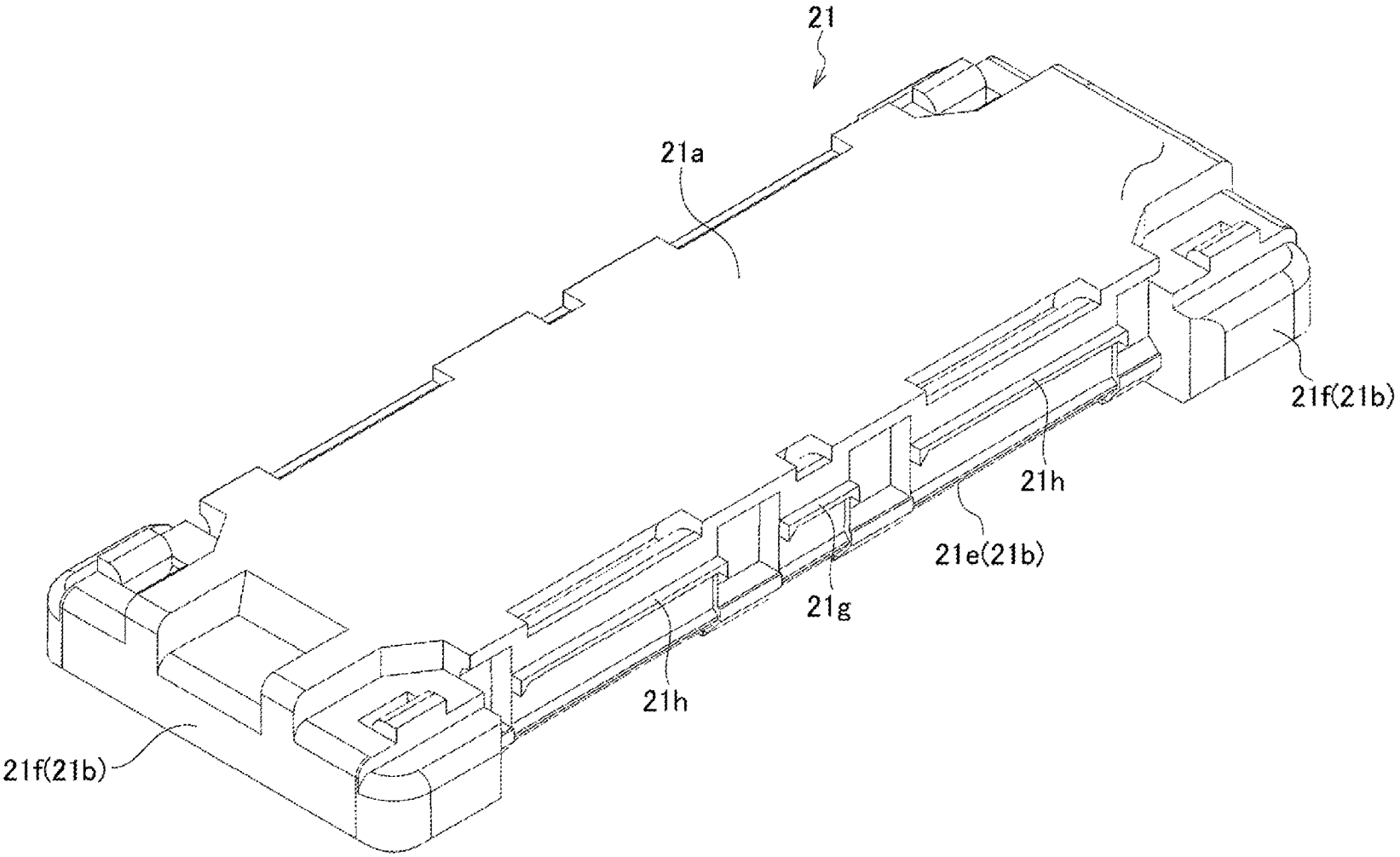
FIG. 5 is a perspective view of the header housing of the connector according to the first exemplary embodiment of the present invention as seen from the front surface side.
Figure 6:
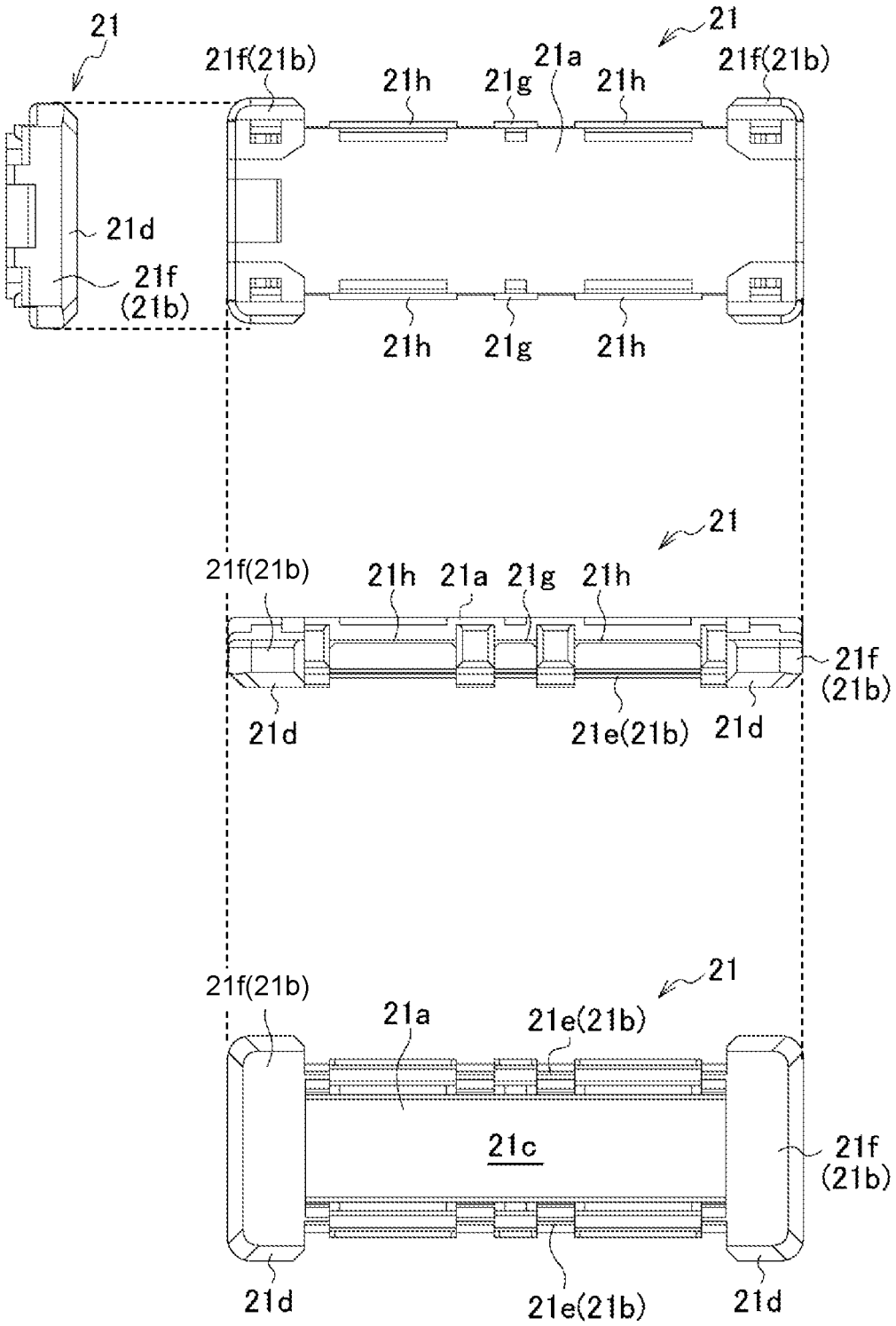
FIG. 6 is a diagram showing the header housing of the connector according to the first exemplary embodiment of the present invention.
Figure 7A:
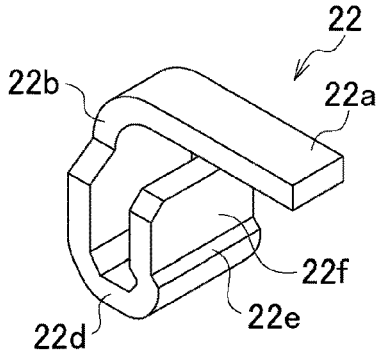
FIG. 7A is a first perspective view of a header-side signal terminal of the connector according to the first exemplary embodiment of the present invention.
Figure 7B:
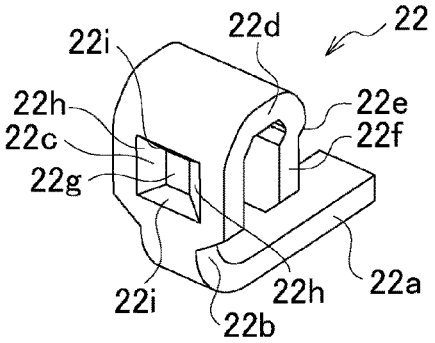
FIG. 7B is a second perspective view of the header-side signal terminal shown in FIG. 7A.
Figure 7C:
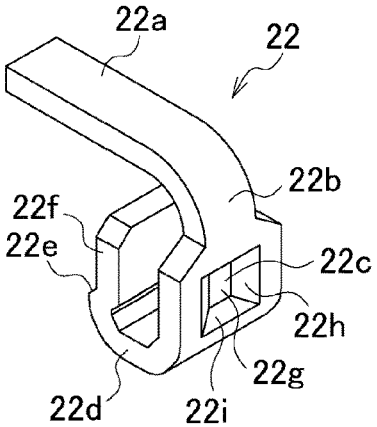
FIG. 7C is a third perspective view of the header-side signal terminal shown in FIG. 7A.
Figure 7D:
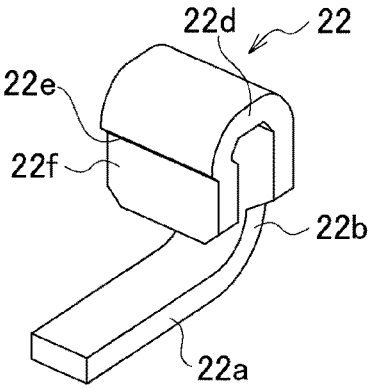
FIG. 7D is a fourth perspective view of the header-side signal terminal shown in FIG. 7A.
Figure 8:
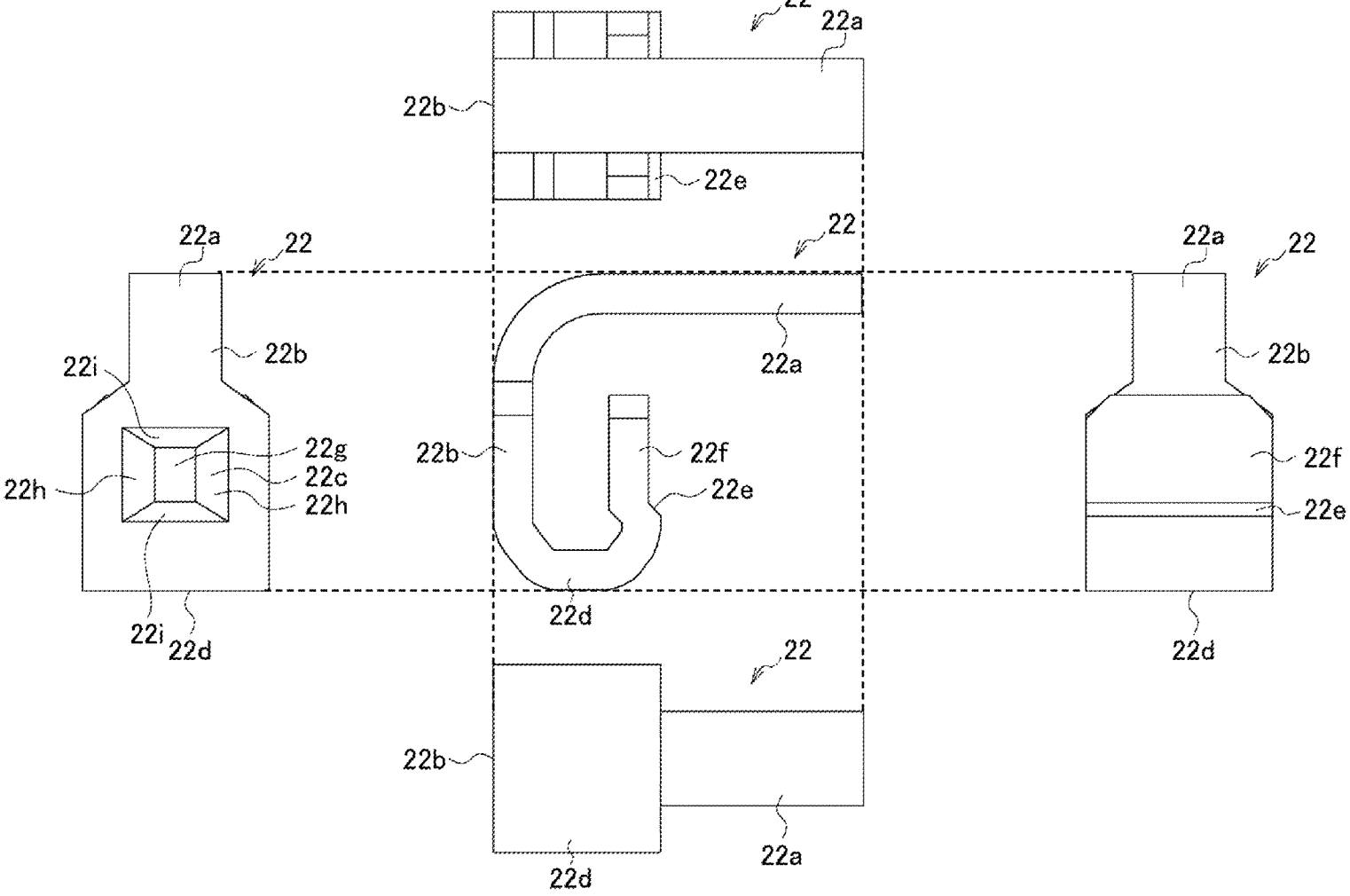
FIG. 8 is a diagram showing the header-side signal terminal of the connector according to the first exemplary embodiment of the present invention.

Header housing 21 is formed to be substantially box-like with plate-like wall part 21*a* and circumferential wall part 21*b* formed continuously in a substantial rectangular annular shape along the circumference of plate-like wall part 21*a*, so as to open on one side (the bottom side in FIG. 5). On the inner side of circumferential wall part 21*b*, recessed part 21*c* (see FIG. 1) is formed. At the lower end in the outer circumferential side of circumferential wall part 21*b*, tapered parts 21*d* that are inclined to become higher (position toward plate-like wall part 21*a*) as they are positioned outward are formed. Tapered parts 21*d* are formed at the opposite ends in the long side direction of long side direction wall parts 21*e* of circumferential wall part 21*b* and the entire width direction Y of short side direction wall parts 21*f* of circumferential wall part 21*b*. That is, at the opposite ends in long side direction X of header housing 21, tapered parts 21*d* each being substantially U-shaped in a plan view (as seen from the back surface) are formed by short side direction wall parts 21*f* and the opposite ends in the long side direction of long side direction wall parts 21*e* continuous to the opposite ends in width direction Y of short side direction wall parts 21*f*.

Note that, each circumferential wall part 21*b* between adjacent header-side signal terminal 22 and header-side power supply terminal 23 is formed to be rounded (inverted U-shaped).

Further, header housing 21 is formed so that the length of short side direction wall part 21*f* in width direction Y becomes greater than the distance between two opposite long side direction wall parts 21*e*. Thus, header housing 21 is substantially I-shaped as a whole in a plan view.

Next, with reference to FIGS. 7A to 9B, a description will be given of the structure of each header-side signal terminal 22.

Header-side signal terminal 22 is fabricated by metal molding, and is an electrically conductive element. Header-side signal terminal 22 has root part 22*a* that projects from the side surface of header housing 21. Root part 22*a* is a site that is fixed to circuit pattern 41 of second circuit board 40 with solder 50. Further, as can be seen from FIG. 29, the upper surface of root part 22*a* extends substantially in parallel to the upper surface of header housing 21 (the outer surface of plate-like wall part 21*a*).

Further, header-side signal terminal 22 has inner side part 22*b* that is continuous to root part 22*a*. Inner side part 22*b* penetrates through the joining part between plate-like wall part 21*a* and long side direction wall part 21*e* of header housing 21 while bending, and extends to the tip part of long side direction wall part 21*e* along the inner surface of long side direction wall part 21*e*.

On the inner surface of inner side part 22*b* of header-side signal terminal 22, recessed part 22*c* is formed. In the present exemplary embodiment, recessed part 22*c* is formed to become a substantial truncated square pyramid by flat depth surface 22*g*, inclined surfaces 22*h* respectively provided continuously on the opposite sides in long side direction X of depth surface 22*g*, and inclined surfaces 22*i* respectively provided continuously on the opposite sides in top-bottom direction Z of depth surface 22*g*. Into recessed part 22*c*, arc-shaped projecting part 32*k* of socket-side signal terminal 32, which will be described later, fits.

Further, header-side signal terminal 22 has tip part 22*d* that is continuous to one end of inner side part 22*b*. Tip part 22*d* bends along the shape of the tip of long side direction wall part 21*e* of header housing 21.

Header-side signal terminal 22 has engaged part 22*e* that is continuous to tip part 22*d*. In the present exemplary embodiment, engaged part 22*e* is formed from one end to the other end in long side direction X of header housing 21 in header-side signal terminal 22. That is, step-like engaged part 22*e* is formed over the entire width direction of header-side signal terminal 22.

Figure 29:
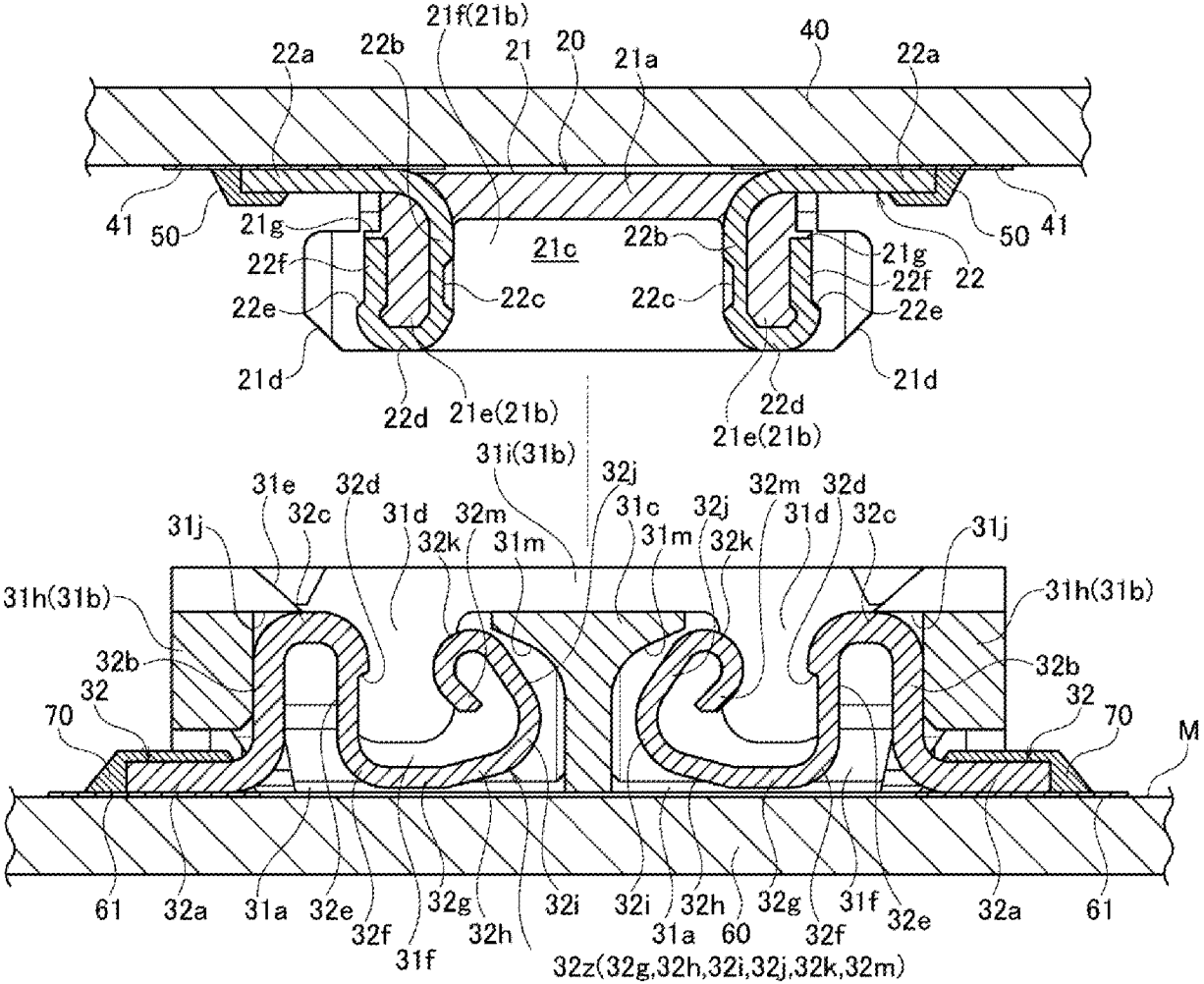
FIG. 29 is a cross-sectional view taken along a site where the header-side signal terminals and the socket-side signal terminals are disposed, showing a state immediately before the header and the socket according to the first exemplary embodiment of the present invention are fitted to each other.
Figure 30:
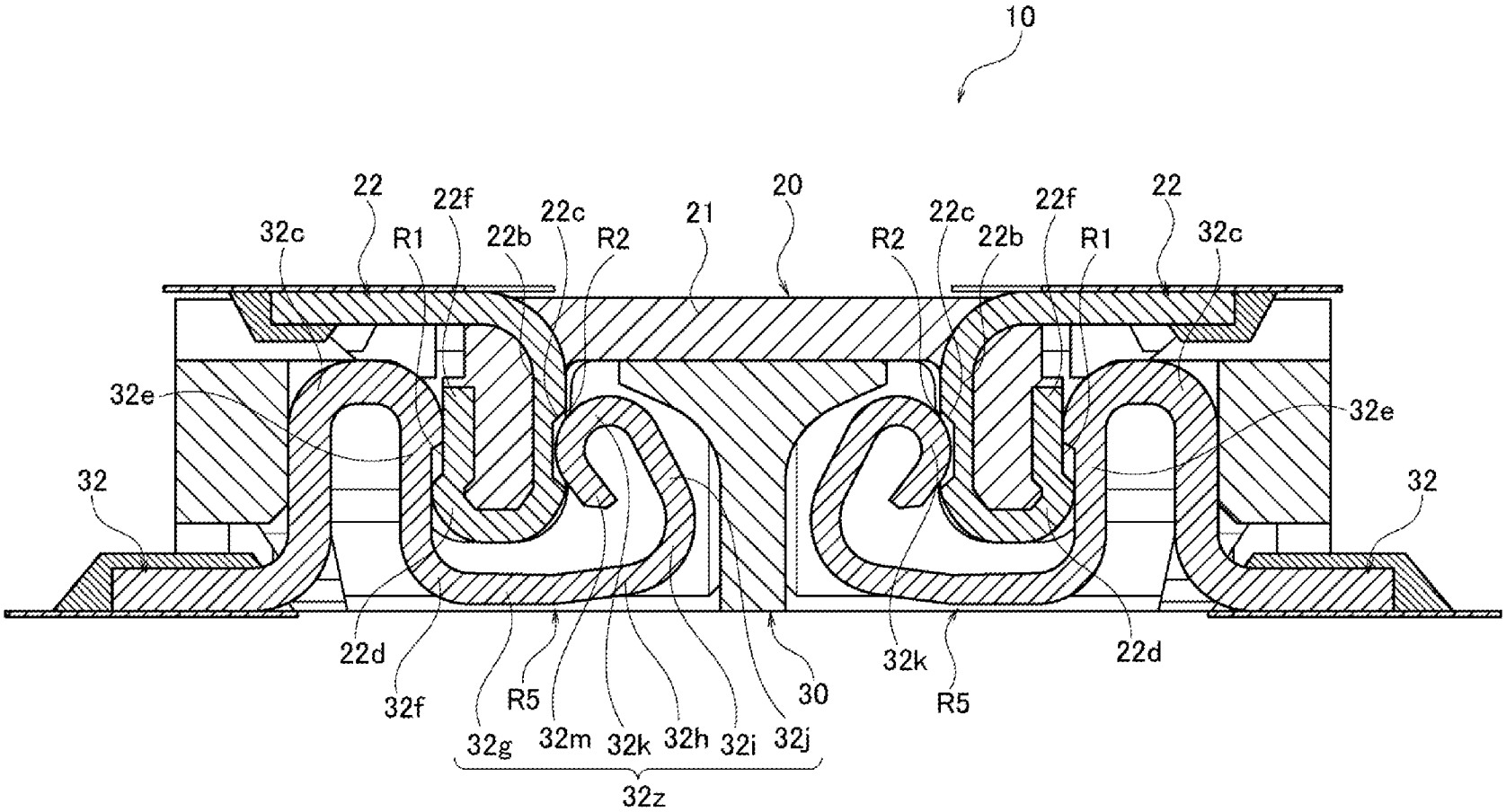
FIG. 30 is a cross-sectional view taken along a site where the header-side signal terminals and the socket-side signal terminals are disposed, showing a state where the header and the socket according to the first exemplary embodiment of the present invention are fitted to each other.

As can be seen from comparison between FIG. 29 and FIG. 30, when header-side signal terminal 22 is fitted into socket-side signal terminal 32, engaged part 22*e* is inserted deeper than engaging part 32*d* as a step part. Accordingly, when header-side signal terminal 22 is pulled out from socket-side signal terminal 32, engaged part 22*e* abuts on engaging part 32*d*. That is, engaged part 22*e* of header-side signal terminal 22 is engaged by engaging part 32*d* of socket-side signal terminal 32. Accordingly, header-side signal terminal 22 is restricted from coming off from socket-side signal terminal 32. That is, header-side signal terminal 22 cannot be pulled out from socket-side signal terminal 32 just by application of external force which is smaller than a predetermined value. On the other hand, header-side signal terminal 22 can be pulled out from socket-side signal terminal 32 by application of external force which is equal to or greater than the predetermined value. That is, engaged part 22*e* of header-side signal terminal 22 and engaging part 32*d* of socket-side signal terminal 32 structure a lock mechanism which is capable of releasing engagement between them by application of external force being equal to or greater than a predetermined value.

Engaged part 22*e* may be formed by rolling of a base material which is performed to partially vary the thickness of header-side signal terminal 22. Alternatively, engaged part 22*e* may be formed by forming to bend the base material of header-side signal terminal 22 in the thickness direction.

Further, header-side signal terminal 22 has outer side part 22*f* that is continuous to tip part 22*d* via engaged part 22*e*, and extends along the outer surface of long side direction wall part 21*e*. In the present exemplary embodiment, projecting wall part 21*g* projecting at the outer circumference of long side direction wall part 21*e* (circumferential wall part 21*b*) positions the tip of outer side part 22*f* of header-side signal terminal 22.

Such header-side signal terminal 22 can be formed by bend-forming a band-like metal member having a predetermined thickness.

Further, in the present exemplary embodiment, header-side signal terminal 22 is disposed in header housing 21 by insert molding. Note that, header-side signal terminal 22 may be disposed in header housing 21 by press-fitting header-side signal terminal 22 into header housing 21.

Next, with reference to FIGS. 10A to 12B, a description will be given of the structure of header-side power supply terminal 23.

Header-side power supply terminal 23 is formed by metal molding, and is an electrically conductive element. Header-side power supply terminal 23 has root part 23*a* that projects from the side surface of header housing 21. Root part 23*a* is a site that is fixed with solder 50 to circuit pattern 41 of second circuit board 40. Further, as can be seen from FIG. 31, the upper surface of root part 23*a* extends substantially in parallel to the upper surface of header housing 21 (the outer surface of plate-like wall part 21*a*).

Further, header-side power supply terminal 23 has inner side part 23*b* that is continuous to root part 23*a*. Inner side part 23*b* penetrates through the joining part between plate-like wall part 21*a* and long side direction wall part 21*e* of header housing 21 while bending, and extends to the tip part of long side direction wall part 21*e* along the inner surface of long side direction wall part 21*e*.

On the inner surface of inner side part 23*b* of header-side power supply terminal 23, recessed part 23*c* is formed. In the present exemplary embodiment, recessed part 23*c* is formed to become a substantial truncated square pyramid by flat depth surface 23*g*, inclined surfaces 23*h* respectively provided continuously on the opposite sides in long side direction X of depth surface 23*g*, and inclined surfaces 23*i* respectively provided continuously in the top-bottom direction Z of depth surface 23*g*. Into recessed part 23*c*, arc-shaped projecting part 33*k* of socket-side power supply terminal 33, which will be described later, fits.

Further, header-side power supply terminal 23 has tip part 23*d* that is continuous to one end of inner side part 23*b*. Tip part 23*d* bends along the shape of the tip of long side direction wall part 21*e* of header housing 21.

Header-side power supply terminal 23 has engaged part 23*e* that is continuous to tip part 23*d*. As can be seen from comparison between FIG. 31 and FIG. 32, when header-side power supply terminal 23 is fitted into socket-side power supply terminal 33, engaged part 23*e* is inserted deeper than engaging part 33*d* as a step part. Accordingly, when header-side power supply terminal 23 is pulled out from socket-side power supply terminal 33, engaged part 23*e* abuts on engaging part 33*d*. That is, engaged part 23*e* of header-side power supply terminal 23 is engaged by engaging part 33*d* of socket-side power supply terminal 33. Accordingly, header-side power supply terminal 23 is restricted from coming off from socket-side power supply terminal 33. That is, header-side power supply terminal 23 cannot be pulled out from socket-side power supply terminal 33 just by application of external force which is smaller than a predetermined value. On the other hand, header-side power supply terminal 23 can be pulled out from socket-side power supply terminal 33 by application of external force which is equal to or greater than the predetermined value. That is, engaged part 23*e* of header-side power supply terminal 23 and engaging part 33*d* of socket-side power supply terminal 33 structure a lock mechanism which is capable of releasing engagement between them by application of external force being equal to or greater than a predetermined value.

Engaged part 23*e* may be formed by rolling of a base material which is performed to partially vary the thickness of header-side power supply terminal 23. Alternatively, engaged part 23*e* may be formed by forming to bend the base material of header-side power supply terminal 23 in the thickness direction.

Further, header-side power supply terminal 23 has outer side part 23*f* that is continuous to tip part 23*d* via engaged part 23*e*, and extends along the outer surface of long side direction wall part 21*e*. In the present exemplary embodiment, projecting wall part 21*h* projecting at the outer circumference of long side direction wall part 21*e* (circumferential wall part 21*b*) positions the tip of outer side part 23*f* of header-side power supply terminal 23.

Figure 9A:
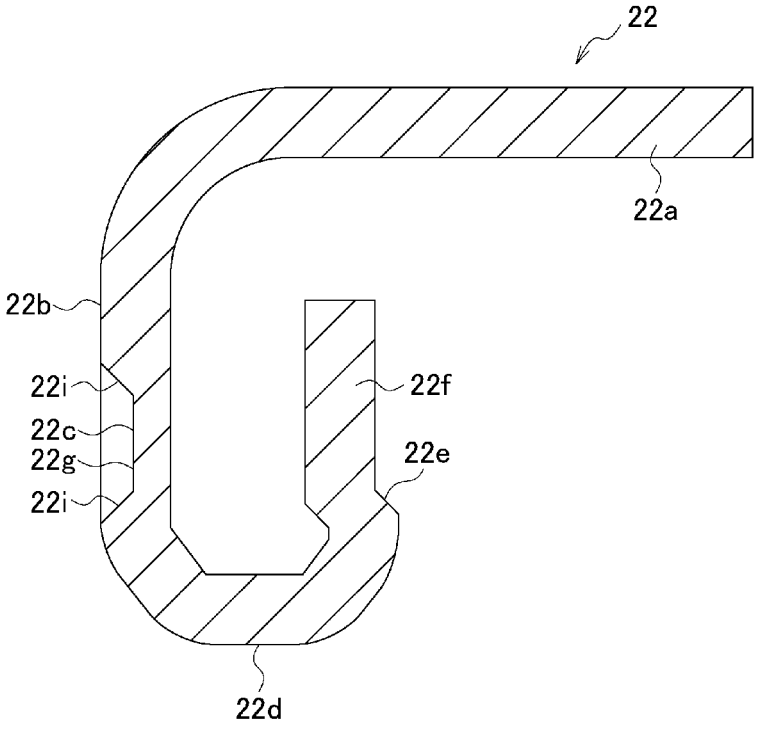
FIG. 9A is a side cross-sectional view of the header-side signal terminal of the connector according to the first exemplary embodiment of the present invention.
Figure 9B:
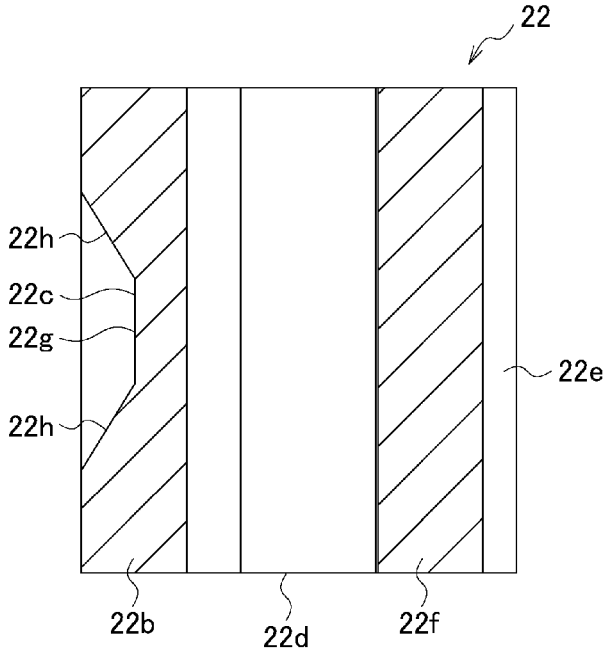
FIG. 9B is a horizontal cross-sectional view of the header-side signal terminal shown in FIG. 9A.
Figure 10A:
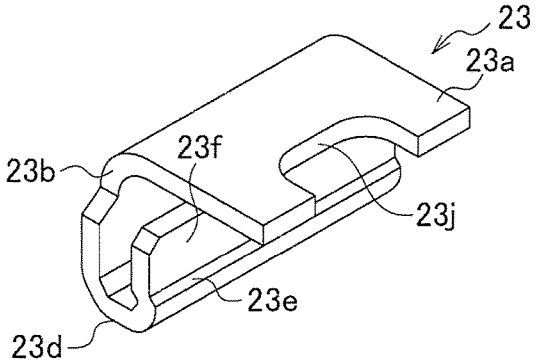
FIG. 10A is a first perspective view of a header-side power supply terminal of the connector according to the first exemplary embodiment of the present invention.
Figure 10B:
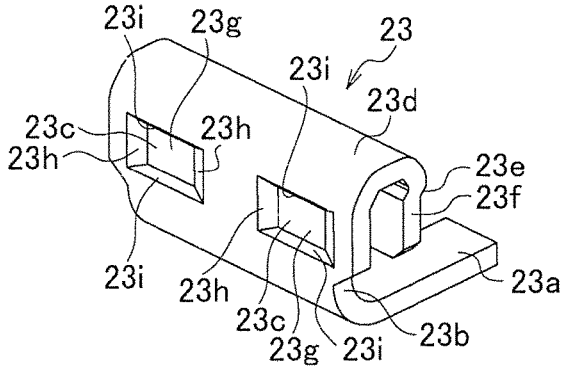
FIG. 10B is a second perspective view of the header-side power supply terminal shown in FIG. 10A.
Figure 10C:
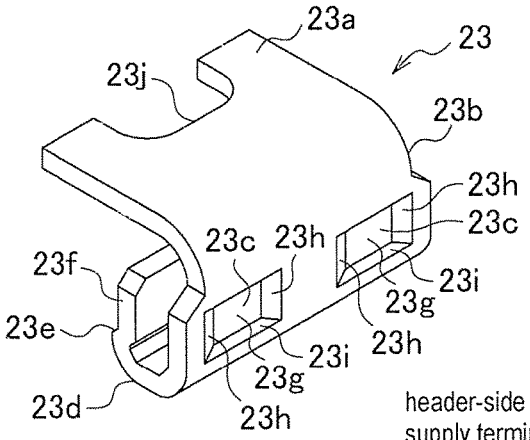
FIG. 10C is a third perspective view of the header-side power supply terminal shown in FIG. 10A.
Figure 10D:
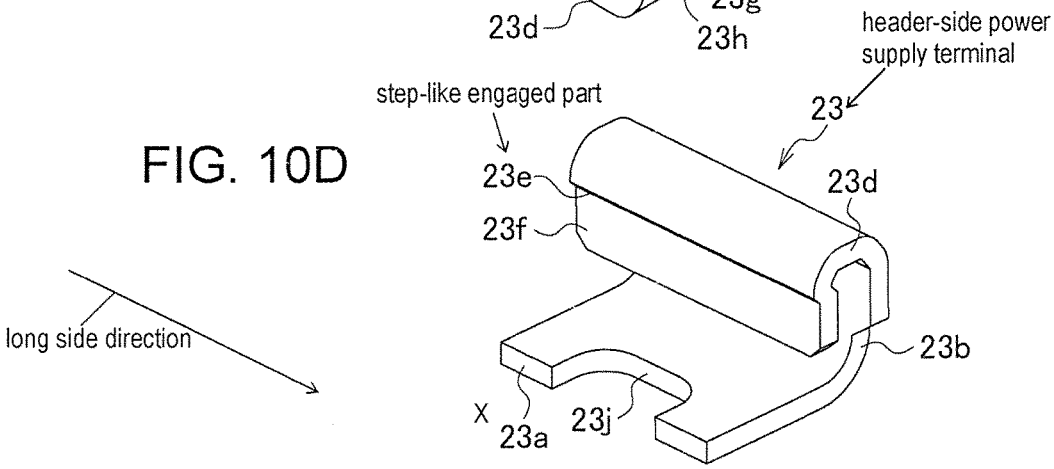
FIG. 10D is a fourth perspective view of the header-side power supply terminal shown in FIG. 10A.
Figure 11:
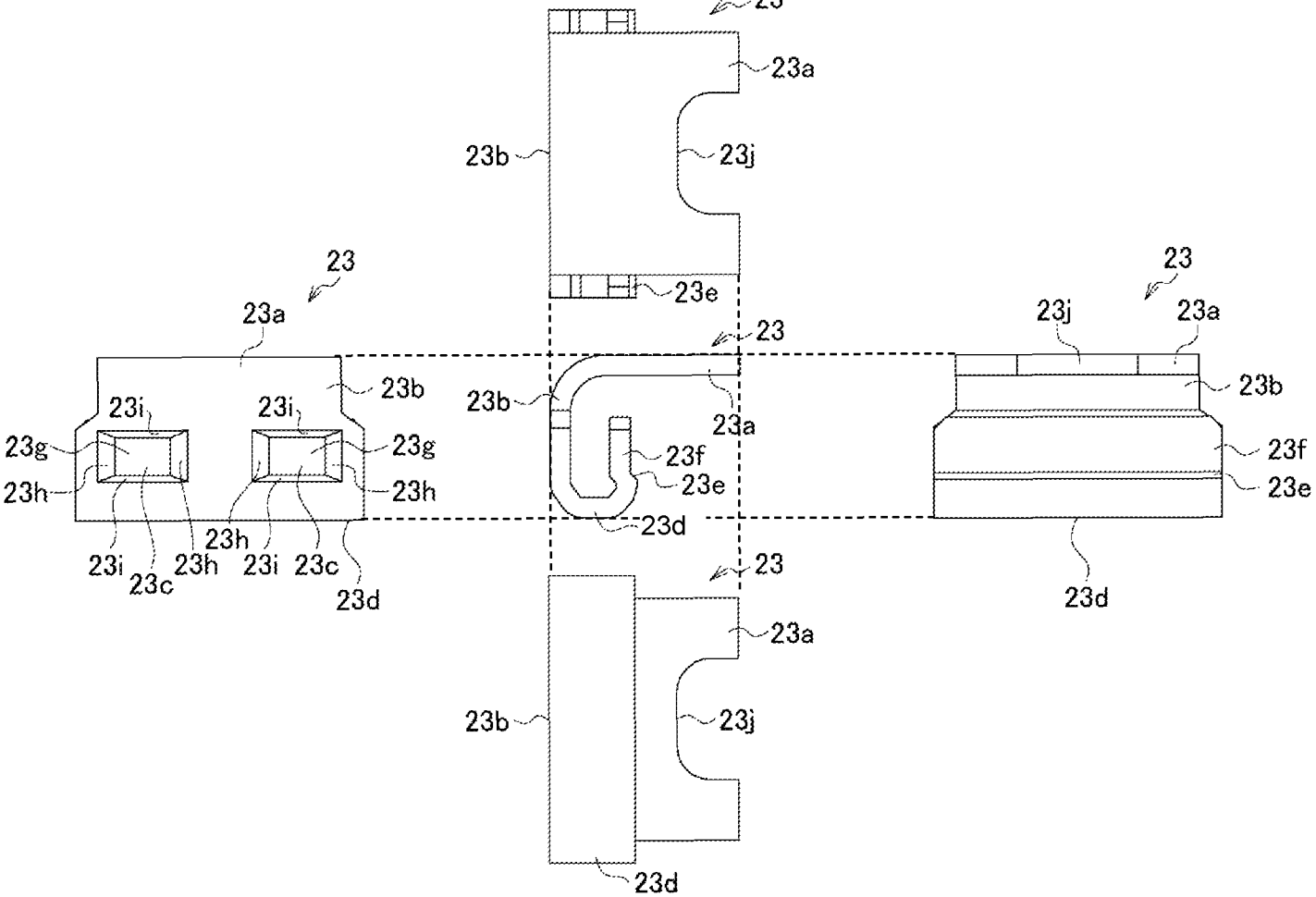
FIG. 11 is a diagram showing the header-side power supply terminal of the connector according to the first exemplary embodiment of the present invention.
Figure 12A:
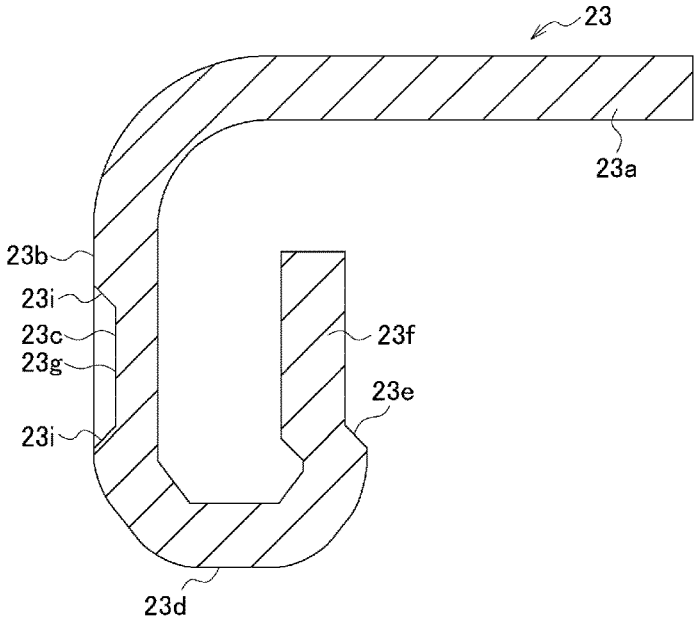
FIG. 12A is a side cross-sectional view of the header-side power supply terminal of the connector according to the first exemplary embodiment of the present invention.
Figure 12B:
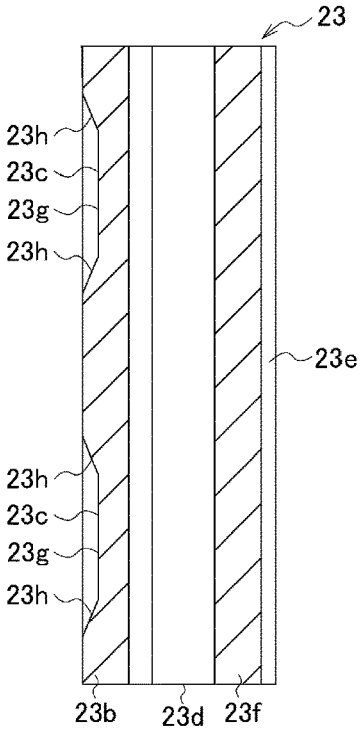
FIG. 12B is a horizontal cross-sectional view of the header-side power supply terminal shown in FIG. 12A.

In this manner, in the present exemplary embodiment, the side cross-sectional shape of header-side signal terminal 22 and the side cross-sectional shape of header-side power supply terminal 23 are substantially identical to each other (see FIGS. 9A and 12A).

Further, as described above, header-side signal terminal 22 and header-side power supply terminal 23 are disposed along long side direction X of header housing 21. In the present exemplary embodiment, header-side power supply terminal 23 is formed so that its width along long side direction X of header housing 21 becomes greater than the width of header-side signal terminal 22 along long side direction X.

That is, in the present exemplary embodiment, header-side signal terminal 22 is smaller than header-side power supply terminal 23 in the width in long side direction X of header housing 21. Note that, in the present exemplary embodiment, every header-side signal terminal 22 is smaller than header-side power supply terminal 23 in the width in long side direction X of header housing 21.

In this manner, since header-side power supply terminal 23 is provided with a great width along long side direction X of header housing 21, recessed part 23*j* having a cutout shaped in a recessed manner is formed at the center in long side direction X of root part 23*a*. Forming recessed part 23*j*, while an increase in the projection amount of root part 23*a* is suppressed, the length of the contour of root part 23*a* in contact with the circuit pattern can be increased. Further, the contour can have a complicated shape. This increases the fixing strength exerted by solder 50 between root part 23*a* and circuit pattern 41 in fixing header-side power supply terminal 23 having a great width to circuit pattern 41 of second circuit board 40 with solder 50, as compared to the case where recessed part 23*j* is not formed.

Further, on the inner surface of inner side part 23*b* of header-side power supply terminal 23, two recessed parts 23*c* are formed along long side direction X, into which two arc-shaped projecting parts 33*k* of socket-side power supply terminal 33, which will be described later, respectively fit.

Still further, in the present exemplary embodiment, engaged part 23*e* is formed from one end to the other end in long side direction X of header housing 21 in header-side power supply terminal 23. That is, step-like engaged part 23*e* is formed over the entire width direction of header-side power supply terminal 23 having a great width. This improves the locking force exerted by engaged part 23*e* of header-side power supply terminal 23 and engaging part 33*d* of socket-side power supply terminal 33. Further, engaged part 23*e* becomes wear-resistant against repeated insertion/disconnection of header 20 and socket 30. Thus, the life of the product increases.

Such header-side power supply terminal 23 can be formed by bend-forming a band-like metal member having a predetermined thickness.

Further, in the present exemplary embodiment, header-side power supply terminal 23 is disposed in header housing 21 by insert molding. Note that, header-side power supply terminal 23 may be disposed in header housing 21 by press-fitting header-side power supply terminal 23 into header housing 21.

Figure 13A:
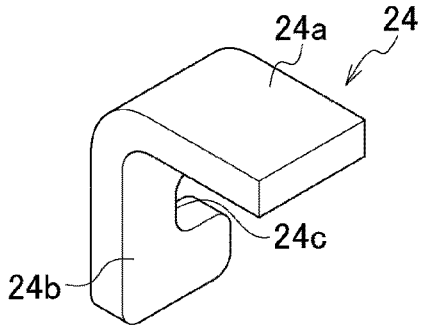
FIG. 13A is a first perspective view of a header-side retainer of the connector according to the first exemplary embodiment of the present invention.
Figure 13B:
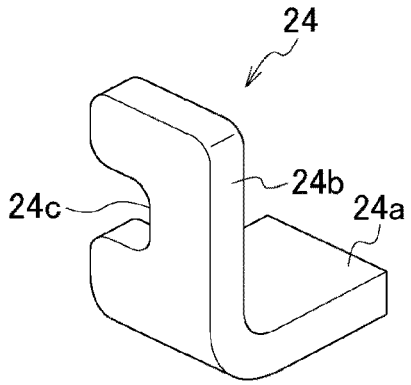
FIG. 13B is a second perspective view of the header-side retainer shown in FIG. 13A.
Figure 13C:
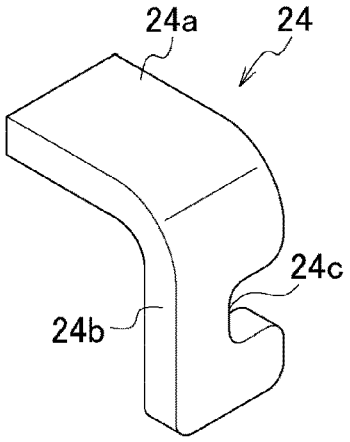
FIG. 13C is a third perspective view of the header-side retainer shown in FIG. 13A.
Figure 13D:
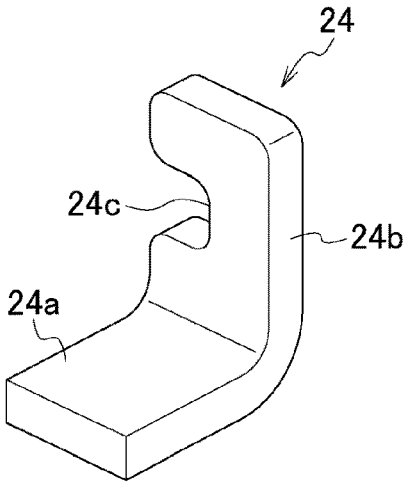
FIG. 13D is a fourth perspective view of the header-side retainer shown in FIG. 13A.
Figure 14:
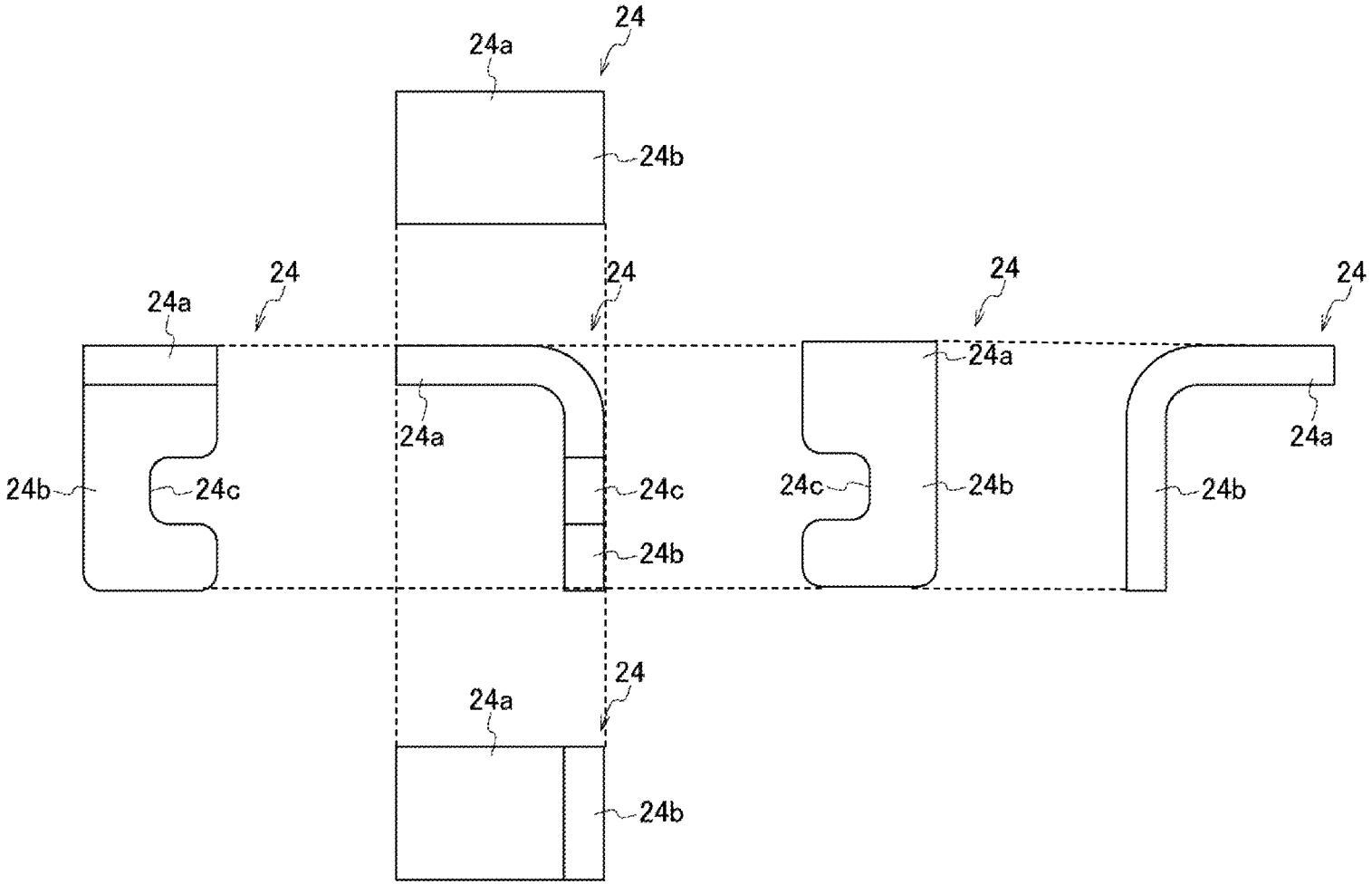
FIG. 14 is a diagram showing the header-side retainer of the connector according to the first exemplary embodiment of the present invention.

Next, with reference to FIGS. 13A to 14, a description will be given of the structure of header-side retainer 24.

Header-side retainer 24 is formed by metal molding similarly to header-side signal terminal 22 and header-side power supply terminal 23.

Header-side retainer 24 has fixed terminal 24*a* that projects from the side surface of header housing 21. Fixed terminal 24*a* is a site that is fixed with solder 50 to circuit pattern 41 of second circuit board 40. Further, the upper surface of fixed terminal 24*a* also extends substantially in parallel to the upper surface of header housing 21 (the outer surface of plate-like wall part 21*a*).

Further, header-side retainer 24 has inner side part 24*b* that is continuous to fixed terminal 24*a*. At inner side part 24*b*, cutout 24*c* that opens on one side in long side direction X is formed. Forming such cutout 24*c* at inner side part 24*b* brings header housing 21 and header-side retainer 24 into contact with each other more tightly, and further enhances the strength of header housing 21.

Further, in the present exemplary embodiment, header-side retainer 24 is disposed in header housing 21 by insert molding. Note that, header-side retainer 24 may be disposed in header housing 21 by press-fitting header-side retainer 24 into header housing 21.

Next, with reference to FIGS. 15 to 28, a description will be given of socket 30 used in connector 10.

As described above, socket 30 has socket housing 31. In the present exemplary embodiment, socket housing 31 is molded with insulating synthetic resin to be quadrangular (rectangular) as a whole in a plan view (see FIGS. 15 to 20).

In socket housing 31, metal-made socket-side signal terminals 32 and metal-made socket-side power supply terminals 33 are disposed. Socket-side signal terminals 32 are electrically connected to a signal line for transmitting signals. On the other hand, socket-side power supply terminals 33 are electrically connected to a power supply line for supplying power.

In the present exemplary embodiment, one socket-side signal terminal 32 and two socket-side power supply terminals 33 are juxtaposed to each other while being spaced apart from each other, along one long side of socket housing 31. One socket-side signal terminal 32 and two socket-side power supply terminals 33 juxtaposed to each other on one side in width direction (short side direction) Y of socket housing 31 form socket-side terminal group G2.

Further, along the other long side of socket housing 31 also, one socket-side signal terminal 32 and two socket-side power supply terminals 33 are juxtaposed to each other while being spaced apart from each other. One socket-side signal terminal 32 and two socket-side power supply terminals 33 juxtaposed to each other on the other side in width direction (short side direction) Y of socket housing 31 also form socket-side terminal group G2.

In this manner, in the present exemplary embodiment, in socket housing 31, two lines (a plurality of lines) of socket-side terminal groups G2 are disposed, each of socket-side terminal group G2 being formed by socket-side signal terminal 32 and socket-side power supply terminals 33 disposed along long side direction X in socket housing 31.

Further, in socket-side terminal group G2 of one line, socket-side power supply terminals 33 are respectively disposed at the opposite ends of socket-side signal terminal 32. In other words, socket-side power supply terminals 33 are disposed at opposite ends in long side direction X of socket housing 31, and socket-side signal terminal 32 is disposed between socket-side power supply terminals 33. In this manner, in the present exemplary embodiment, socket-side power supply terminals 33 are disposed on the outer side in long side direction X of socket housing 31 relative to socket-side signal terminal 32.

Note that, socket-side signal terminals 32 and socket-side power supply terminals 33 are disposed in socket housing 31 so as to be respectively brought into contact with corresponding header-side signal terminals 22 and header-side power supply terminals 23 when header 20 and socket 30 are fitted to each other.

Further, in the present exemplary embodiment, metal-made socket-side retainers 34 are disposed at the opposite ends in long side direction X of socket housing 31. Socket-side retainers 34 are used for enhancing the strength of socket housing 31, and fixing fixed terminals 34*d* of socket-side retainers 34 to the above-described first circuit board 60.

Next, with reference to FIGS. 18 to 20, a description will be given of the structure of socket housing 31.

Figure 15:
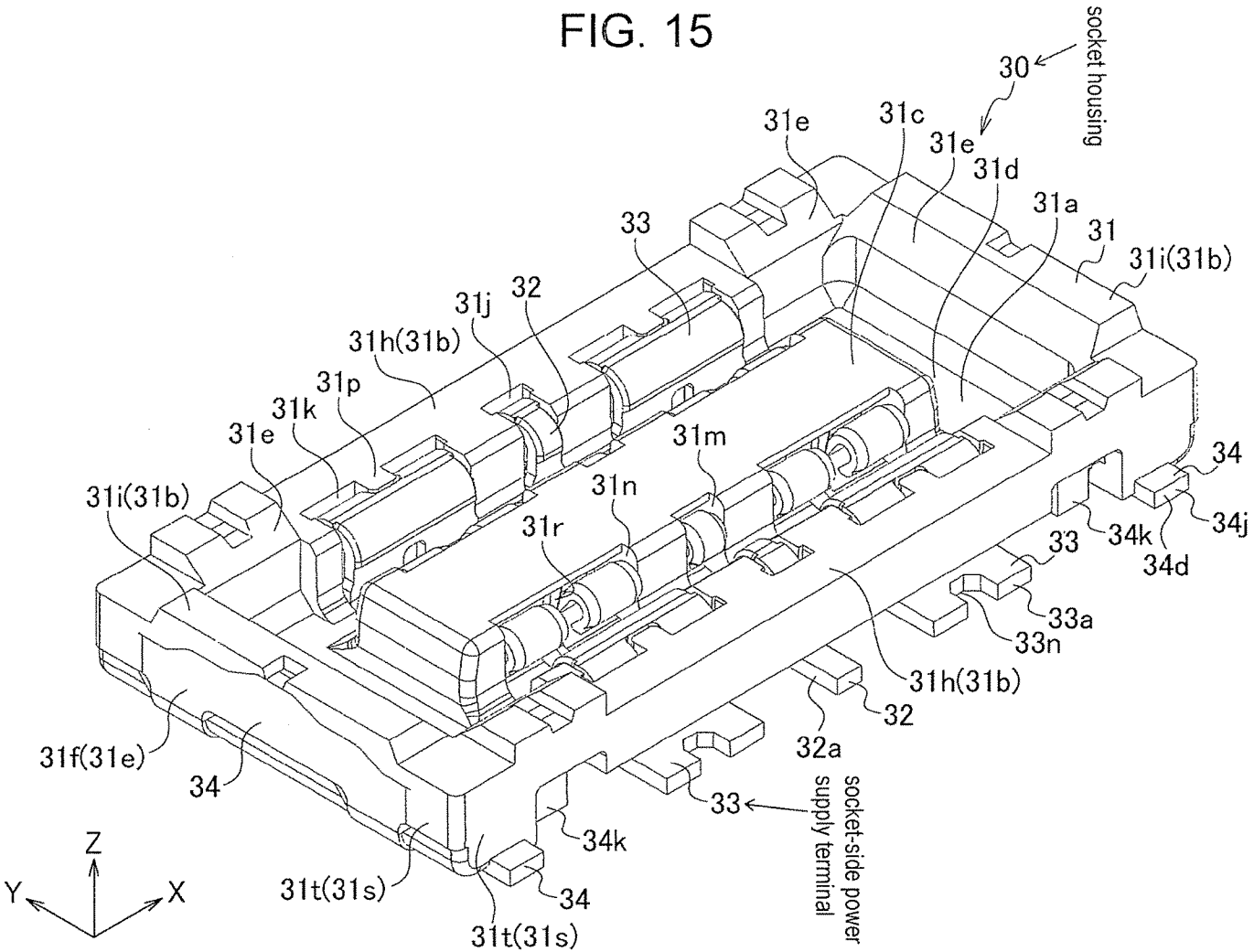
FIG. 15 is a perspective view of a socket of the connector according to the first exemplary embodiment of the present invention as seen from the front surface side.
Figure 16:
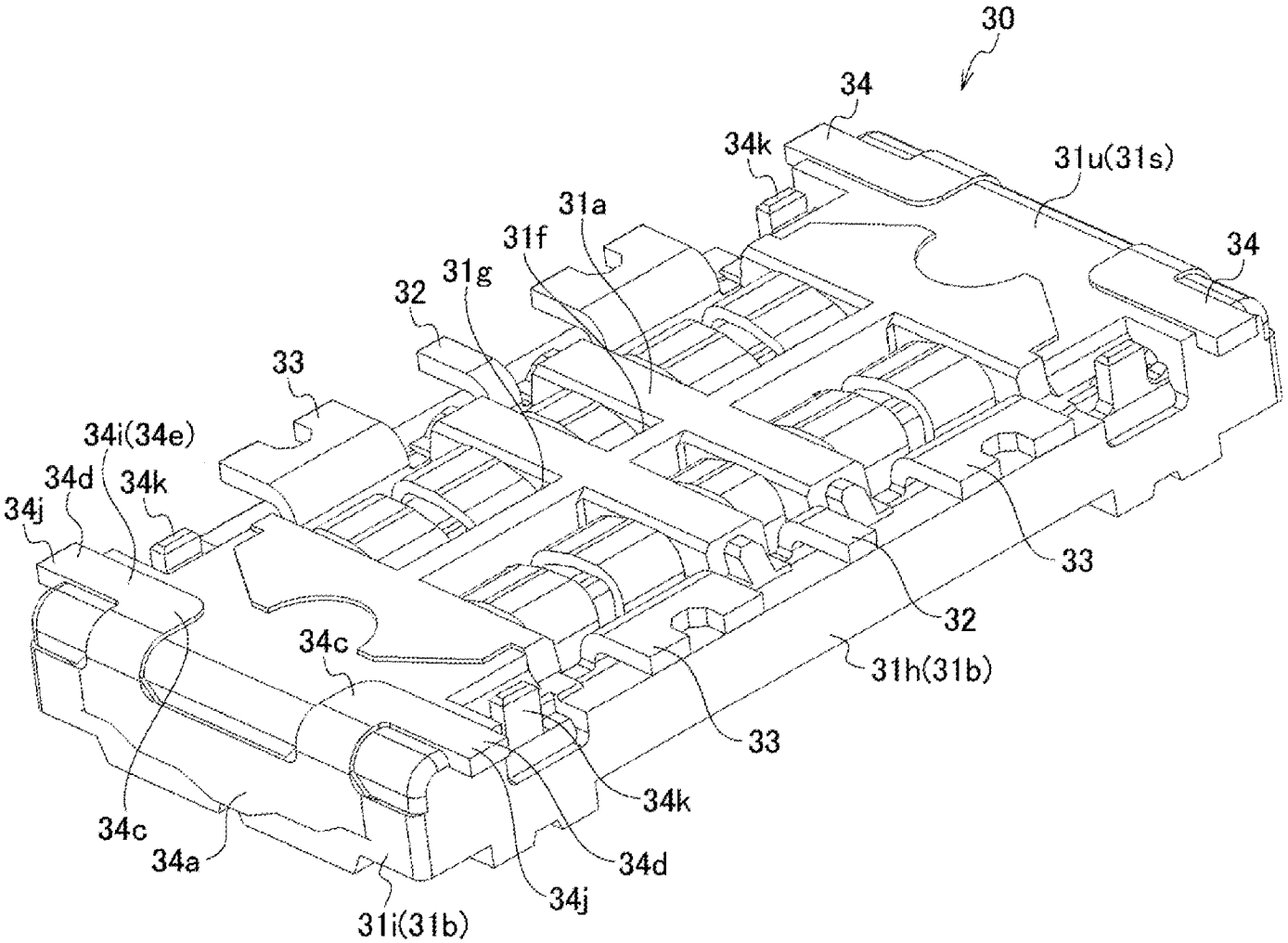
FIG. 16 is a perspective view of the socket of the connector according to the first exemplary embodiment of the present invention as seen from the back surface side.
Figure 17:
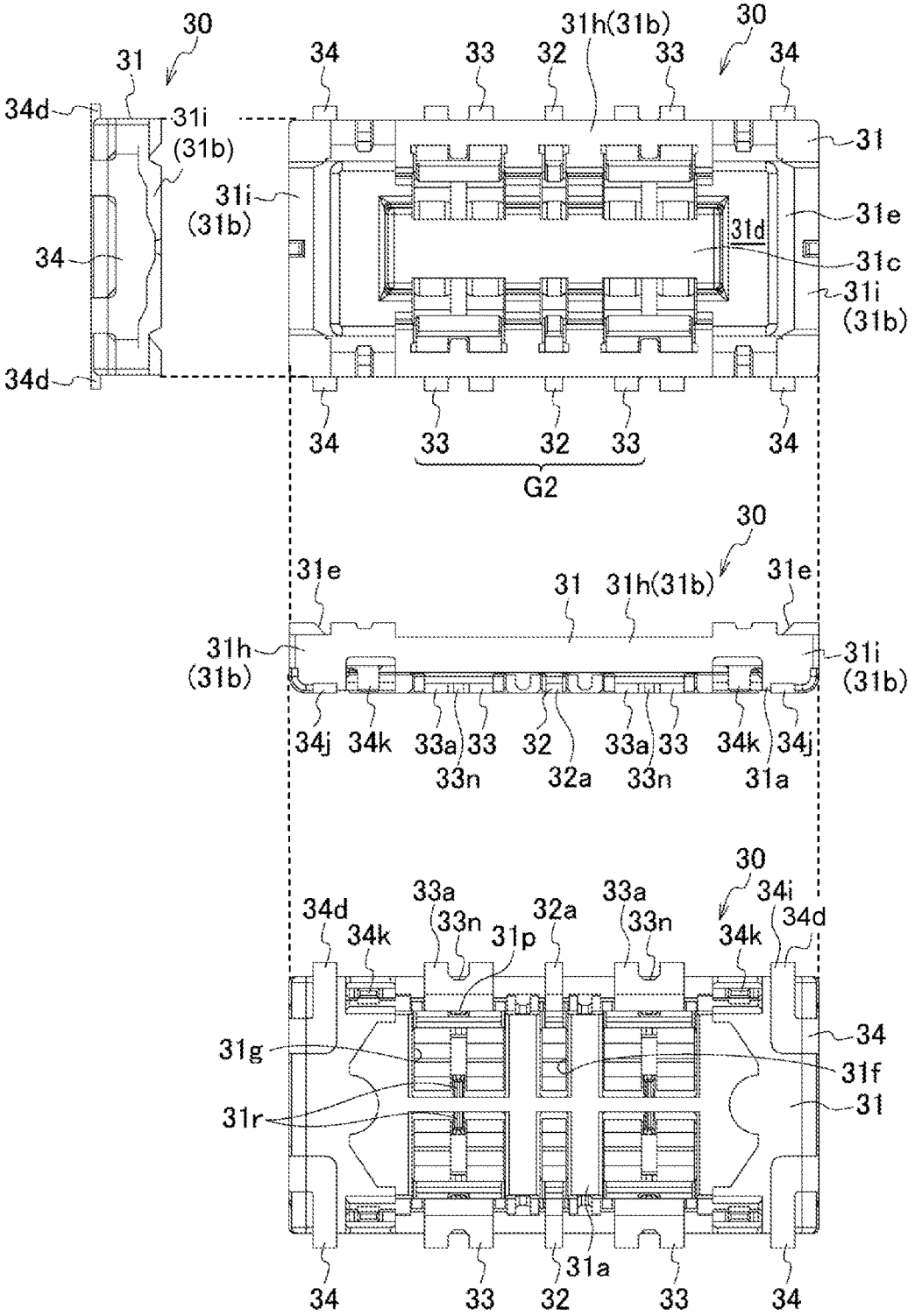
FIG. 17 is a diagram showing the socket of the connector according to the first exemplary embodiment of the present invention.

Socket housing 31 is formed to be substantially box-like with plate-like wall part 31*a* and circumferential wall part 31*b* formed continuously in a substantial rectangular annular shape along the circumference of plate-like wall part 31*a*, so as to open on one side (the top side in FIG. 15). Further, in the present exemplary embodiment, substantially quadrangular island part 31*c* is formed at the center of plate-like wall part 31*a*, with a predetermined distance from circumferential wall part 31*b*. Between circumferential wall part 31*b* and island part 31*c*, substantially frame-like fitting groove part 31*d* is formed for circumferential wall part 21*b* of header 20 to be fitted into. Note that, island part 31*c* fits into recessed part 21*c*.

Further, since short side direction wall parts 21*f* and long side direction wall parts 21*e* fit into fitting groove part 31*d*, fitting groove part 31*d* is formed so that its width is greater at the opposite ends in long side direction X.

Still further, in the present exemplary embodiment, at the upper end on the inner circumferential side of circumferential wall part 31*d*, tapered parts 31*e* that are inclined to become lower (position toward plate-like wall part 31*a*) as they are positioned inward are formed. Tapered parts 31*e* are formed at the opposite ends in the long side direction of long side direction wall part 31*h* of circumferential wall part 31*b* and short side direction wall parts 31*i* of circumferential wall part 31*b*. Further, tapered parts 31*e* are formed also at circumferential wall part 31*b* between adjacent socket-side signal terminal 32 and socket-side power supply terminal 33. In this manner, tapered parts 31*e* are formed over substantially the entire circumference of circumferential wall part 31*b* in the present exemplary embodiment.

Figure 18:
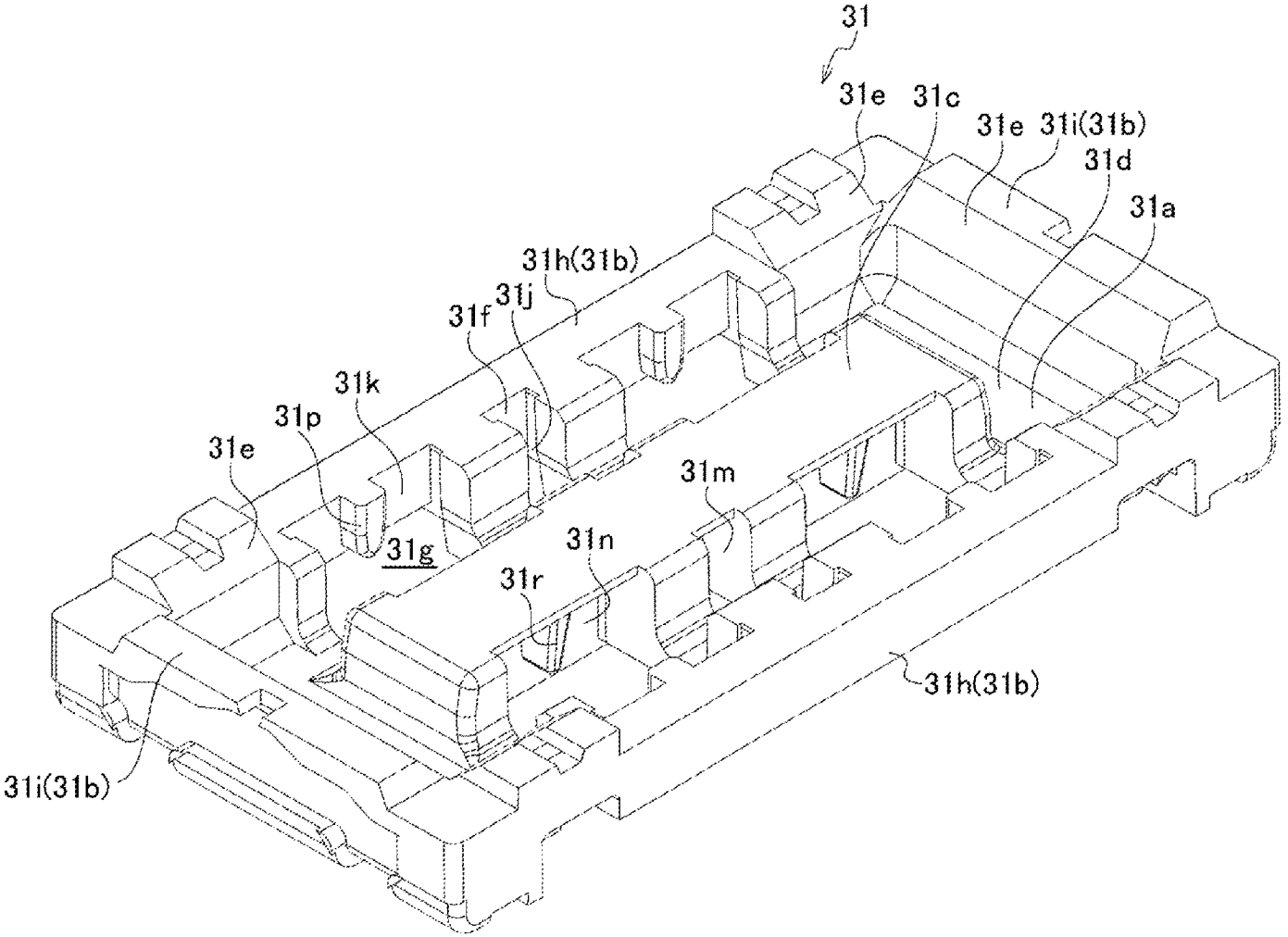
FIG. 18 is a perspective view of a socket housing of the connector according to the first exemplary embodiment of the present invention as seen from the front surface side.
Figure 19:
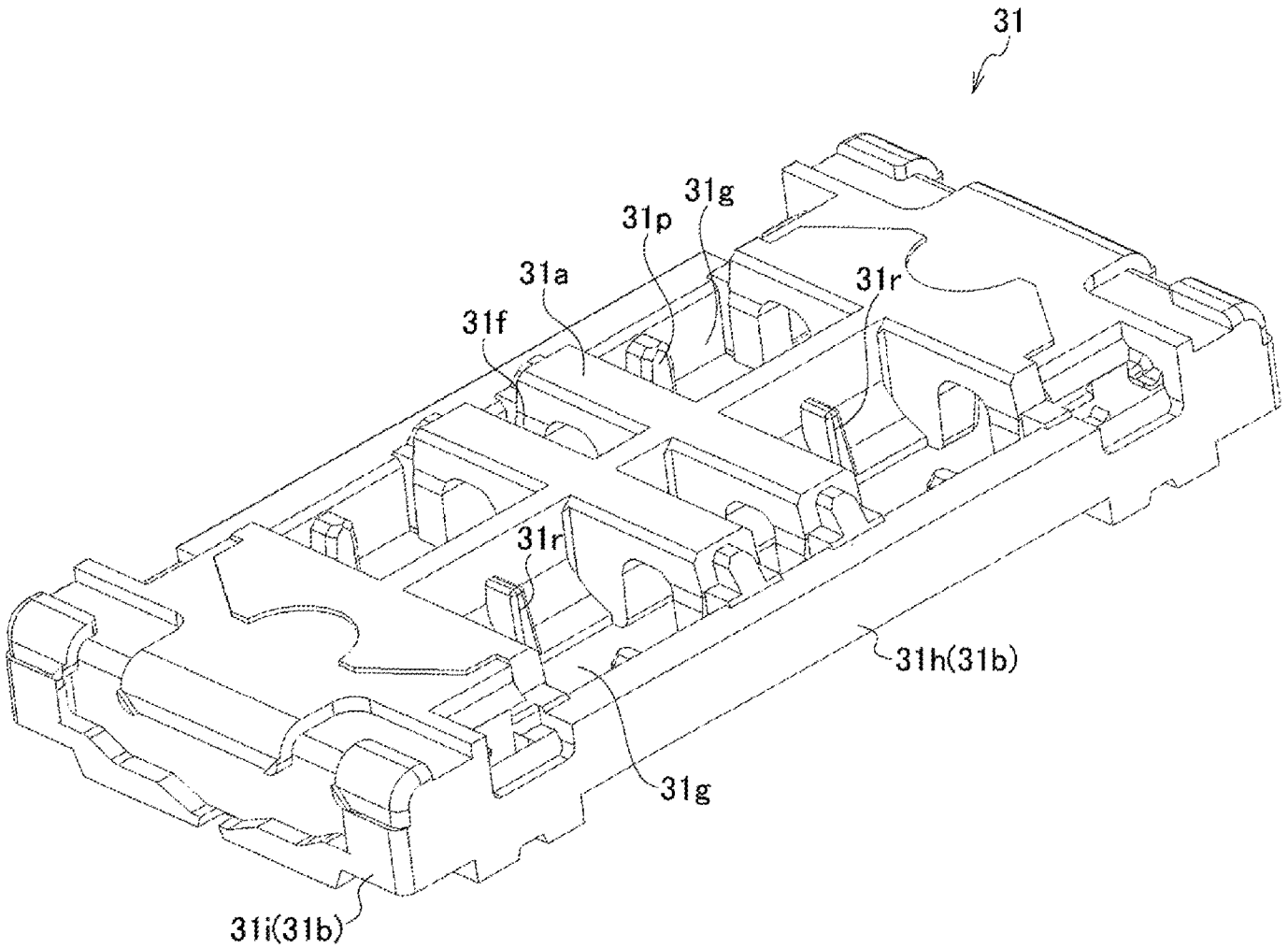
FIG. 19 is a perspective view of the socket housing of the connector according to the first exemplary embodiment of the present invention as seen from the back surface side.
Figure 20:
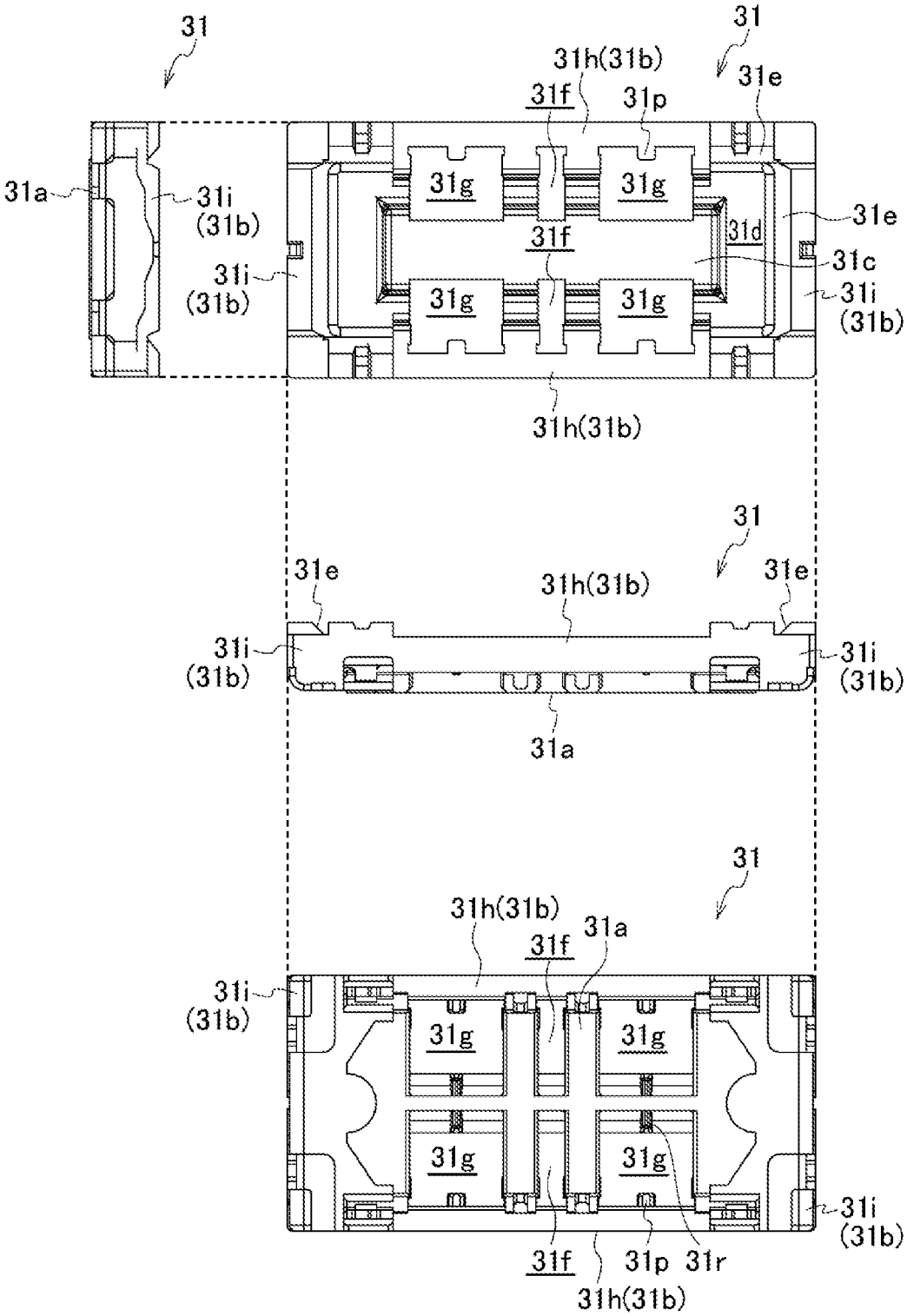
FIG. 20 is a diagram showing the socket housing of the connector according to the first exemplary embodiment of the present invention.
Figure 21A:
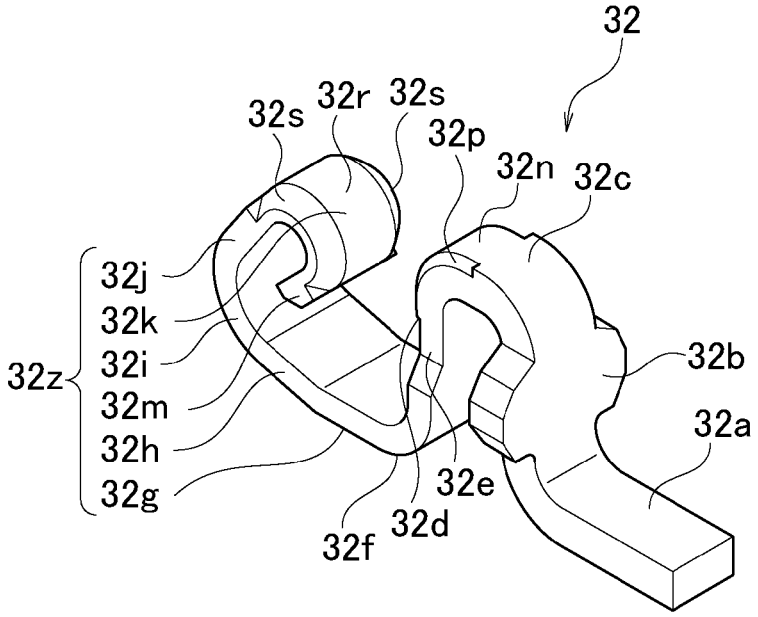
FIG. 21A is a first perspective view of a socket-side signal terminal of the connector according to the first exemplary embodiment of the present invention.
Figure 21B:
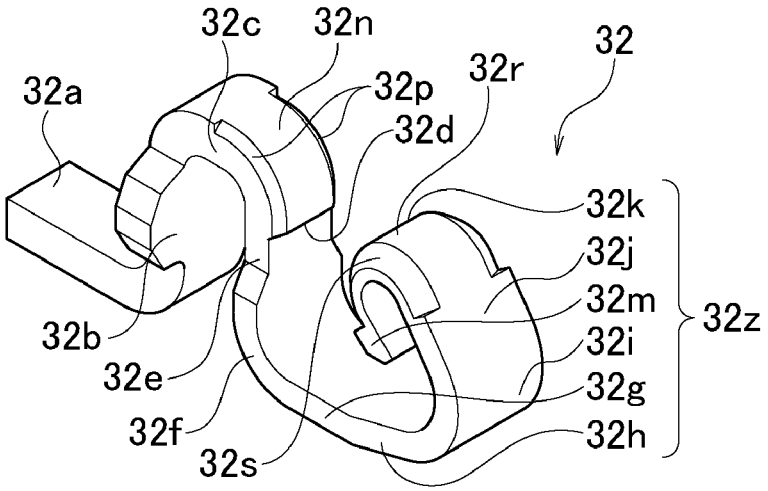
FIG. 21B is a second perspective view of the socket-side signal terminal shown in FIG. 21A.
Figure 21C:
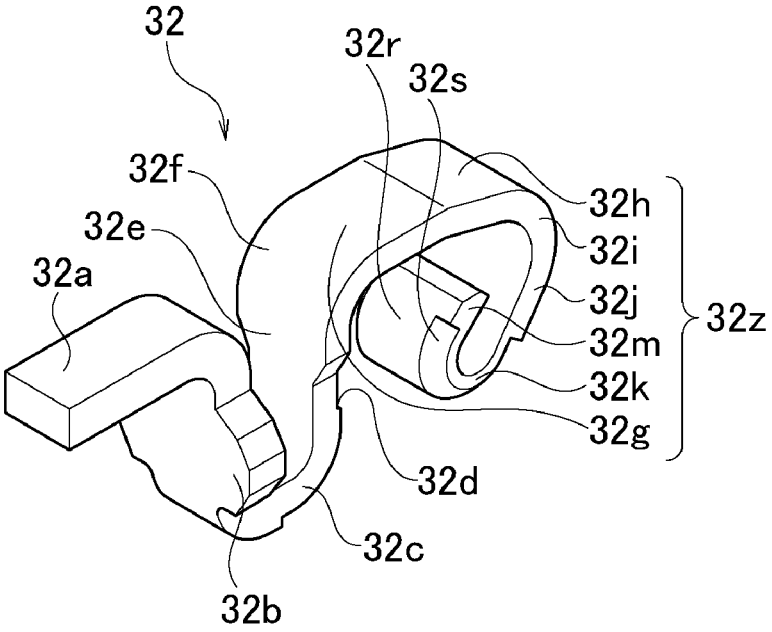
FIG. 21C is a third perspective view of the socket-side signal terminal shown in FIG. 21A.
Figure 21D:
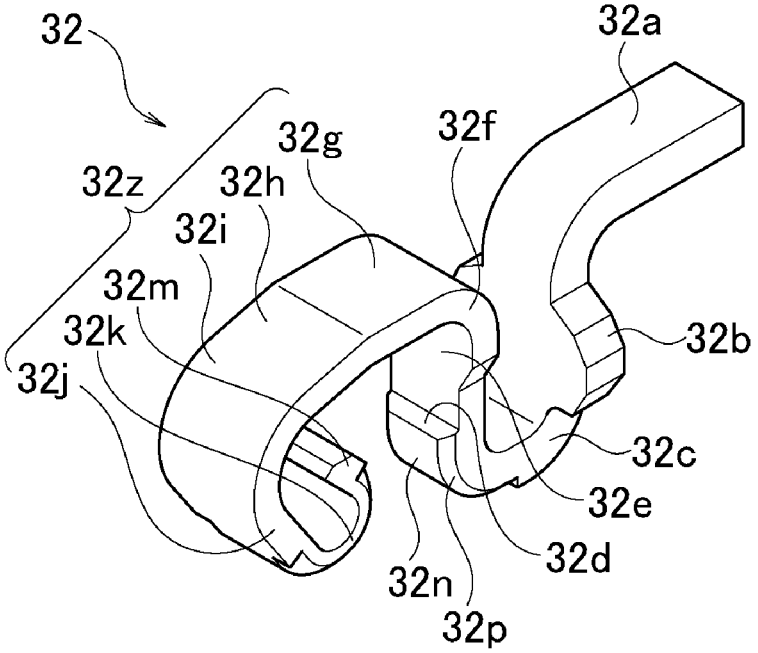
FIG. 21D is a fourth perspective view of the socket-side signal terminal shown in FIG. 21A.
Figure 22:
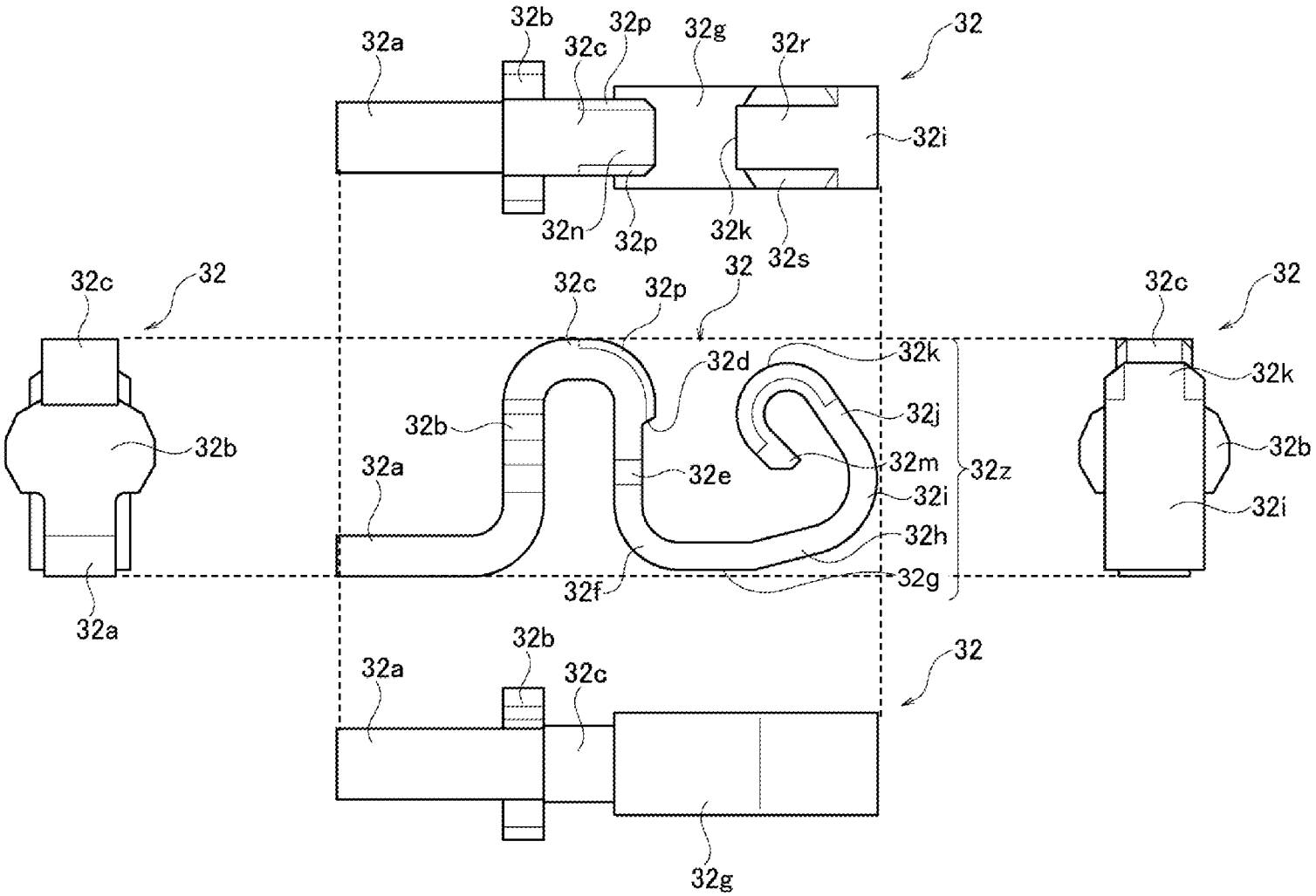
FIG. 22 is a diagram showing the socket-side signal terminal of the connector according to the first exemplary embodiment of the present invention.

Further, in the present exemplary embodiment, in socket housing 31, socket-side signal terminal housing parts 31*f* that respectively house socket-side signal terminals 32 are formed so as to penetrate through plate-like wall part 31*a* (see FIGS. 18 to 20). Further, in socket housing 31, socket-side power supply terminal housing parts 31*g* that respectively house socket-side power supply terminals 33 are formed so as to penetrate through plate-like wall part 31*a*.

Each socket-side signal terminal housing part 31*f* is formed by forming socket-side signal terminal housing recessed part 31*j* at long side direction wall part 31*h* so as to communicate with fitting groove part 31*d*, and forming socket-side signal terminal housing recessed part 31*m* at island part 31*c* so as to communicate with fitting groove part 31*d*.

Further, each socket-side power supply terminal housing part 31*g* is formed by forming socket-side power supply terminal housing recessed part 31*k* at long side direction wall part 31*h* so as to communicate with fitting groove part 31*d*, and forming socket-side power supply terminal housing recessed part 31*n* at island part 31*c* so as to communicate with fitting groove part 31*d*.

Socket-side signal terminals 32 and socket-side power supply terminals 33 are respectively press-fitted into socket-side signal terminal housing parts 31*f* and socket-side power supply terminal housing parts 31*g* from the back surface side of socket housing 31.

Next, with reference to FIGS. 21A to 23B, a description will be given of the structure of each socket-side signal terminal 32.

Socket-side signal terminal 32 is fabricated by metal molding, and is an electrically conductive element. Socket-side signal terminal 32 has root part 32*a* that projects from the side surface of socket housing 31. Root part 32*a* is a site that is fixed to circuit pattern 61 of first circuit board 60 with solder 70. Further, the lower surface of root part 32*a* extends along main surface M of first circuit board 60, and is positioned in a plane identical to the bottom surface of socket housing 31 (the back surface of plate-like wall part 31*a*).

Socket-side signal terminal 32 has rising part 32*b* that rises from root part 32*a* and extends away from first circuit board 60. Rising part 32*b* bends from root part 32*a* and enters inside socket-side signal terminal housing recessed part 31*j*, and extends along the inner surface of long side direction wall part 31*h*.

Socket-side signal terminal 32 has inverted U-shaped part 32*c* whose one end is continuous to the upper end of rising part 32*b*. Inverted U-shaped part 32*c* has a shape in which the letter U is inverted upside down. Note that, inverted U-shaped part 32*c* has tip surface 32*n* and inclined surfaces 32*p* respectively provided continuously on the opposite sides in long side direction X of tip surface 32*n*, and formed to be a projection being substantially trapezoidal in a horizontal cross-sectional view (see FIG. 23B).

Socket-side signal terminal 32 has engaging part 32*d* that is continuous to the other end of inverted U-shaped part 32*c*. In the present exemplary embodiment, engaging part 32*d* is formed from one end to the other end in long side direction X of socket housing 31 in socket-side signal terminal 32. That is, step-like engaging part 32*d* is formed over the entire width direction of socket-side signal terminal 32.

As described above, engaging part 32*d* functions as a part that restricts engaged part 22*e* from shifting, when header-side signal terminal 22 is pulled out from socket-side signal terminal 32. That is, engaging part 32*d* of socket-side signal terminal 32 abuts on engaged part 22*e* of header-side signal terminal 22 thereby engaging with engaged part 22*e*. Engaging part 32*d* of socket-side signal terminal 32 and engaged part 22*e* of header-side signal terminal 22 structure a lock mechanism which is capable of releasing engagement between them by application of external force being equal to or greater than a predetermined value.

Engaging part 32*d* may be formed by rolling of a base material which is performed to partially vary the thickness of socket-side signal terminal 32. Alternatively, engaging part 32*d* may be formed by forming to bend the base material of socket-side signal terminal 32 in the thickness direction.

Further, socket-side signal terminal 32 has falling part 32*e* that is continuous to engaging part 32*d* and extends substantially in parallel to rising part 32*b*.

Socket-side signal terminal 32 has first arc-shaped part 32*f* that is continuous to the lower end of falling part 32*e*.

As shown in FIGS. 29 and 30, socket-side signal terminal 32 has facing part 32*z* that is continuous to first arc-shaped part 32*f*. Facing part 32*z* includes flat part 32*g*, first slanting part 32*h*, second arc-shaped part 32*i*, second slanting part 32*j*, arc-shaped projecting part 32*k*, and tip part 32*m* which will be described in the following. Facing part 32*z* is specifically structured as follows.

Facing part 32*z* has flat part 32*g* that is continuous to the lower end of arc-shaped part 32*f*. As shown in FIG. 29, flat part 32*g* extends, away from falling part 32*e*, along main surface M of first circuit board 60. Note that, flat part 32*g* is not necessarily in parallel to main surface M. Flat part 32*g* is provided for increasing the spring length of a spring part, which will be described later.

As shown in FIG. 29, facing part 32*z* has first slanting part 32*h* that is continuous to flat part 32*g* and extends in a slanting direction relative to main surface M of first circuit board 60. First slanting part 32*h* extends to be more distanced from falling part 32*e* as it becomes distanced from first circuit board 60. First slanting part 32*h* is continuous to second arc-shaped part 32*i*. Second arc-shaped part 32*i* is a curved part that projects away from falling part 32*e*. Second arc-shaped part 32*i* is continuous to second slanting part 32*j* extending in a slanting direction relative to main surface M of first circuit board 60. Second slanting part 32*j* extends to be nearer to falling part 32*e* as it is distanced from first circuit board 60. Accordingly, second slanting part 32*j* is positioned above first slanting part 32*h*.

As shown in FIG. 29, facing part 32*z* has arc-shaped projecting part 32*k* whose one end is continuous to the upper end of second slanting part 32*j*. Arc-shaped projecting part 32*k* has tip surface 32*r* and inclined surfaces 32*s* respectively provided continuously on the opposite sides in long side direction X of tip surface 32*r*, and formed to be a projection being substantially trapezoidal in a horizontal cross-sectional view (see FIG. 26B).

As shown in FIG. 29, arc-shaped projecting part 32*k* fits into recessed part 22*c* of header-side signal terminal 22. The other end of arc-shaped projecting part 32*k* is continuous to tip part 32*m*. Tip part 32*m* extends substantially in parallel to second slanting part 32*j*. As can be seen from FIGS. 29 and 30, facing part 32*z* (32*g*, 32*h*, 32*i*, 32*j*, 32*k*, 32*m*) is continuous to the lower end of arc-shaped part 32*f*, and opposite to falling part 32*e* as a whole.

In the present exemplary embodiment, as shown in FIG. 30, when header 20 and socket 30 fit to each other, header-side signal terminal 22 is inserted between inverted U-shaped part 32*c* and arc-shaped projecting part 32*k*. Here, falling part 32*e*, arc-shaped part 32*f*, flat part 32*g*, first slanting part 32*h*, arc-shaped part 32*i*, second slanting part 32*j*, arc-shaped projecting part 32*k*, and tip part 32*m* integrally function as a spring part. The spring part (32*e*, 32*f*, 32*g*, 32*h*, 32*i*, 32*j*, 32*k*, 32*m*) elastically deforms when the protruding part of header-side signal terminal 22 is inserted into the recessed part of socket-side signal terminal 32. This increases the distance from the two parts, namely, falling part 32*e* and inverted U-shaped part 32*c*, to arc-shaped projecting part 32*k*. Here, engaged part 22*e* of header-side signal terminal 22 is inserted into a position lower than engaging part 32*d* of socket-side signal terminal 32. Thus, arc-shaped projecting part 32*k* of socket-side signal terminal 32 fits into recessed part 22*c* of header-side signal terminal 22.

In the state where header-side signal terminal 22 fits to socket-side signal terminal 32, resilience occurs at the spring part that is elastically deforming. With the resilience, arc-shaped projecting part 32*k* presses header-side signal terminal 22 against each of falling part 32*e* and inverted U-shaped part 32*c*. Thus, header-side signal terminal 22 is clamped by socket-side signal terminal 32. Here, header-side signal terminal 22 is brought into contact with each of inverted U-shaped part 32*c*, falling part 32*e*, and arc-shaped projecting part 32*k* of socket-side signal terminal 32.

Specifically, as shown in FIGS. 29 to 33B, tip part 22*d* of header-side signal terminal 22 is brought into contact with falling part 32*e* of socket-side signal terminal 32. That is, contact part R1 of socket-side signal terminal 32 and contact part R1 of header-side signal terminal 22 are brought into contact with each other.

Further, recessed part 22*c* of header-side signal terminal 22 is brought into contact with arc-shaped projecting part 32*k* of socket-side signal terminal 32. That is, contact part R2 of socket-side signal terminal 32 and contact part R2 of header-side signal terminal 22 are brought into contact with each other.

In this manner, header-side signal terminal 22 and socket-side signal terminal 32 are brought into contact with each other at a plurality of contacts spaced apart from each other in width direction Y (at contact part R1 and contact part R2). Accordingly, electrical connection between header-side signal terminal 22 and socket-side signal terminal 32 is highly reliable.

Further, in the present exemplary embodiment, recessed part 22*c* is formed at contact part R2 of header-side signal terminal 22, which is one of contact part R2 of socket-side signal terminal 32 and contact part R2 of header-side signal terminal 22 being brought into contact with each other. Then, contact part R2 of socket-side signal terminal 32 which is the other one of contact parts is brought into contact at opposite ends in long side direction X of socket housing 31 in recessed part 22*c*.

Figure 33A:
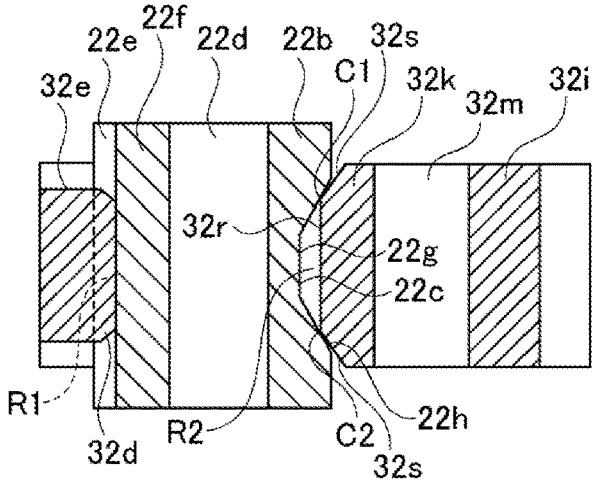
FIG. 33A is a horizontal cross-sectional view schematically showing a contact state between terminals according to the first exemplary embodiment of the present invention, schematically showing a contact state between the header-side signal terminal and the socket-side signal terminal.

Specifically, as shown in FIG. 33A, when arc-shaped projecting part 32*k* of socket-side signal terminal 32 fits into recessed part 22*c*, the boundary portions between tip surface 32*r* of arc-shaped projecting part 32*k* and inclined surfaces 32*s* are respectively in contact with inclined surfaces 22*h*. In this manner, in the present exemplary embodiment, contact part R2 of socket-side signal terminal 32 is brought into contact with contact part R2 of header-side signal terminal 22 at two points (contact C1 and contact C2).

Note that, elastic deformation of the spring part may bring the boundary part between flat part 32*g* and first slanting part 32*h* into contact with first circuit board 60 at contact part R5, in addition to contact part R1 and contact part R2.

In this manner, header-side signal terminal 22 and socket-side signal terminal 32 according to the present exemplary embodiment are in contact with each other at a plurality of contacts spaced apart from each other in width direction Y. However, the header-side signal terminal and the socket-side signal terminal of the present invention may be in contact with each other just at a single contact, for example, between the inner side surface of the header-side signal terminal and the facing part of the socket-side signal terminal.

Note that, the spring part (32*e*, 32*f*, 32*g*, 32*h*, 32*i*, 32*j*, 32*k*, 32*m*) is structured by a U-shaped part (32*e*, 32*f*, 32*g*, 32*h*, 32*i*, 32*j*) and a free end part (32*k*, 32*m*) provided continuously on one end (on 32*j* side) of the U-shaped part (32*e*, 32*f*, 32*g*, 32*h*, 32*i*, 32*j*). At arc-shaped projecting part 32*k* of the free end part (32*k*, 32*m*), contact part R2 of socket-side signal terminal 32 is provided.

In this manner, socket-side signal terminal 32 has the U-shaped part (32*e*, 32*f*, 32*g*, 32*h*, 32*i*, 32*j*), and at one end (on 32*j* side) of the U-shaped part (32*e*, 32*f*, 32*g*, 32*h*, 32*i*, 32*j*), the free end part (32*k*, 32*m*) where contact part R2 is provided is continuously provided.

Such socket-side signal terminal 32 can be formed by bend-forming a band-like metal member having a predetermined thickness.

Further, socket-side signal terminal 32 is mounted on socket housing 31 by being inserted (press-fitted) into socket-side signal terminal housing part 31*f* from the back surface side of socket housing 31 (from the bottom side in FIG. 15) during assembly of socket 30.

Note that, socket-side signal terminal 32 may be mounted on socket housing 31 by insert-molding socket-side signal terminal 32 into socket housing 31.

Next, with reference to FIGS. 24A to 26B, a description will be given of the structure of socket-side power supply terminal 33.

Socket-side power supply terminal 33 is formed by metal molding, and is an electrically conductive element. Socket-side power supply terminal 33 has root part 33*a* that projects from the side surface of socket housing 31. Root part 33*a* is a site that is fixed to circuit pattern 61 of first circuit board 60 with solder 70. Further, the lower surface of root part 33*a* extends along main surface M of first circuit board 60, and is positioned in a plane identical to the bottom surface of socket housing 31 (the back surface of plate-like wall part 31*a*).

Socket-side power supply terminal 33 has rising part 33*b* that rises from root part 33*a* and extends away from first circuit board 60. Rising part 33*b* bends from root part 33*a* and enters inside socket-side power supply terminal housing recessed part 31*k*, and extends along the inner surface of long side direction wall part 31*h*.

Socket-side power supply terminal 33 has inverted U-shaped part 33*c* whose one end is continuous to the upper end of rising part 33*b*. Inverted U-shaped part 33*c* has a shape in which the letter U is inverted upside down. Note that, inverted U-shaped part 33*c* has tip surface 33*r* and inclined surfaces 33*s* respectively provided continuously on opposite sides in long side direction X of tip surface 33*r*, and formed to be a projection being substantially trapezoidal in a horizontal cross-sectional view (see FIG. 26B).

Socket-side power supply terminal 33 has engaging part 33*d* that is continuous to the other end of inverted U-shaped part 33*c*. As described above, engaging part 33*d* functions as a part that restricts engaged part 23*e* from shifting, when header-side power supply terminal 23 is pulled out from socket-side power supply terminal 33. That is, engaging part 33*d* of socket-side power supply terminal 33 abuts on engaged part 23*e* of header-side power supply terminal 23 thereby engaging with engaged part 23*e*. Engaging part 33*d* of socket-side power supply terminal 33 and engaged part 23*e* of header-side power supply terminal 23 structure a lock mechanism which is capable of releasing engagement between them by application of external force being equal to or greater than a predetermined value.

Engaging part 33*d* may be formed by rolling of a base material which is performed to partially vary the thickness of socket-side power supply terminal 33. Alternatively, engaging part 33*d* may be formed by forming to bend the base material of socket-side power supply terminal 33 in the thickness direction.

Further, socket-side power supply terminal 33 has falling part 33*e* that is continuous to engaging part 33*d* and extends substantially in parallel to rising part 33*b*.

Socket-side power supply terminal 33 has first arc-shaped part 33*f* that is continuous to the lower end of falling part 33*e*.

Figure 31:
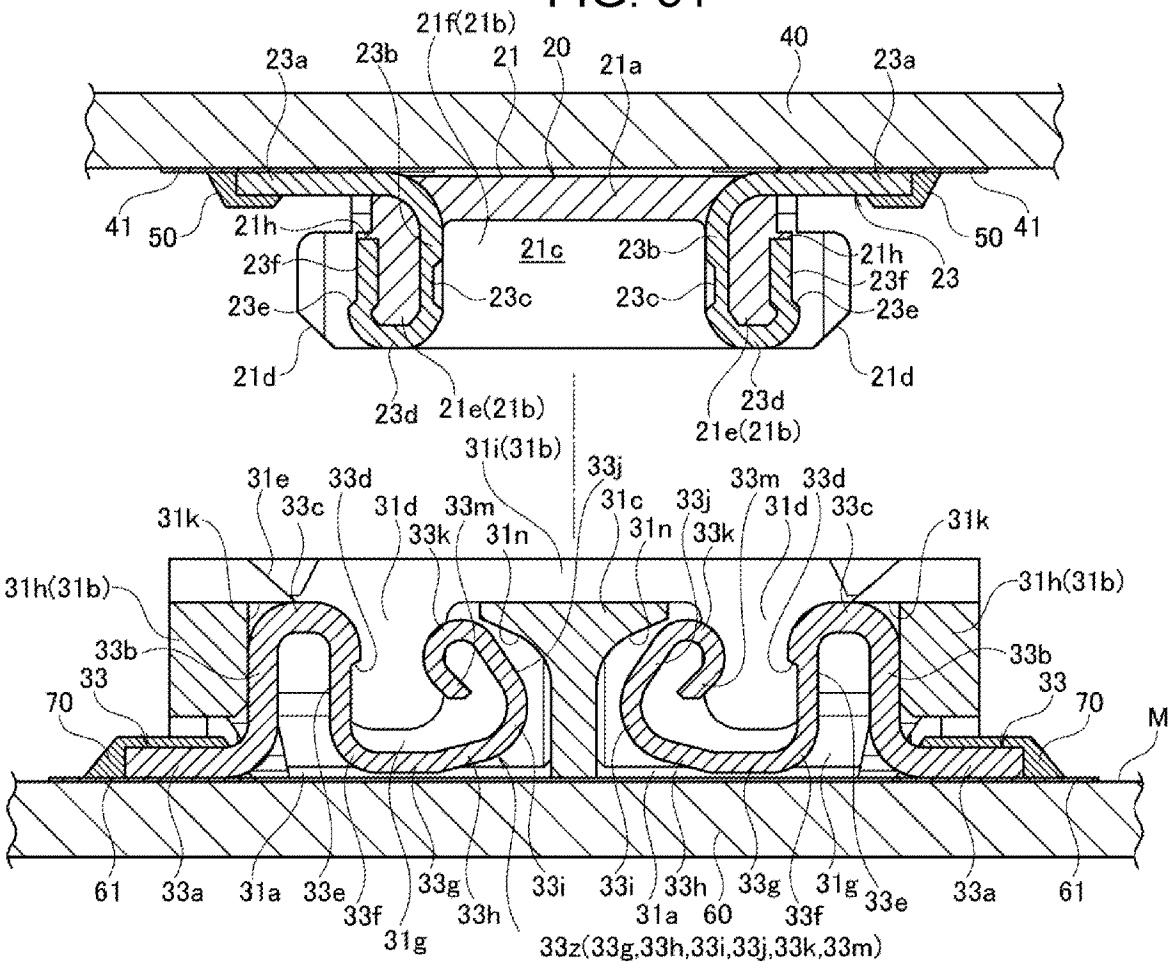
FIG. 31 is a cross-sectional view taken along a site where the header-side power supply terminals and the socket-side power supply terminals are disposed, showing a state immediately before the header and the socket according to the first exemplary embodiment of the present invention are fitted to each other.
Figure 32:
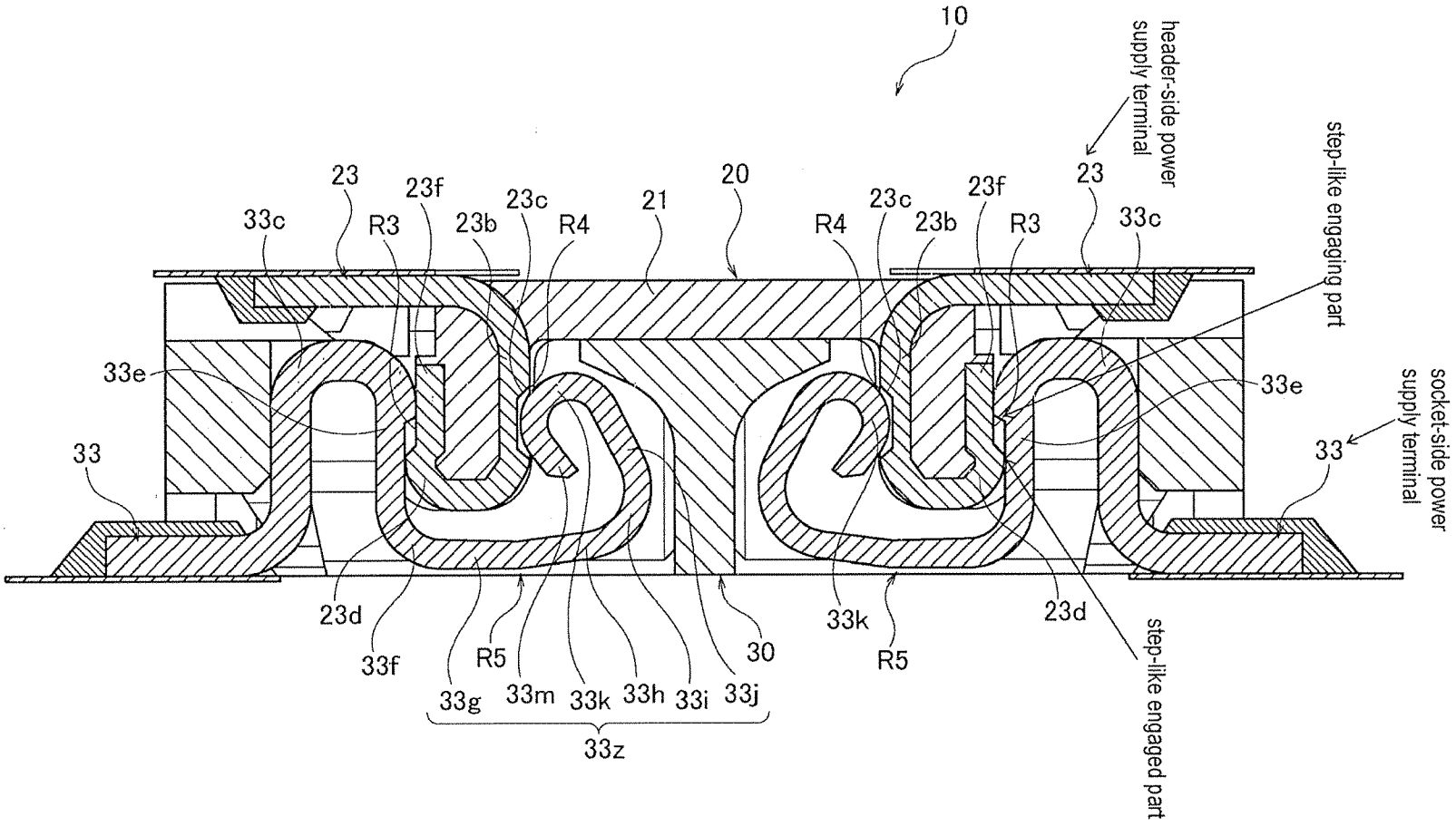
FIG. 32 is a cross-sectional view taken along a site where the header-side power supply terminals and the socket-side power supply terminals are disposed, showing a state where the header and the socket according to the first exemplary embodiment of the present invention are fitted to each other.

As shown in FIGS. 31 and 32, socket-side power supply terminal 33 has facing part 33*z* that is continuous to first arc-shaped part 33*f*. Facing part 33*z* includes flat part 33*g*, first slanting part 33*h*, second arc-shaped part 33*i*, second slanting part 33*j*, arc-shaped projecting part 33*k*, and tip part 33*m* which will be described in the following. Facing part 33*z* is specifically structured as follows.

Facing part 33*z* has flat part 33*g* that is continuous to the lower end of arc-shaped part 33*f*. As shown in FIG. 31, flat part 33*g* extends, away from falling part 33*e*, along main surface M of first circuit board 60. Note that, flat part 33*g* is not necessarily in parallel to main surface M. Flat part 33*g* is provided for increasing the spring length of a spring part, which will be described later.

As shown in FIG. 31, facing part 33*z* has first slanting part 33*h* that is continuous to flat part 33*g* and extends in a slanting direction relative to main surface M of first circuit board 60. First slanting part 33*h* extends to be more distanced from falling part 33*e* as it becomes distanced from first circuit board 60. First slanting part 33*h* is continuous to second arc-shaped part 33*i*. Second arc-shaped part 33*i* is a curved part that projects away from falling part 33*e*. Second arc-shaped part 33*i* is continuous to second slanting part 33*j* extending in a slanting direction relative to main surface M of first circuit board 60. Second slanting part 33*j* extends be nearer to falling part 33*e* as it is distanced from first circuit board 60. Accordingly, second slanting part 33*j* is positioned above first slanting part 33*h*.

As shown in FIG. 31, facing part 33*z* has arc-shaped projecting part 33*k* whose one end is continuous to the upper end of second slanting part 33*j*. Arc-shaped projecting part 33*k* has tip surface 33*v* and inclined surfaces 33*w* respectively provided continuously on the opposite sides in long side direction X of tip surface 33*v*, and formed to be a projection being substantially trapezoidal in a horizontal cross-sectional view (see FIG. 26B).

As shown in FIG. 31, arc-shaped projecting part 33*k* fits into recessed part 23*c* of header-side power supply terminal 23. The other end of arc-shaped projecting part 33*k* is continuous to tip part 33*m*. Tip part 33*m* extends substantially in parallel to second slanting part 33*j*. As can be seen from FIGS. 31 and 32, facing part 33*z* (33*g*, 33*h*, 33*i*, 33*j*, 33*k*, 33*m*) is continuous to the lower end of arc-shaped part 33*f*, and opposite to falling part 33*e* as a whole.

In the present exemplary embodiment, as shown in FIG. 32, when header 20 and socket 30 fit to each other, header-side power supply terminal 23 is inserted between inverted U-shaped part 33*c* and arc-shaped projecting part 33*k*. Here, falling part 33*e*, arc-shaped part 33*f*, flat part 33*g*, first slanting part 33*h*, arc-shaped part 33*i*, second slanting part 33*j*, arc-shaped projecting part 33*k*, and tip part 33*m* integrally function as a spring part. The spring part (33*e*, 33*f*, 33*g*, 33*h*, 33*i*, 33*j*, 33*k*, 33*m*) elastically deforms when the protruding part of header-side power supply terminal 23 is inserted into the recessed part of socket-side power supply terminal 33. This increases the distance from the two parts, namely, falling part 33*e* and inverted U-shaped part 33*c*, to arc-shaped projecting part 33*k*. Here, engaged part 23*e* of header-side power supply terminal 23 is inserted into a position lower than engaging part 33*d* of socket-side power supply terminal 33. Thus, arc-shaped projecting part 33*k* of socket-side power supply terminal 33 fits into recessed part 23*c* of header-side power supply terminal 23.

In the state where header-side power supply terminal 23 fits to socket-side power supply terminal 33, resilience occurs at the spring part that is elastically deforming. With the resilience, arc-shaped projecting part 33*k* presses header-side power supply terminal 23 against each of falling part 33*e* and inverted U-shaped part 33*c*. Thus, header-side power supply terminal 23 is clamped by socket-side power supply terminal 33. Here, header-side power supply terminal 23 is brought into contact with each of inverted U-shaped part 33*c*, falling part 33*e*, and arc-shaped projecting part 33*k* of socket-side power supply terminal 33.

Specifically, as shown in FIGS. 31 to 33B, tip part 23*d* of header-side power supply terminal 23 is brought into contact with falling part 33*e* of socket-side power supply terminal 33. That is, contact part R3 of socket-side power supply terminal 33 and contact part R3 of header-side power supply terminal 23 are brought into contact with each other.

Further, recessed part 23*c* of header-side power supply terminal 23 is brought into contact with arc-shaped projecting part 33*k* of socket-side power supply terminal 33. That is, contact part R4 of socket-side power supply terminal 33 and contact part R4 of header-side power supply terminal 23 are brought into contact with each other.

In this manner, header-side power supply terminal 23 and socket-side power supply terminal 33 are brought into contact with each other at a plurality of contacts spaced apart from each other in width direction Y (at contact part R3 and contact part R4). Accordingly, electrical connection between header-side power supply terminal 23 and socket-side power supply terminal 33 is highly reliable.

Figure 23A:
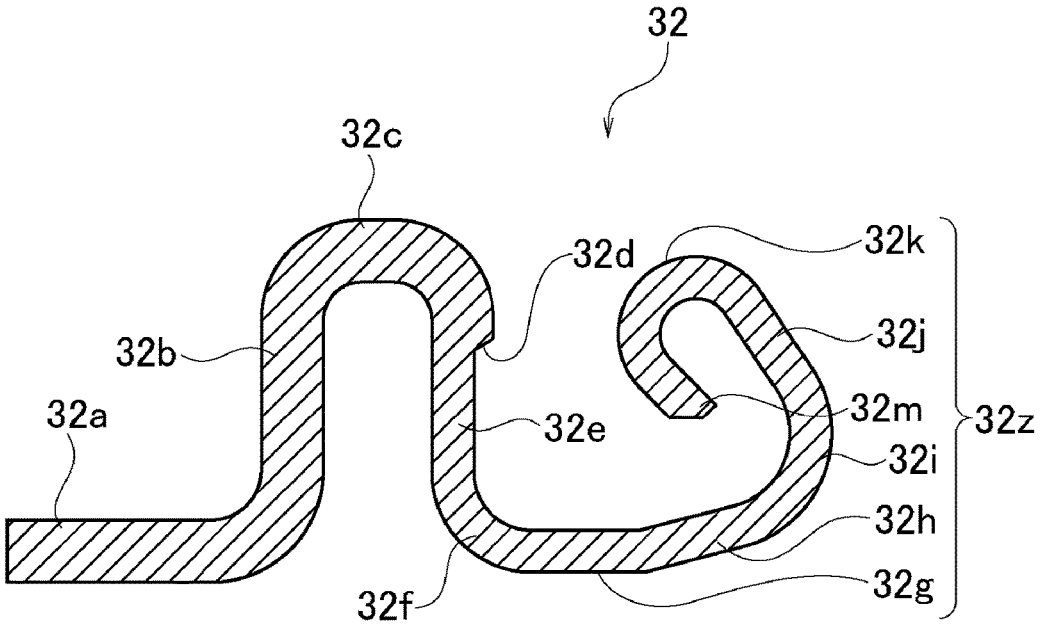
FIG. 23A is a side cross-sectional view of the socket-side signal terminal of the connector according to the first exemplary embodiment of the present invention.
Figure 23B:
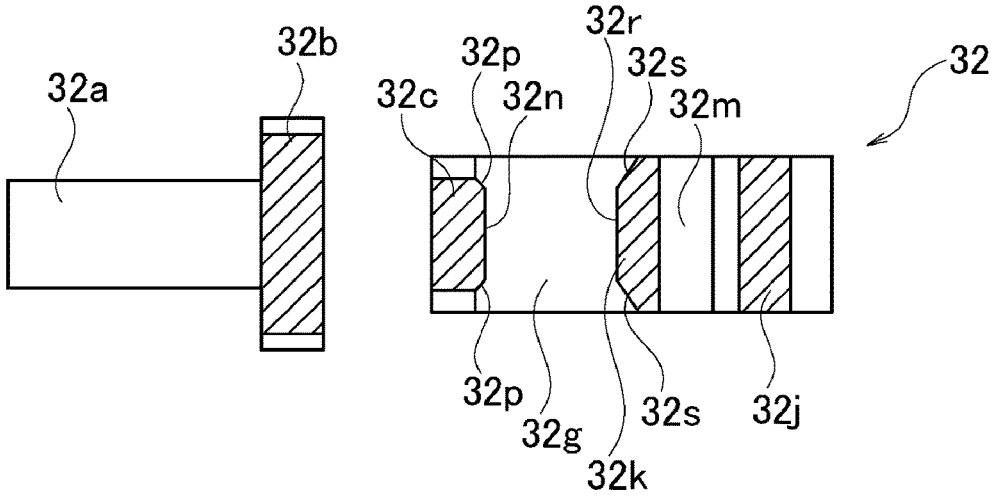
FIG. 23B is a horizontal cross-sectional view of the socket-side signal terminal shown in FIG. 23A.
Figure 24A:
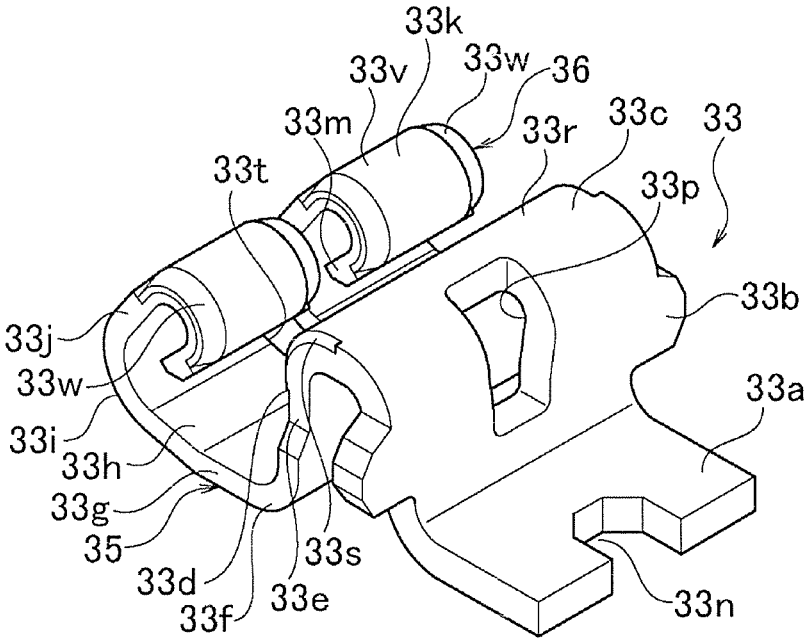
FIG. 24A is a first perspective view of a socket-side power supply terminal of the connector according to the first exemplary embodiment of the present invention.
Figure 24B:
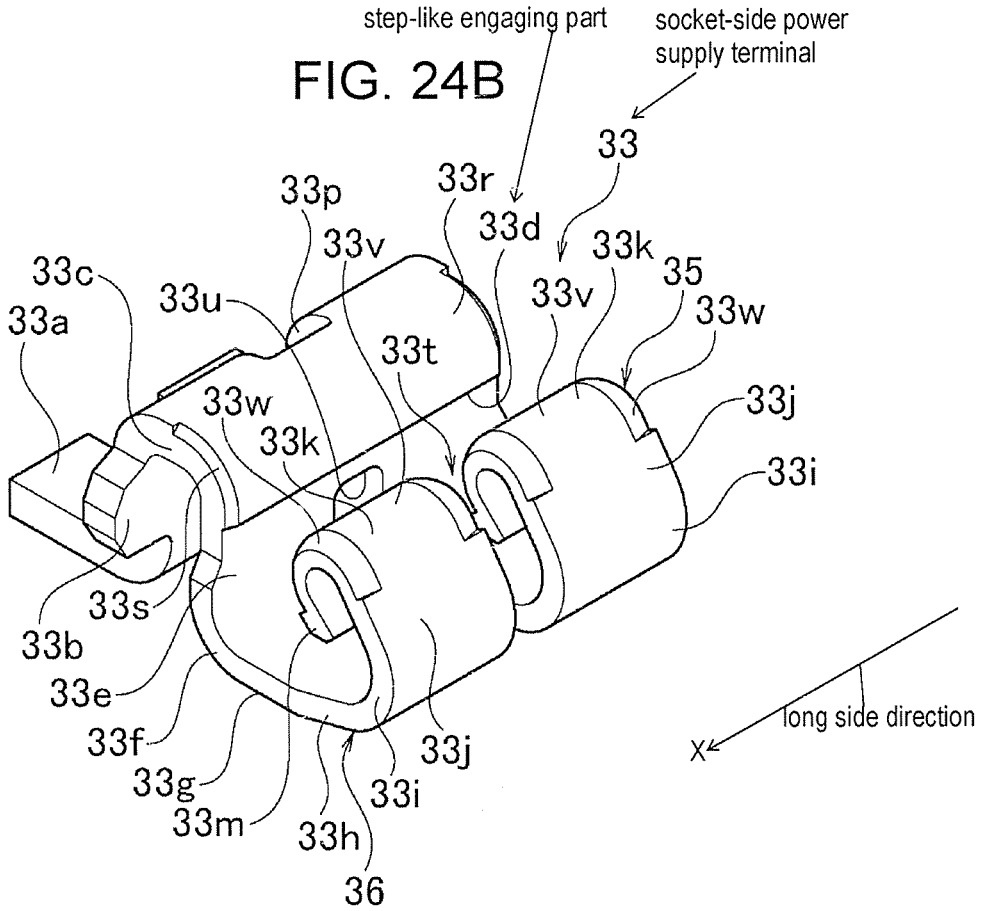
FIG. 24B is a second perspective view of the socket-side power supply terminal shown in FIG. 24A.
Figure 24C:
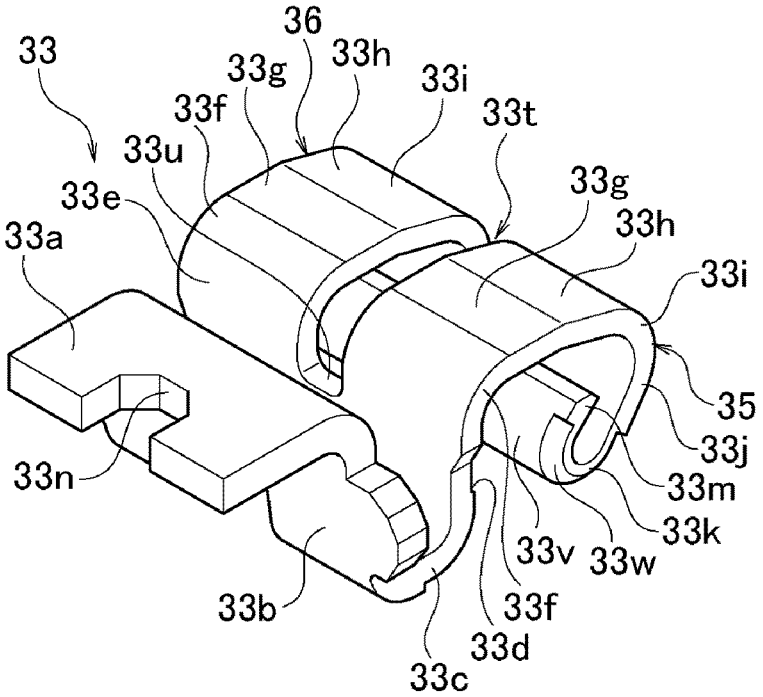
FIG. 24C is a third perspective view of the socket-side power supply terminal shown in FIG. 24A.
Figure 24D:
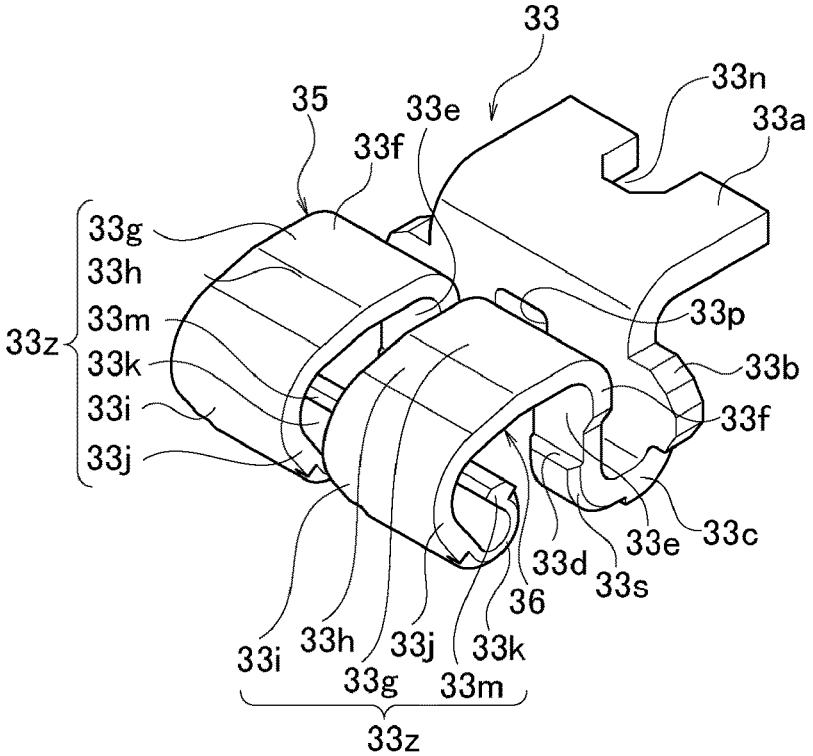
FIG. 24D is a fourth perspective view of the socket-side power supply terminal shown in FIG. 24A.
Figure 25:
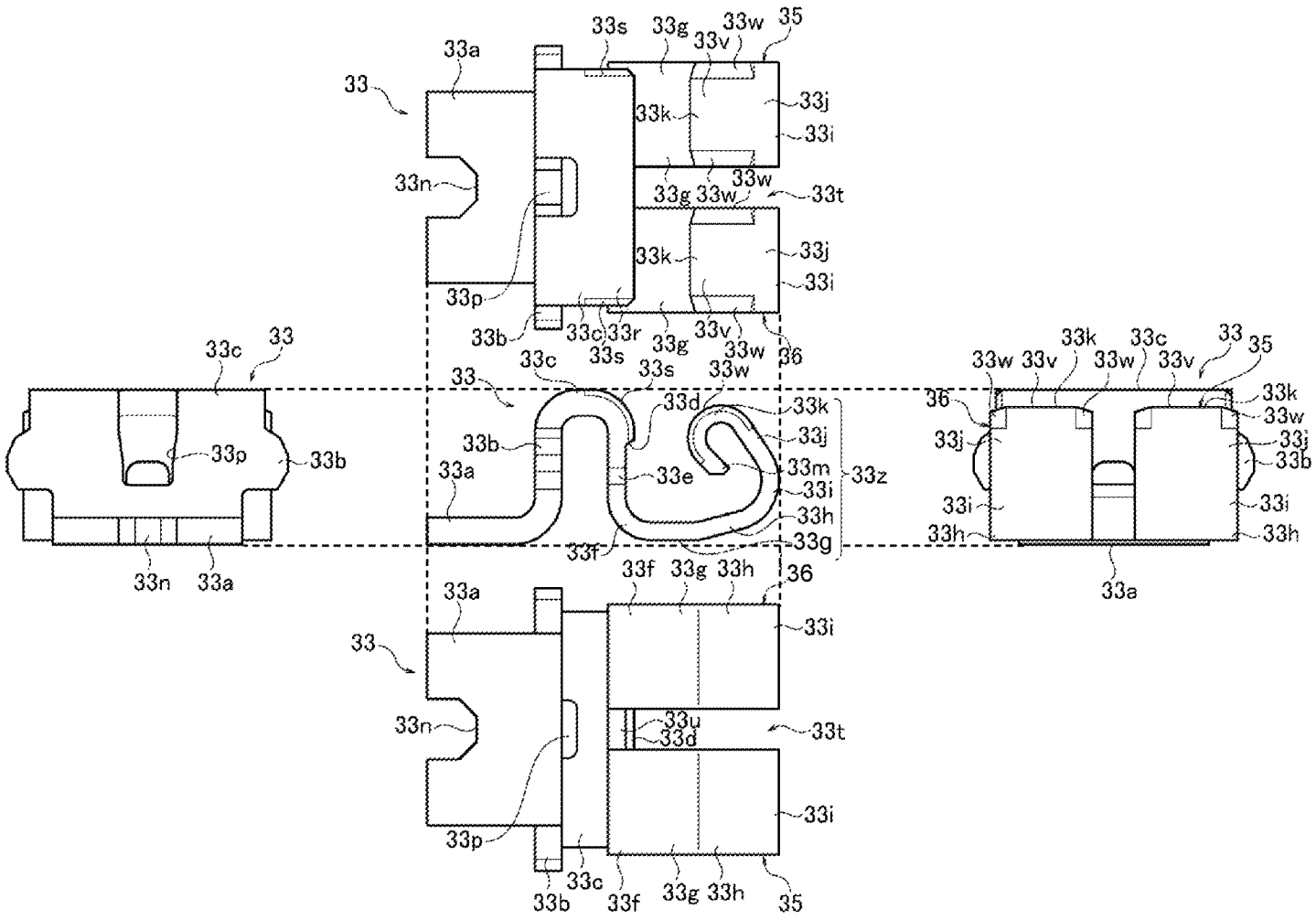
FIG. 25 is a diagram showing the socket-side power supply terminal of the connector according to the first exemplary embodiment of the present invention.
Figure 26A:
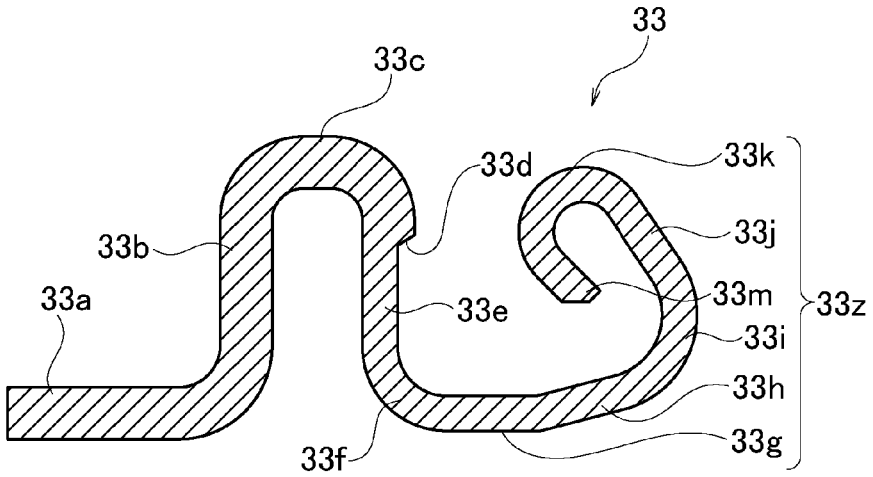
FIG. 26A is a side cross-sectional view of the socket-side power supply terminal of the connector according to the first exemplary embodiment of the present invention.
Figure 26B:
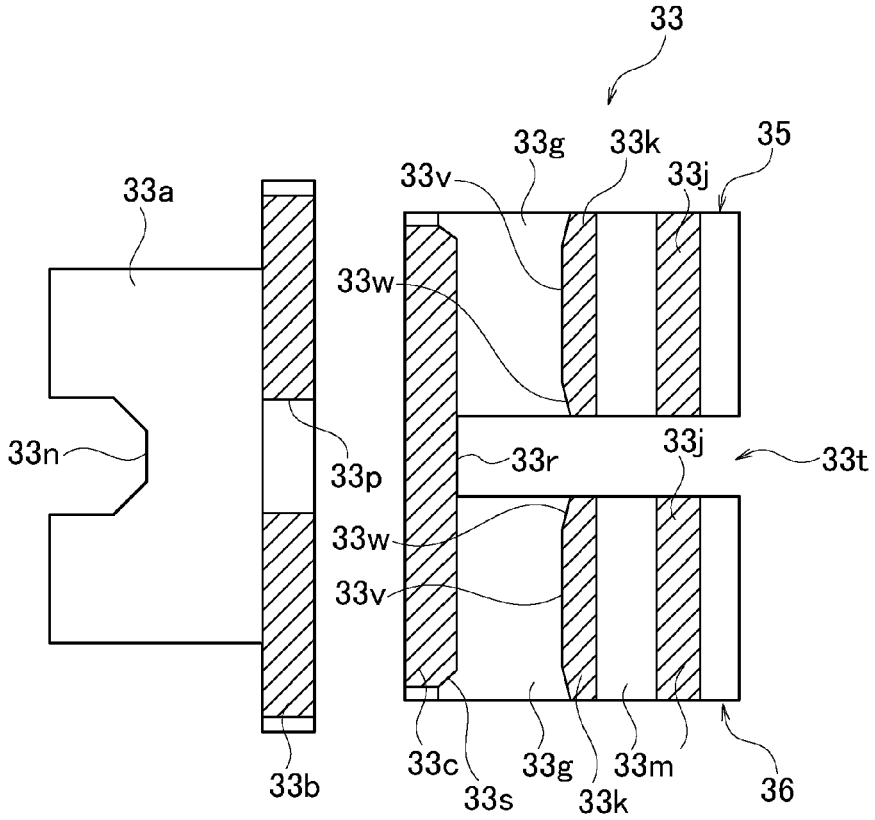
FIG. 26B is a horizontal cross-sectional view of the socket-side power supply terminal shown in FIG. 26B.

In this manner, in the present exemplary embodiment, the side cross-sectional shape of socket-side signal terminal 32 and the side cross-sectional shape of socket-side power supply terminal 33 are substantially identical to each other (see FIGS. 23A and 26A).

Further, as described above, socket-side signal terminal 32 and socket-side power supply terminal 33 are disposed along long side direction X of socket housing 31. In the present exemplary embodiment, socket-side power supply terminal 33 is formed so that its width along long side direction X of socket housing 31 becomes greater than the width of socket-side signal terminal 32 along long side direction X.

That is, in the present exemplary embodiment, socket-side signal terminal 32 is smaller than socket-side power supply terminal 33 in the width in long side direction X of socket housing 31. Note that, in the present exemplary embodiment, every socket-side signal terminal 32 is smaller than socket-side power supply terminal 33 in the width in long side direction X of socket housing 31.

In this manner, since socket-side power supply terminal 33 is provided with a great width along long side direction X of socket housing 31, recessed part 33*n* having a cutout shaped in a recessed manner is formed at the center in long side direction X of root part 33*a*. Forming recessed part 33*n*, while an increase in the projection amount of root part 33*a* is suppressed, the length of the contour of root part 33*a* in contact with the circuit pattern can be increased. Further, the contour can have a complicated shape. This increases the fixing strength exerted by solder 70 between root part 33*a* and circuit pattern 61 in fixing socket-side power supply terminal 33 having a great width to circuit pattern 61 of first circuit board 60 with solder 70, as compared to the case where recessed part 33*n* is not formed.

Further, at the center in long side direction X from rising part 33*b* to inverted U-shaped part 33*c*, hole 33*p* is formed. When socket-side power supply terminal 33 is inserted (press-fitted) into socket-side power supply terminal housing part 31*g*, projecting part 31*p* formed at socket-side power supply terminal housing recessed part 31*k* is inserted into hole 33*p*, whereby socket-side power supply terminal 33 is supported by socket housing 31.

Further, in the present exemplary embodiment, engaging part 33*d* is formed from one end to the other end in long side direction X of socket housing 31 in socket-side power supply terminal 33. That is, step-like engaging part 33*d* is formed over the entire width direction of socket-side power supply terminal 33 having a great width. This improves the locking force exerted by engaged part 23*e* of header-side power supply terminal 23 and engaging part 33*d* of socket-side power supply terminal 33. Further, engaging part 33*d* becomes wear-resistant against repeated insertion/disconnection of header 20 and socket 30. Thus, the life of the product increases.

Further, in the present exemplary embodiment, the spring part (33*e*, 33*f*, 33*g*, 33*h*, 33*i*, 33*j*, 33*k*, 33*m*) is structured by a U-shaped part (33*e*, 33*f*, 33*g*, 33*h*, 33*i*, 33*j*) and a free end part (33*k*, 33*m*) provided continuously on one end (on 33*j* side) of the U-shaped part (33*e*, 33*f*, 33*g*, 33*h*, 33*i*, 33*j*). At arc-shaped projecting part 33*k* of the free end part (33*k*, 33*m*), contact part R4 of socket-side signal terminal 32 is provided.

In this manner, socket-side power supply terminal 33 has the U-shaped part (33*e*, 33*f*, 33*g*, 33*h*, 33*i*, 33*j*), and at one end (on 33*j* side) of the U-shaped part (33*e*, 33*f*, 33*g*, 33*h*, 33*i*, 33*j*), the free end part (33*k*, 33*m*) where contact part R4 is provided is continuously provided.

A plurality of piece parts 35, 36 are formed at least at the free end part (33*k*, 33*m*).

In the present exemplary embodiment, by forming groove part 33*t* having a band-like cutout shape at part of the spring part (33*e*, 33*f*, 33*g*, 33*h*, 33*i*, 33*j*, 33*k*, 33*m*), two (the plurality of) piece parts 35, 36 are provided.

Two (the plurality of) piece parts 35, 36 are flexible, and can flex independently of each other.

Contact part R4 is provided at each of the two piece parts 35, 36.

In this manner, in the present exemplary embodiment, socket-side power supply terminal 33 and header-side power supply terminal 23 are provided with a plurality of contact parts R4 that are brought into contact with each other. Specifically, two contact parts R4 are formed along long side direction X of socket housing 31.

Note that, in the present exemplary embodiment, depth part 33*u* of groove part 33*t* is positioned at a middle position of falling part 33*e*. That is, depth part 33*u* of groove part 33*t* is positioned on the free end part (33*k*, 33*m*) side relative to engaging part 33*d*.

This provides the spring function to free end part (33*k*, 33*m*) without reducing the locking force exerted by engaging part 33*d*.

Further, partition wall 31*r* is formed at socket-side power supply terminal housing recessed part 31*n*. When socket-side power supply terminal 33 is inserted (press-fitted) into socket-side power supply terminal housing part 31*g*, partition wall 31*r* is inserted into groove part 33*t*, whereby interference between two (the plurality of) piece parts 35, 36 is restricted.

Further, in the present exemplary embodiment, recessed part 23*c* is formed at contact part R4 of header-side power supply terminal 23, which is one of contact part R4 of socket-side power supply terminal 33 and contact part R4 of header-side power supply terminal 23 being brought into contact with each other. Then, contact part R4 of socket-side power supply terminal 33 which is other one of contact parts is brought into contact at opposite ends in long side direction X of socket housing 31 in recessed part 23*c*.

Figure 33B:
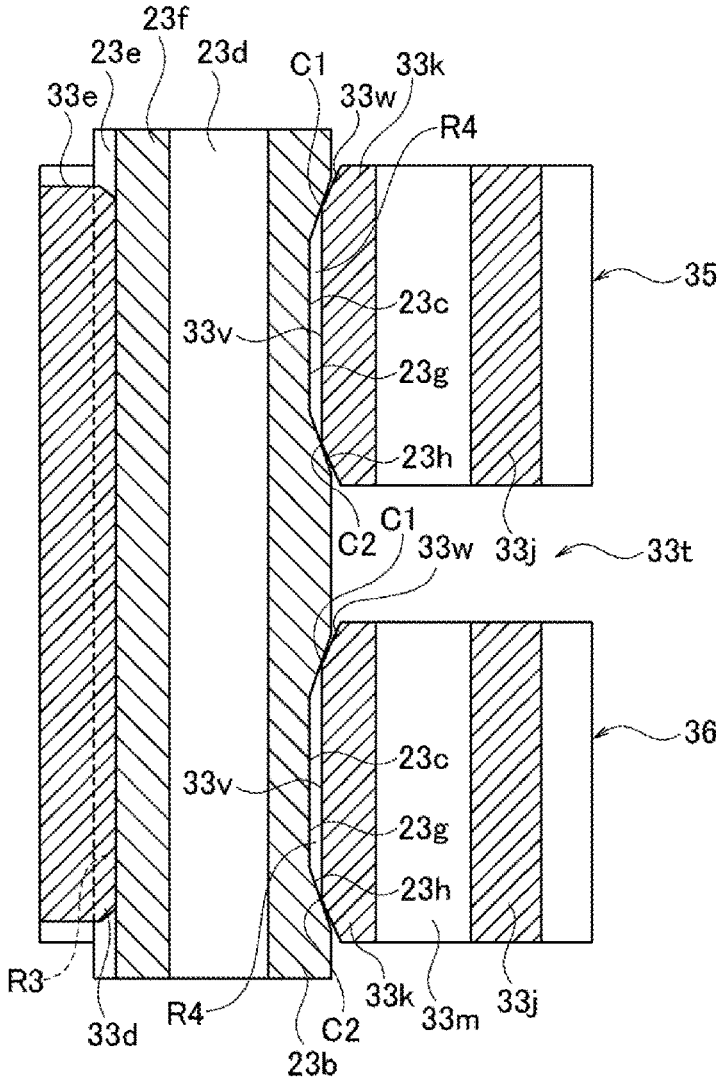
FIG. 33B is a horizontal cross-sectional view schematically showing a contact state between terminals according to the first exemplary embodiment of the present invention, schematically showing a contact state between the header-side power supply terminal and the socket-side power supply terminal.

Specifically, as shown in FIG. 33B, when arc-shaped projecting part 33*k* of socket-side power supply terminal 33 fits into recessed part 23*c*, the boundary portions between tip surface 33*v* of arc-shaped projecting part 33*k* and inclined surfaces 33*w* are respectively in contact with inclined surfaces 23*h*. In this manner, in the present exemplary embodiment, contact part R4 of socket-side power supply terminal 33 is brought into contact with contact part R4 of header-side power supply terminal 23 at two points (contact C1 and contact C2).

In the present exemplary embodiment, two contact parts R4 formed to be spaced apart from each other along long side direction X are both brought into contact at two points (contact C1 and contact C2)

Note that, elastic deformation of the spring part may bring the boundary part between flat part 33*g* and first slanting part 33*h* into contact with first circuit board 60 at contact part R5, in addition to contact part R3 and contact part R4.

Such socket-side power supply terminal 33 can be formed by bend-forming a band-like metal member having a predetermined thickness.

Further, socket-side power supply terminal 33 is mounted on socket housing 31 by being inserted (press-fitted) into socket-side power supply terminal housing part 31*g* from the back surface side of socket housing 31 (from the bottom side in FIG. 15) during assembly of socket 30.

Note that, socket-side power supply terminal 33 may be mounted on socket housing 31 by insert-molding socket-side power supply terminal 33 into socket housing 31.

Figure 27A:
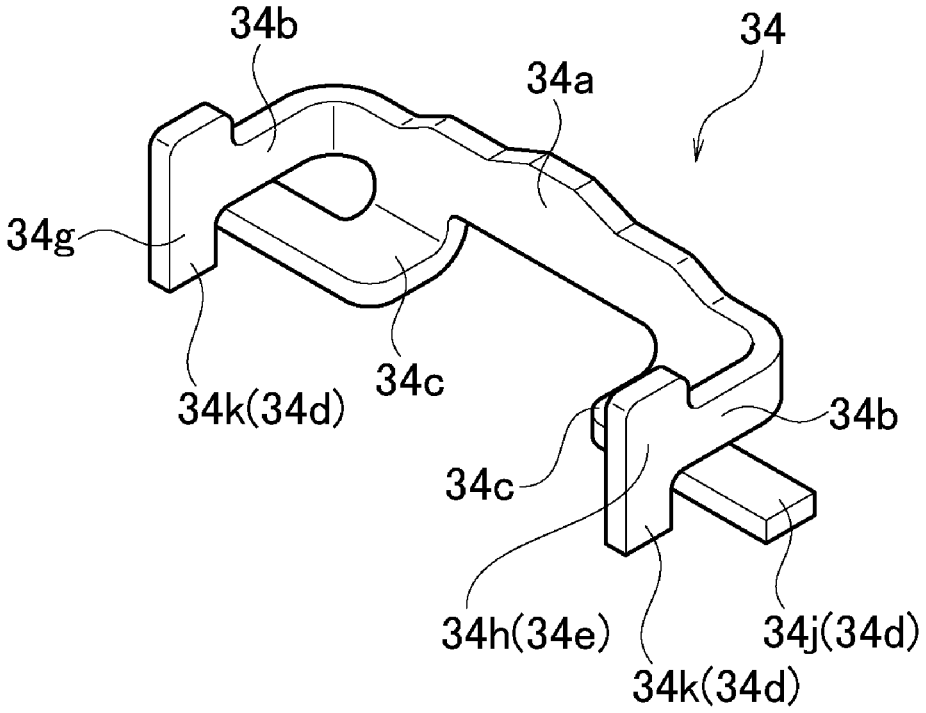
FIG. 27A is a first perspective view of a socket-side retainer of the connector according to the first exemplary embodiment of the present invention.
Figure 27B:
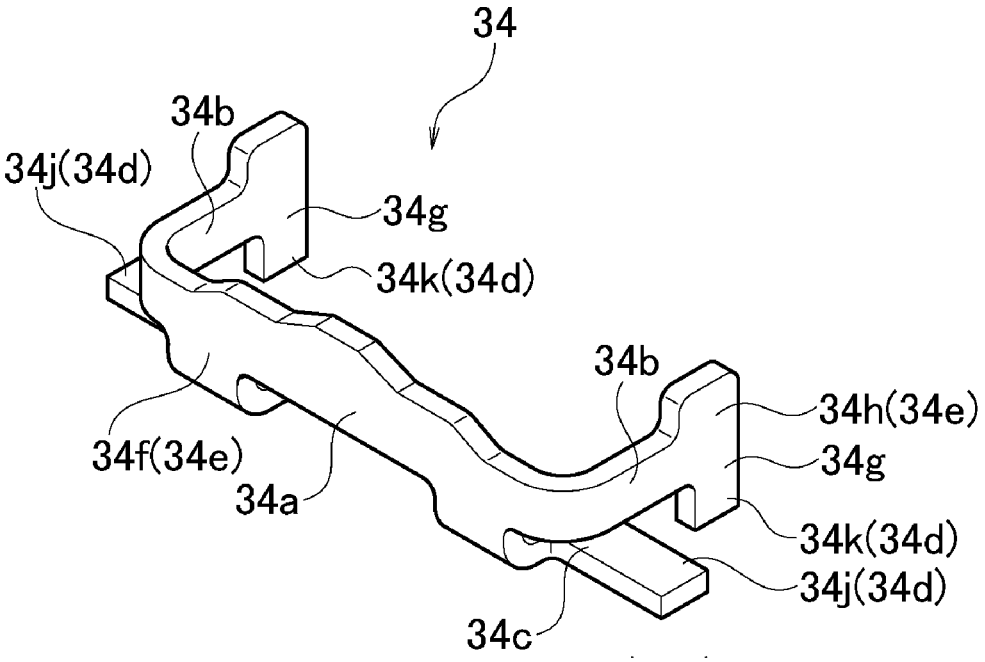
FIG. 27B is a second perspective view of the socket-side retainer shown in FIG. 27A.
Figure 27C:
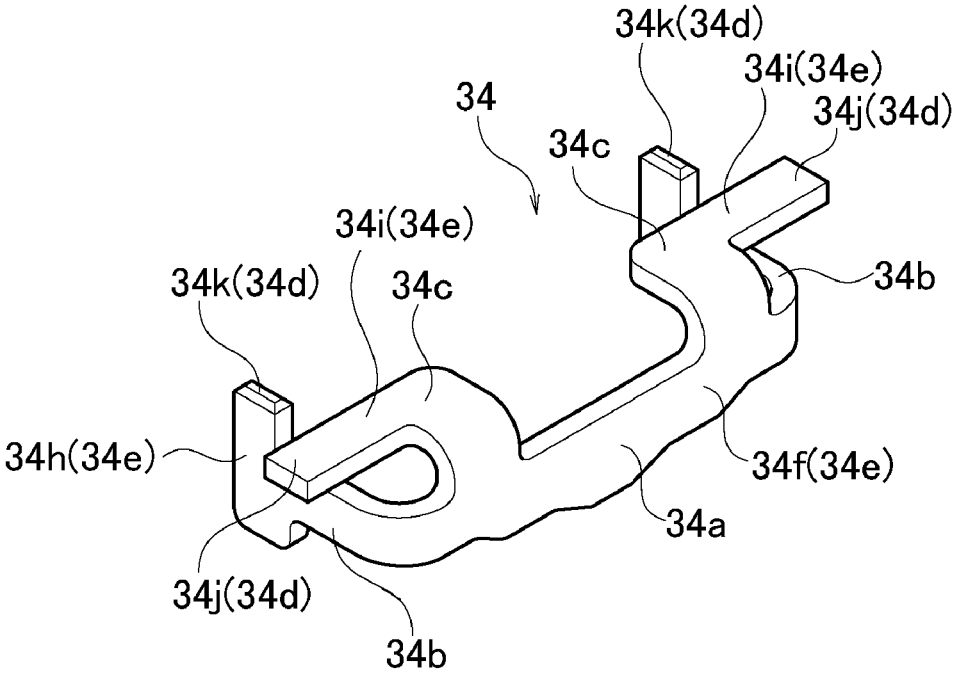
FIG. 27C is a third perspective view of the socket-side retainer shown in FIG. 27A.
Figure 27D:
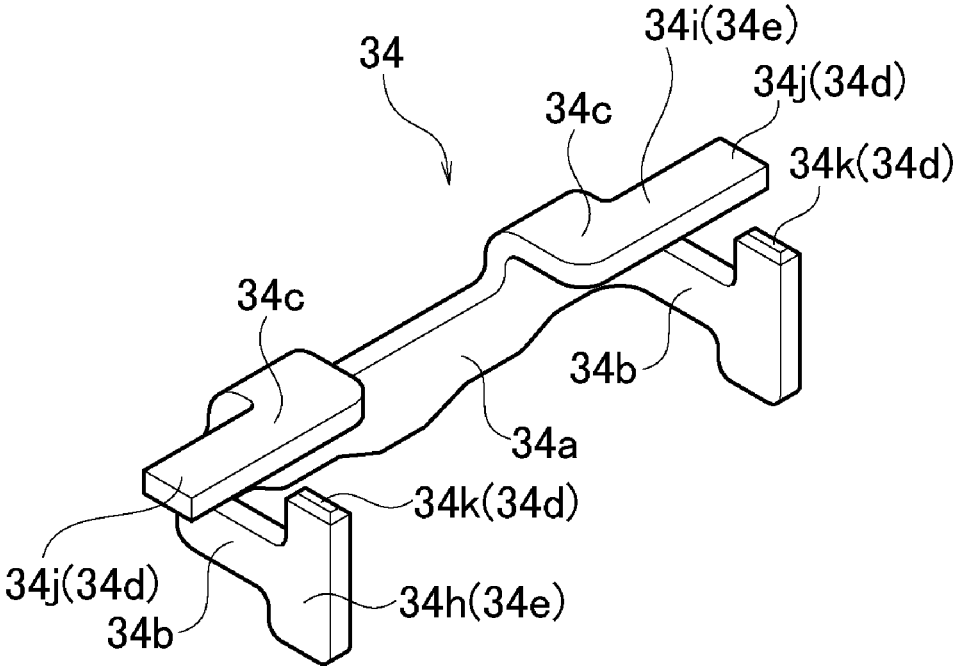
FIG. 27D is a fourth perspective view of the socket-side retainer shown in FIG. 27A.
Figure 28:
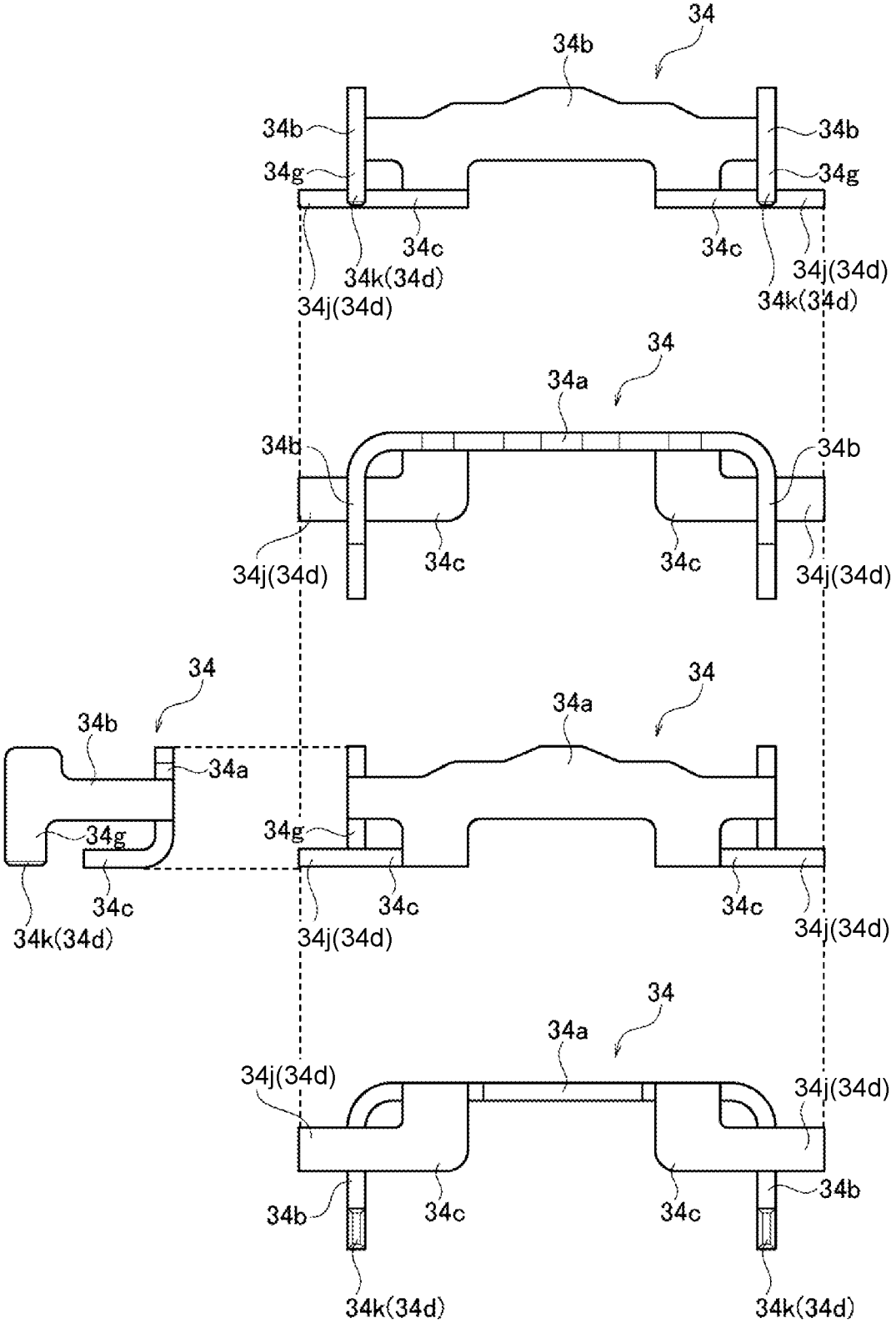
FIG. 28 is a diagram showing the socket-side retainer of the connector according to the first exemplary embodiment of the present invention.

Next, with reference to FIGS. 27A to 28, a description will be given of the structure of socket-side retainer 34.

Socket-side retainer 34 can be formed by bending a retainer plate which is formed by press-molding of a metal plate having a predetermined thickness. Socket-side retainer 34 has side plate part 34*a* extending in width direction Y of connector 10, and bottom plate parts 34*c* which are formed by bending the lower side of side plate part 34*a* toward the center in long side direction X substantially at right angles. By causing the opposite ends of bottom plate part 34*c* to project outward from the opposite side in width direction Y of connector 10, first fixed terminals 34*j* as fixed terminals 34*d* are formed.

At the opposite ends in width direction Y of side plate part 34*a*, extending parts 34*b* are formed by bending opposite ends in width direction Y of side plate part 34*a* toward the center of long side direction X of connector 10 substantially at right angles. At terminating part 34*g* in the extending direction of each of extending parts 34*b*, second fixed terminal 34*k* is provided as fixed terminal 34*d*, which extends downward and fixed to first circuit board 60 with solder 70.

In the present exemplary embodiment, four pairs of fixed terminals each formed by first fixed terminal 34*j* and second fixed terminal 34*k* disposed in close proximity to each other are provided in the opposite ends in long side direction X of long sides of connector 10, so as to be juxtaposed to socket-side terminal groups G2.

In this manner, in the present exemplary embodiment, socket-side retainer 34 has first fixed terminals 34*j* fixed on first circuit board 60, and second fixed terminals 34*k* that are formed separately from first fixed terminal 34*j* and fixed on first circuit board 60. Second fixed terminals 34*k* extend from extending parts 34*b* of socket-side retainer 34.

Here, second fixed terminal 34*k* is provided at a position where the route on socket-side retainer 34 from corresponding first fixed terminal 34*j* (the distance along the outer surface of socket-side retainer 34) becomes the maximum.

Further, in the present exemplary embodiment, socket-side retainer 34 is mounted (disposed) on socket housing 31 by insert molding. Here, at least part of socket-side retainer 34 is exposed along socket housing 31.

That is, at least part of socket-side retainer 34 is exposed along outer surface 31*s* of socket housing 31.

Further, in the present exemplary embodiment, part of outer surface 31*s* of circumferential wall part 31*b* and plate-like wall part 31*a* and part of outer wall surface 34*e* of socket-side retainer 34 are substantially flush with each other. In other words, socket-side retainer 34 is integrated with socket housing 31, so that part of outer wall surface 34*e* of socket-side retainer 34 is exposed at outer surface 31*s* of circumferential wall part 31*b* as being substantially flush with each other.

Specifically, the upper part of outer surface 34*f* of side plate part 34*a* is exposed while being flush with side surface (end surface in the long side direction) 31*t* that extends to the outermost end in X direction (the long side direction) of socket housing 31. In this manner, in the present exemplary embodiment, socket-side retainer 34 is exposed along at least one of side surface 31*t* and bottom surface 31*u* of socket housing 31.

Note that, though outer surface 34*i* of bottom plate part 34*c* is exposed while not being flush with bottom surface 31*u* (outer surface 31*s*) of socket housing 31, outer surface 34*i* of bottom plate part 34*c* may be exposed while being flush with bottom surface 31*u* (outer surface 31*s*) of socket housing 31. Further, it is not necessary for outer wall surface 34*e* of socket-side retainer 34 to be exposed at the outer surface of circumferential wall part 31*b* (outer surface 31*s* of short side direction wall part 31*i*). In the case where outer wall surface 34*e* is exposed also, it is not necessary for outer wall surface 34*e* to be exposed while being flush with the outer surface of circumferential wall part 31*b* (outer surface 31*s* of short side direction wall part 31*i*). Further, outer wall surface 34*e* of extending parts 34*b* (outer surface 34*h*) may be exposed outside the outer surface of circumferential wall part 31*b* (outer surface 31*s* of long side direction wall part 31*h*). Here, outer wall surface 34*e* may be exposed while being flush or not being flush.

As shown in FIGS. 30 and 32, inserting and fitting circumferential wall part 21*b* of header housing 21 into fitting groove part 31*d* of socket housing 31 fits header 20 into socket 30.

Note that, in fitting header 20 into socket 30, for example, tapered part 31*e* and tapered part 21*d* formed at the long side portion on one end side in Y direction (a width direction: a short side direction) may be overlaid on each other, and fitted to each other while being displaced toward the other end in Y direction (the width direction: the short side direction). In this manner, tapered part 31*e* and tapered part 21*d* can function as guide parts, and fitting of header 20 into socket 30 is facilitated.

In the state where header 20 fits into socket 30, contact part R1 of socket-side signal terminal 32 and contact part R1 of header-side signal terminal 22 are brought into contact with each other.

Further, contact part R2 of socket-side signal terminal 32 and contact part R2 of header-side signal terminal 22 are brought into contact with each other.

Contact part R3 of socket-side power supply terminal 33 and contact part R3 of header-side power supply terminal 23 are brought into contact with each other.

Further, contact part R4 of socket-side power supply terminal 33 and contact part R4 of header-side power supply terminal 23 are brought into contact with each other.

As a result, socket-side signal terminal 32 and header-side signal terminal 22 are electrically connected to each other, and socket-side power supply terminal 33 and header-side power supply terminal 23 are electrically connected to each other.

Thus, circuit pattern 61 of first circuit board 60 and circuit pattern 41 of second circuit board 40 are electrically connected to each other.

On the other hand, in disconnecting header 20 and socket 30 from each other, they are removed in the separating direction. Then, while step-like engaging part 32*d* and step-like engaged part 22*e* relatively slide, the spring part (32*e*, 32*f*, 32*g*, 32*h*, 32*i*, 32*j*, 32*k*, 32*m*) of socket-side signal terminal 32 elastically deforms, releasing engagement between engaging part 33*d* and engaged part 23*e*. At this time, fitting of arc-shaped projecting part 32*k* into recessed part 22*c* is also released.

Further, while step-like engaging part 33*d* and step-like engaged part 23*e* relatively slide, the spring part (33*e*, 33*f*, 33*g*, 33*h*, 33*i*, 33*j*, 33*k*, 33*m*) of socket-side power supply terminal 33 elastically deforms, releasing engagement between engaging part 33*d* and engaged part 23*e*. At this time, fitting of arc-shaped projecting part 33*k* into recessed part 23*c* is also released.

Thus, header 20 and socket 30 can be separated from each other.

Note that, in the present exemplary embodiment, header-side signal terminal 22 and header-side power supply terminal 23 are mounted on header housing 21 so that their respective heights in Z direction of their tip parts on socket 30 side in fitting header 20 and socket 30 to each other become substantially identical to each other.

On the other hand, socket-side signal terminal 32 and socket-side power supply terminal 33 are mounted on socket housing 31 so that so that their respective heights in Z direction of their tip parts on header 20 side in fitting header 20 and socket 30 to each other become substantially identical to each other.

Accordingly, in fitting header 20 and socket 30 to each other, contact between header-side power supply terminal 23 and socket-side power supply terminal 33 and contact between header-side signal terminal 22 and socket-side signal terminal 32 take place substantially simultaneously.

Further, in separating header 20 and socket 30 from each other, contact between header-side power supply terminal 23 and socket-side power supply terminal 33 and contact between header-side signal terminal 22 and socket-side signal terminal 32 are released substantially simultaneously.

Further, in the present exemplary embodiment, as described above, header-side retainers 24 are disposed at the opposite ends in long side direction X of header housing 21, and socket-side retainers 34 are disposed at the opposite ends in long side direction X of socket housing 31. Header-side retainers 24 and socket-side retainers 34 are used for enhancing the strength of header housing 21 and socket housing 31, and fixing header housing 21 and socket housing 31 respectively to the circuit boards.

In the present exemplary embodiment, soldering fixed terminal 24*a* of header-side retainer 24 to second circuit board 40 strongly couples header 20 to second circuit board 40.

Further, soldering fixed terminal 34*d* of socket-side retainer 34 to first circuit board 60 strongly couples socket 30 to first circuit board 60.

Such a structure allows header 20 and socket 30, which are respectively strongly coupled to the circuit boards, to fit to each other. Thus, header-side signal terminal 22 and socket-side signal terminal 32 are electrically connected to each other by being in contact with each other, and header-side power supply terminal 23 and socket-side power supply terminal 33 are electrically connected to each other by being in contact with each other. Thus, the circuit patterns of respective circuit boards can be electrically connected to each other.

Next, with reference to FIGS. 34 to 37, a description will be given of structures for fixing the terminals and the retainers to the circuit patterns. Note that, the structures for fixing the terminals and the retainers to the circuit patterns are not limited to the structures shown in FIG. 34 to FIG. 37.

Figure 34:
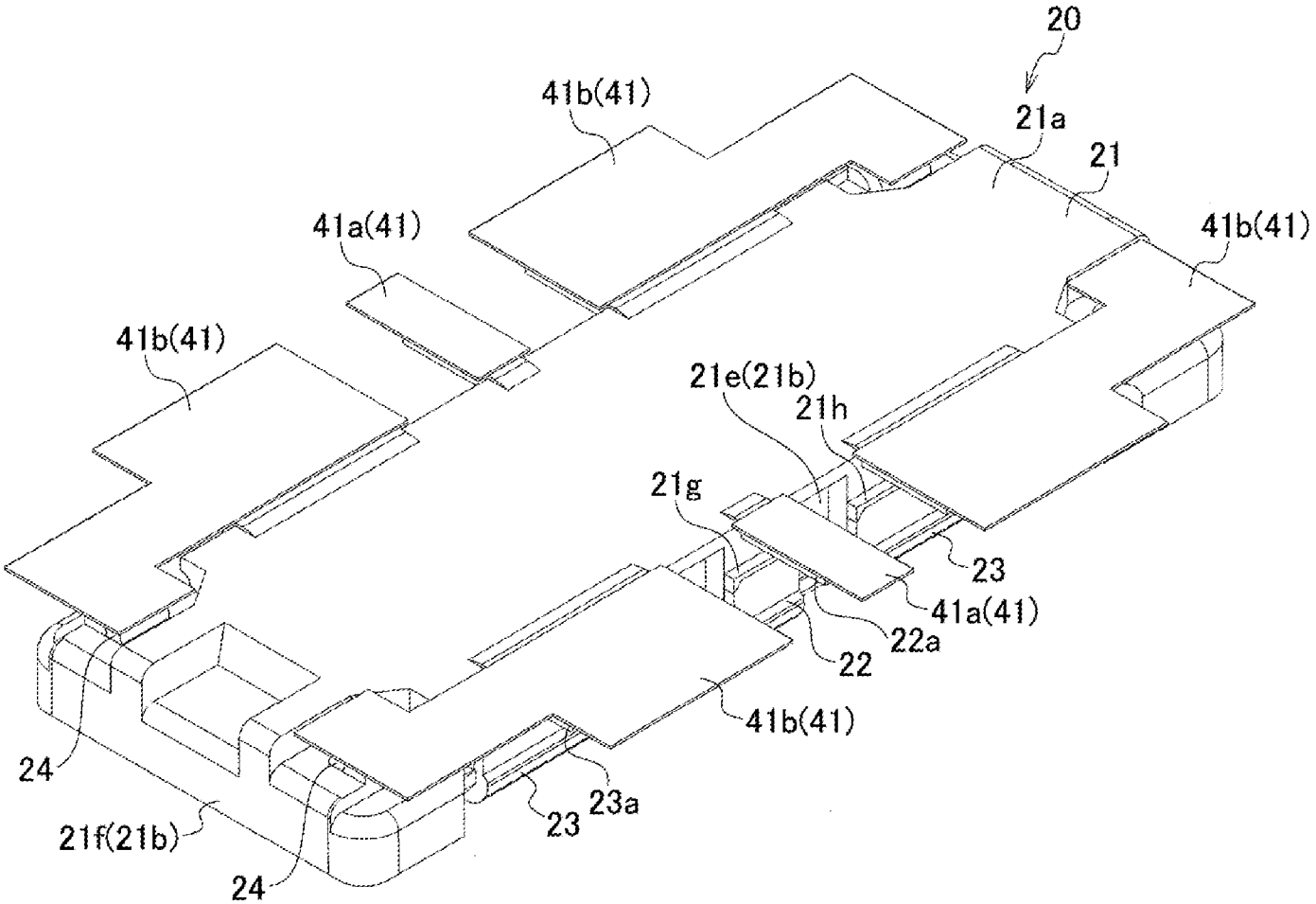
FIG. 34 is a perspective view schematically showing an exemplary connection state between the terminals of the header according to the first exemplary embodiment of the present invention and circuit patterns.

Header-side signal terminals 22, header-side power supply terminals 23, and header-side retainers 24 can be fixed to circuit pattern 41 as shown in FIG. 34.

Header-side signal terminals 22 disposed at the center in long side direction X respectively have their root parts 22*a* fixed to signal-use circuit patterns 41*a* with solder 50.

On the other hand, header-side power supply terminals 23 disposed on the opposite sides in long side direction X have their respective root parts 23*a* fixed to common circuit patterns 41*b* with solder 50. Header-side retainers 24 also have their respective fixed terminals 24*a* fixed to common circuit patterns 41*b* with solder 50.

In this manner, in FIG. 34, fixed terminals 24*a* and root parts 23*a* are soldered to common circuit patterns 41*b*.

Further, in FIG. 34, header-side power supply terminal 23 and header-side retainer 24 disposed adjacent to each other are soldered to common circuit pattern 41*b*. That is, header-side power supply terminal 23 and header-side retainer 24 disposed adjacent to each other share circuit pattern 41*b*.

Accordingly, two header-side power supply terminals 23 disposed on one side in long side direction X are electrically connected to each other via circuit patterns 41*b* disposed on one side in long side direction X and header-side retainers 24 disposed on one side in long side direction X. Further, two header-side power supply terminals 23 disposed on the other side in long side direction X are also electrically connected to each other via circuit patterns 41*b* disposed on the other side in long side direction X and header-side retainers 24 disposed on the other side in long side direction X.

Figure 35:
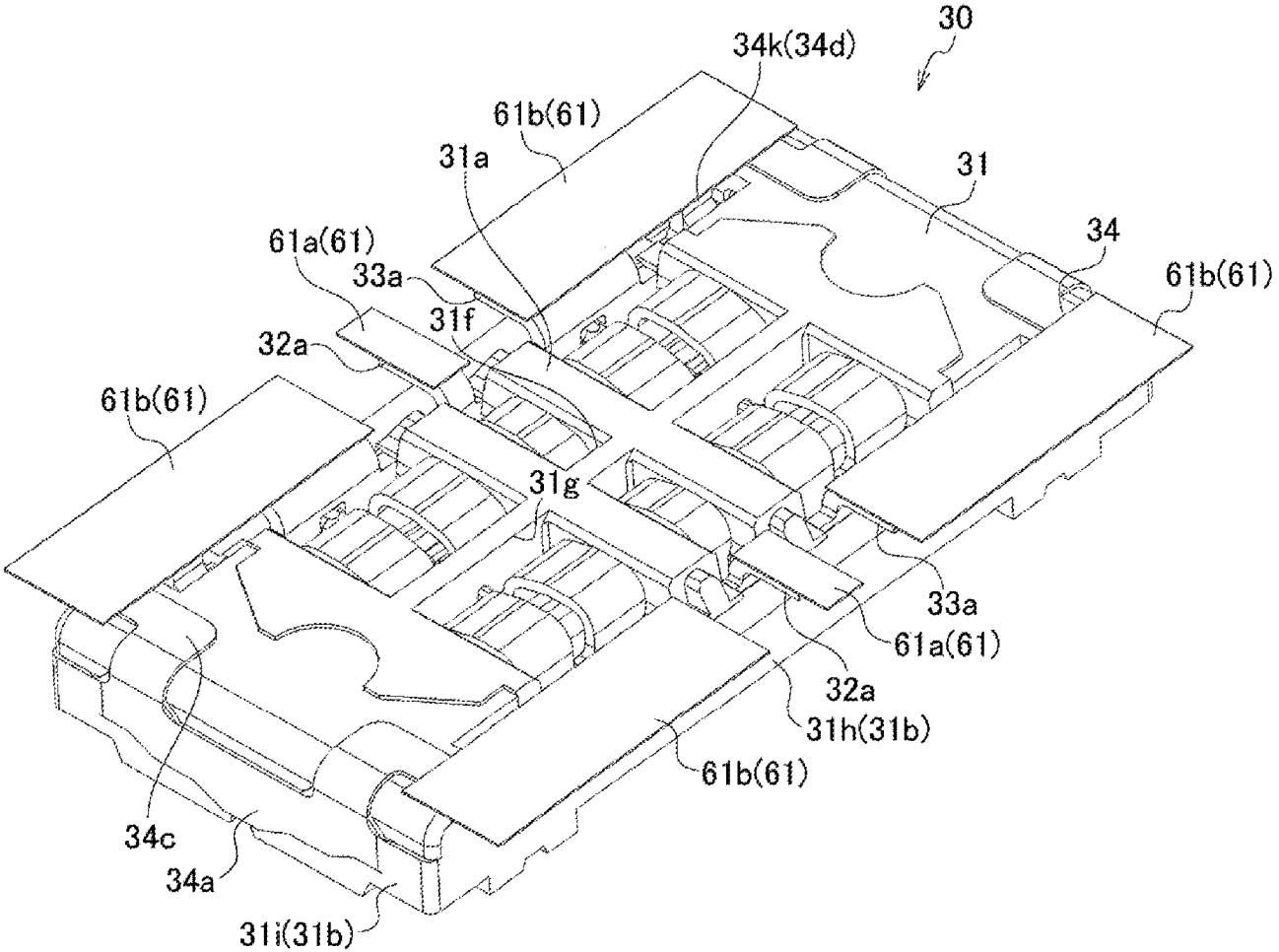
FIG. 35 is a perspective view schematically showing an exemplary connection state between the terminals of the socket according to the first exemplary embodiment of the present invention and circuit patterns.

On the other hand, socket-side signal terminals 32, socket-side power supply terminals 33, and socket-side retainers 34 are fixed to circuit pattern 61 as shown in FIG. 35.

Socket-side signal terminals 32 disposed at the center in long side direction X respectively have their root parts 32*a* fixed to signal-use circuit patterns 61*a* with solder 70.

Socket-side power supply terminals 33 disposed on the opposite sides in long side direction X have their respective root parts 33*a* fixed to common circuit patterns 61*b* with solder 70. Socket-side retainers 34 also have their respective fixed terminals 34*d* fixed to common circuit patterns 61*b* with solder 70.

In this manner, in FIG. 35, fixed terminals 34*d* and root parts 33*a* are soldered to common circuit patterns 61*b*.

Further, in FIG. 35, socket-side power supply terminal 33 and socket-side retainer 34 disposed adjacent to each other are soldered to common circuit pattern 61*b*. Accordingly, two socket-side power supply terminals 33 disposed on one side in long side direction X are electrically connected to each other via circuit patterns 61*b* disposed on one side in long side direction X and socket-side retainer 34 disposed on one side in long side direction X. Further, two socket-side power supply terminals 33 disposed on the other side in long side direction X are also electrically connected via circuit patterns 61*b* disposed on the other side in long side direction X and socket-side retainer 34 disposed on the other side in long side direction X.

Further, in the present exemplary embodiment, first fixed terminal 34*j* and second fixed terminal 34*k* forming a pair with each other are soldered to circuit pattern 61*b* where root part 33*a* is soldered.

Figure 36:
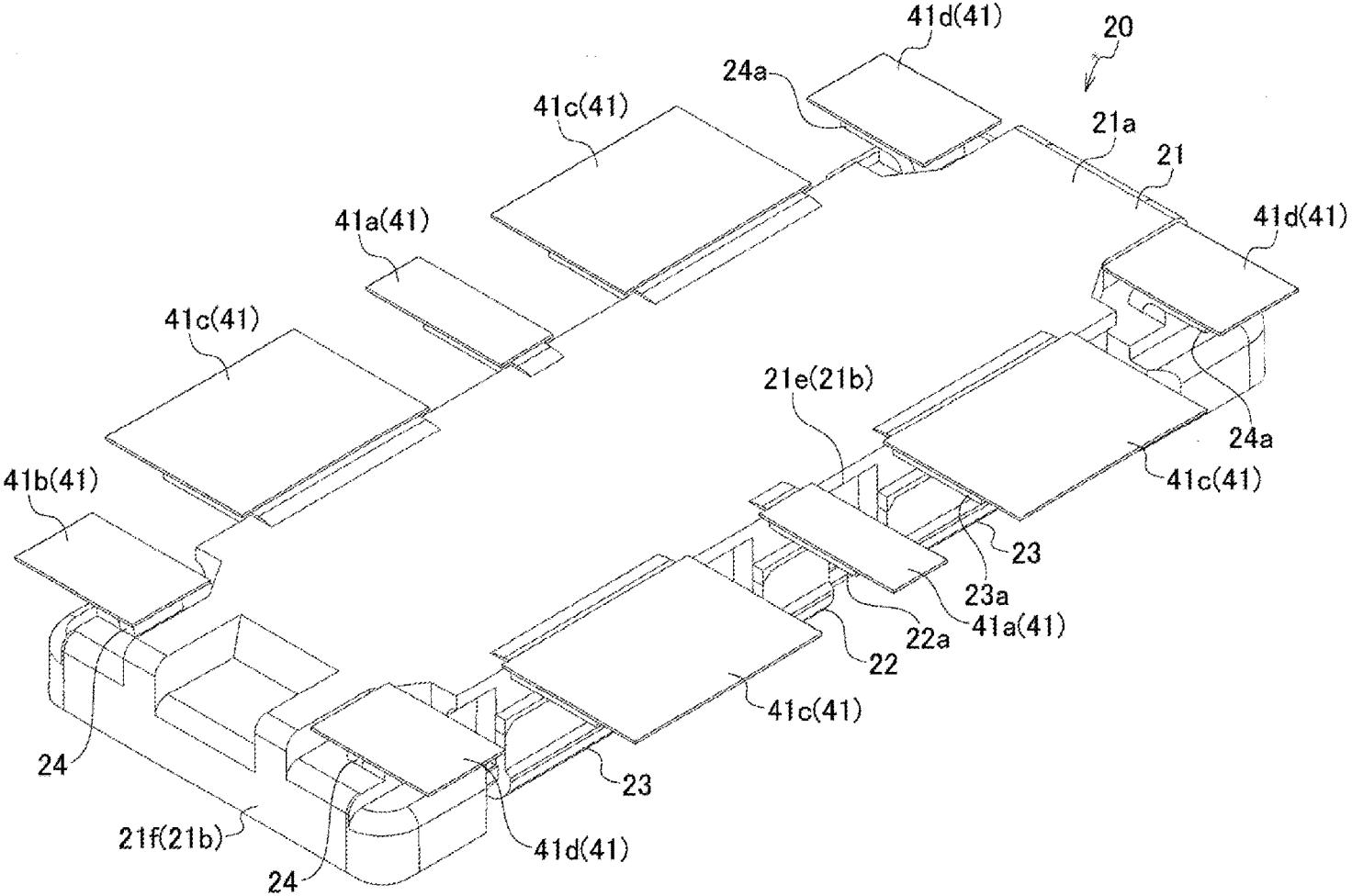
FIG. 36 is a perspective view schematically showing other exemplary connection state between the terminals of the header according to the first exemplary embodiment of the present invention and circuit patterns.

Still further, header-side signal terminals 22, header-side power supply terminals 23, and header-side retainers 24 are fixed to circuit pattern 41 as shown in FIG. 36.

Header-side signal terminals 22 disposed at the center in long side direction X respectively have their root parts 22*a* fixed to signal-use circuit patterns 41*a* with solder 50.

Further, header-side power supply terminals 23 disposed on the opposite sides in long side direction X have their respective root parts 23*a* fixed to power supply-use circuit patterns 41*c* with solder 50.

Header-side retainers 24 have their respective fixed terminals 24*a* fixed to circuit patterns 41*d* for fixing the retainers with solder 50.

In this manner, in FIG. 36, fixed terminals 24*a* and root parts 23*a* are soldered to separate circuit patterns 41.

Figure 37:
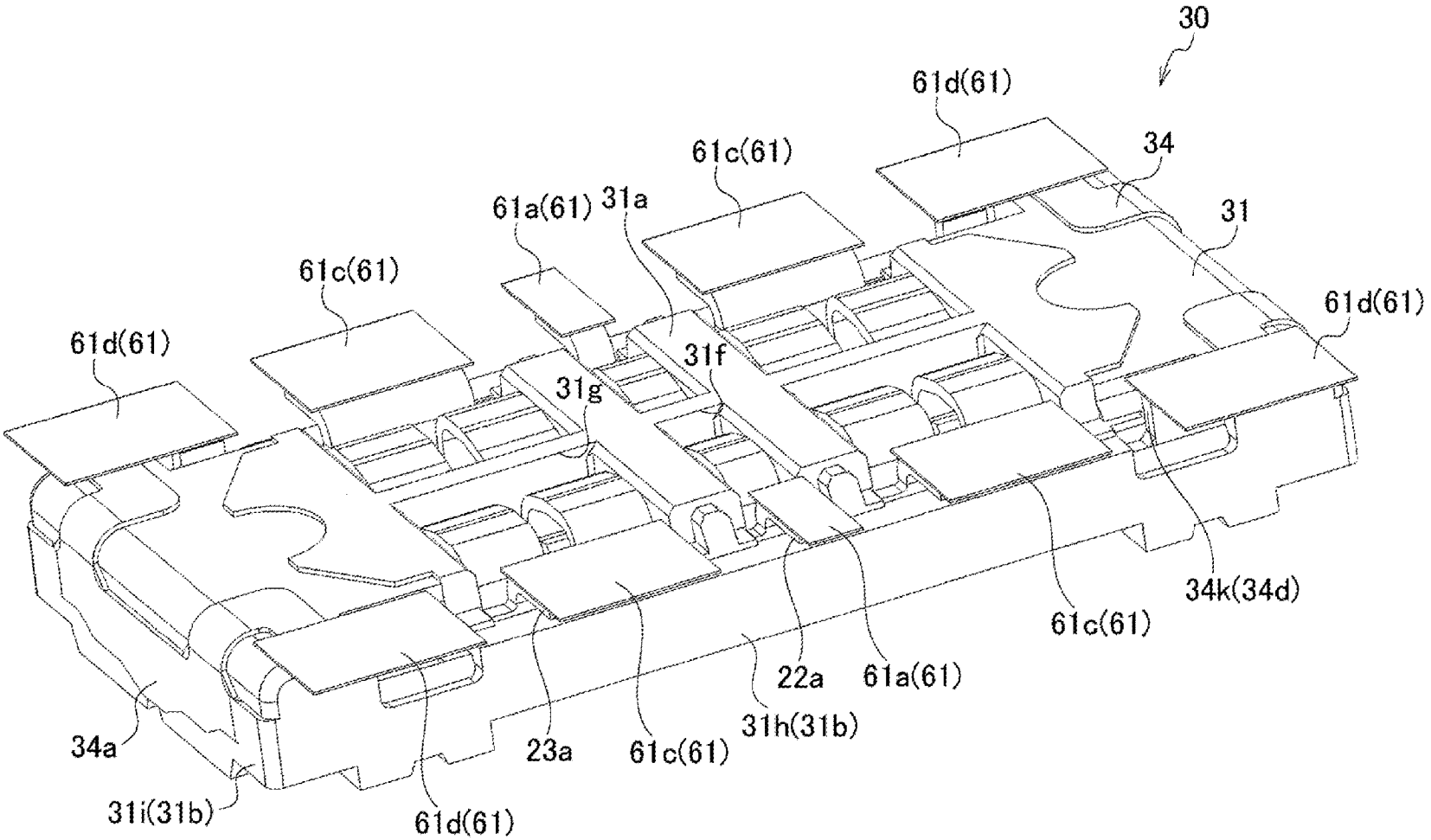
FIG. 37 is a perspective view schematically showing other exemplary connection state between the terminals of the socket according to the first exemplary embodiment of the present invention and circuit patterns.
Figure 38:
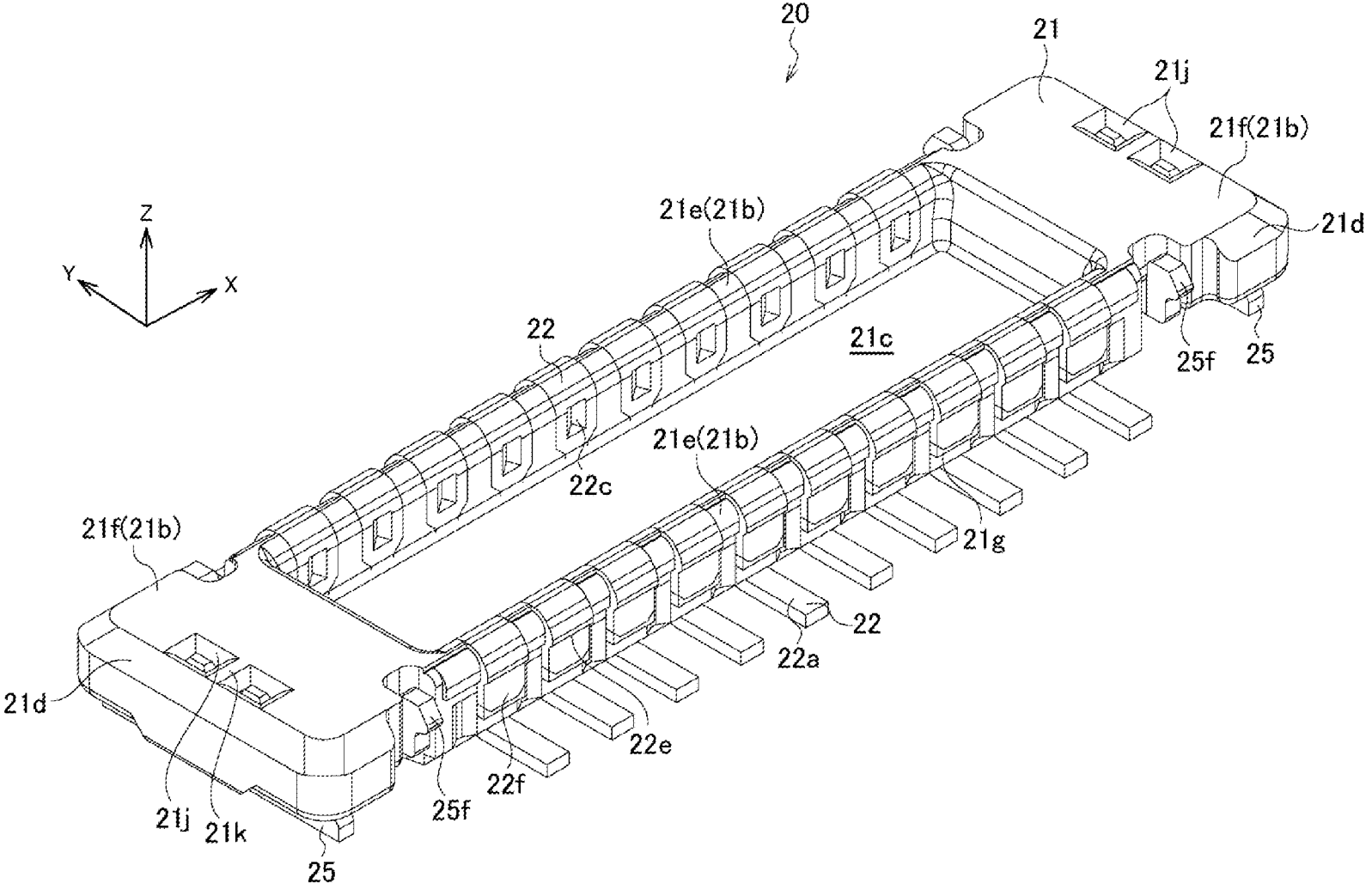
FIG. 38 is a perspective view showing a header of a connector according to a second exemplary embodiment of the present invention as seen from the back surface side.
Figure 39:
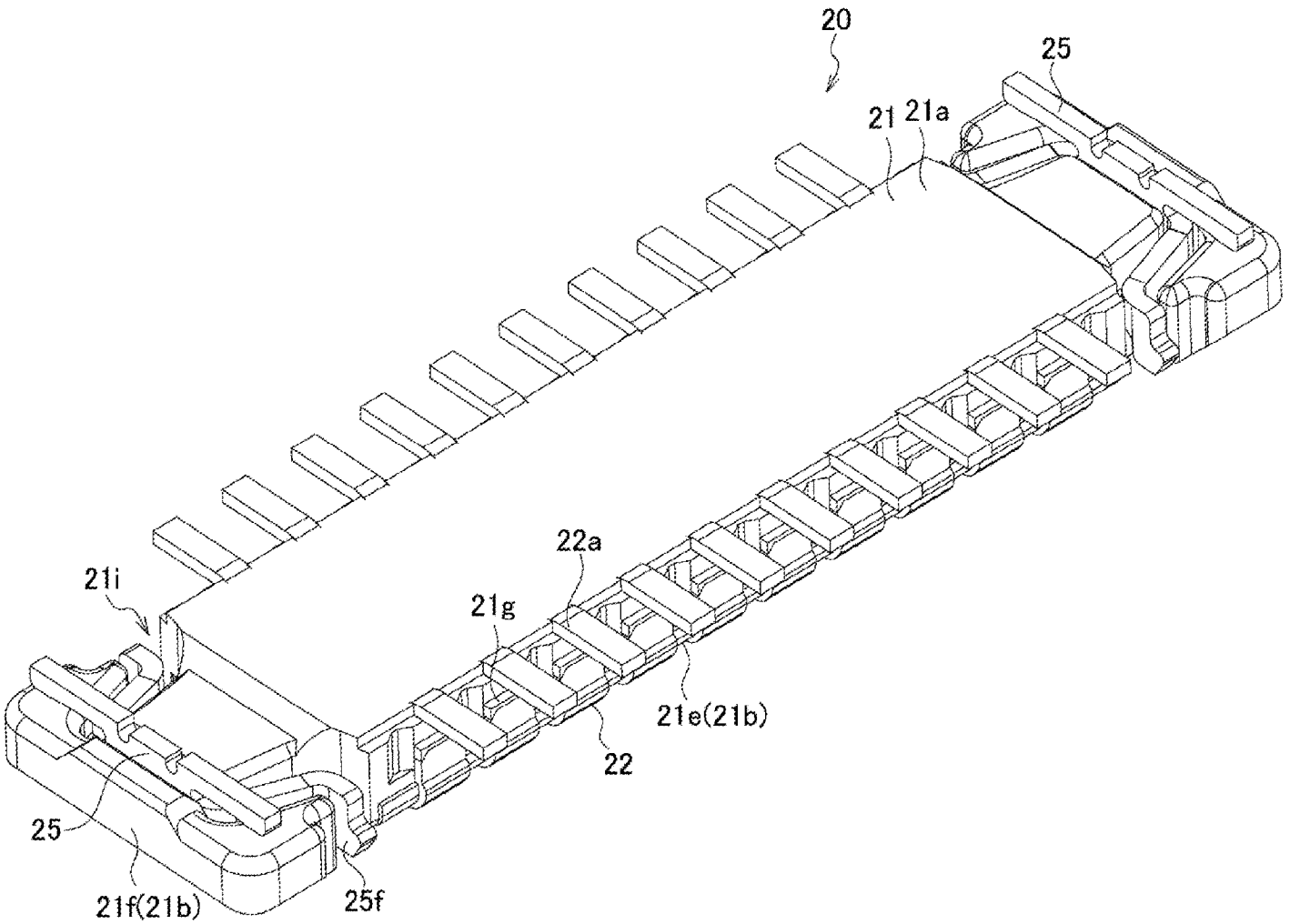
FIG. 39 is a perspective view showing the header of the connector according to the second exemplary embodiment of the present invention as seen from the front surface side.
Figure 40:
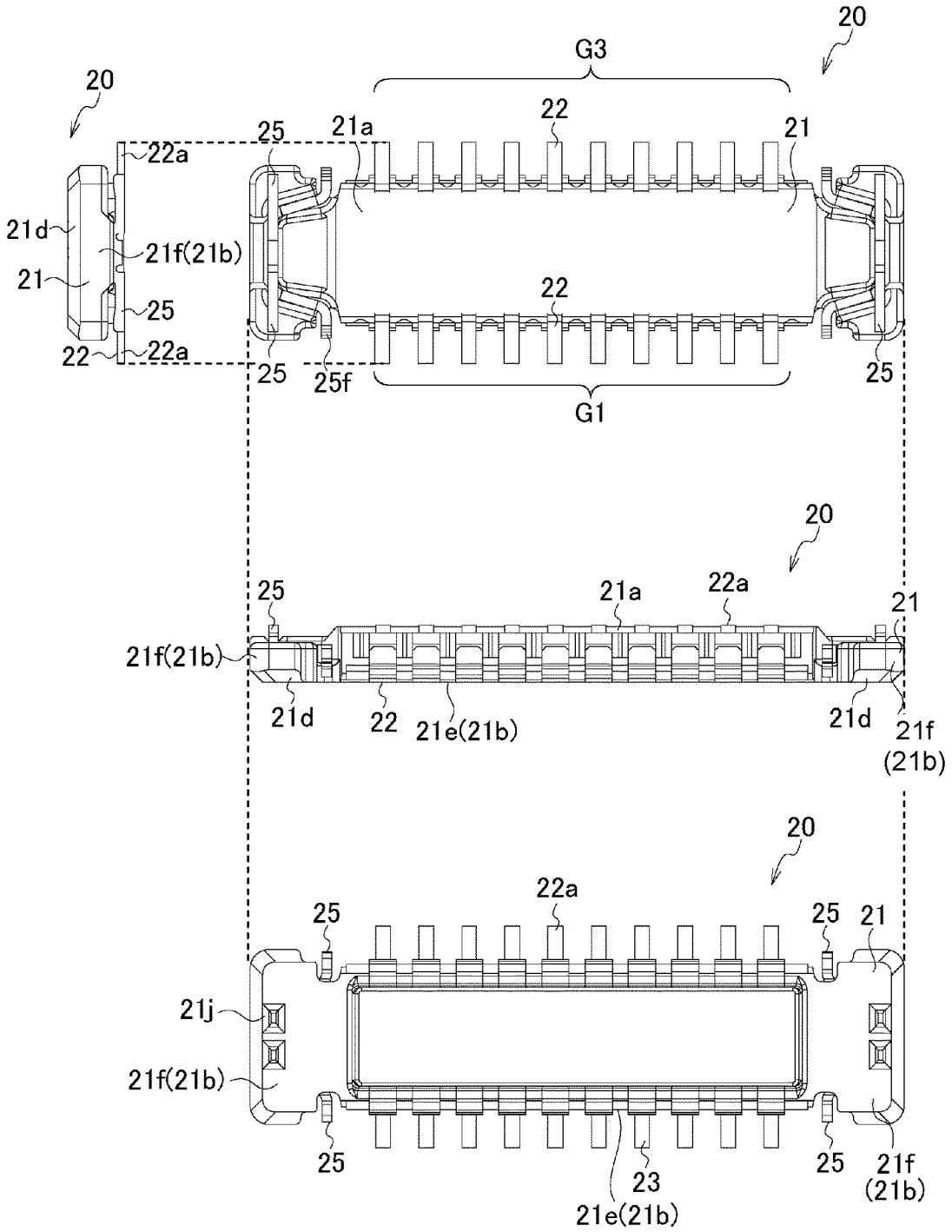
FIG. 40 is a diagram showing the header of the connector according to the second exemplary embodiment of the present invention.

On the other hand, socket-side signal terminals 32, socket-side power supply terminals 33, and socket-side retainers 34 are also fixed to circuit pattern 61 as shown in FIG. 37.

Socket-side signal terminals 32 disposed at the center in long side direction X respectively have their respective root parts 32*a* fixed to signal-use circuit patterns 61*a* with solder 70.

Further, socket-side power supply terminals 33 disposed on the opposite sides in long side direction X have their root parts 33*a* fixed to power supply-use circuit patterns 61*c* with solder 70.

Socket-side retainers 34 have their fixed terminals 34*d* fixed to circuit patterns 61*d* for fixing retainers with solder 70.

In this manner, in FIG. 37, fixed terminals 34*d* and root parts 33*a* are soldered to separate circuit patterns 61.

The structure for fixing connector 10 to the circuit patterns can be obtained by selecting one of FIG. 34 and FIG. 36 as the fixing structure on the socket side, and one of FIG. 35 and FIG. 37 as the fixing structure on the header side, and combining the selected structures.

As described above, connector 10 according to the present exemplary embodiment has socket 30 having substantially quadrangular socket housing 31 in which socket-side signal terminals 32 and socket-side power supply terminals 33 are disposed, and header 20 having substantially quadrangular header housing 21 in which header-side signal terminals 22 and header-side power supply terminals 23 are disposed.

Socket-side signal terminal 32 and socket-side power supply terminals 33 are disposed along long side direction X of socket housing 31. Socket-side signal terminal 32 is smaller than socket-side power supply terminal 33 in the width in long side direction X of socket housing 31.

In this manner, formation of dead space is suppressed as compared to the case where a plurality of terminals disposed to be spaced from each other are used in combination as a power supply-use terminal. Accordingly, socket 30 can be reduced in size in long side direction X.

Further, the cross-sectional shape of socket-side signal terminal 32 and the cross-sectional shape of socket-side power supply terminal 33 are substantially identical to each other. As a result, efficiency in components production and efficiency in assembly improve.

Further, in socket housing 31, a plurality of lines of socket-side terminal groups G2 are disposed, each of socket-side terminal groups G2 being formed by socket-side signal terminal 32 and socket-side power supply terminals 33 disposed along long side direction X of socket housing 31. This increases the cross-sectional area of the terminals, thereby increasing the current-carrying capacity.

Further, each socket-side power supply terminal 33 has step-like engaging part 33*d* that is engaged by header-side power supply terminal 23. Engaging part 33*d* is formed from one end to the other end in long side direction X of socket housing 31 in socket-side power supply terminal 33. As a result, not only an increase in the locking force, but also resistance to wear under repeated insertion/removal is achieved. Accordingly, an increase in life of the product is achieved.

Still further, socket-side power supply terminals 33 are disposed on the outer side in long side direction X of socket housing 31 relative to socket-side signal terminal 32. Thus, since socket-side power supply terminals 33 which generate heat by a greater amount are disposed on the outer side in long side direction X of socket housing 31, heat releasing efficiency further improves.

Still further, socket-side power supply terminal 33 and header-side power supply terminal 23 are provided with a plurality of contact parts R4 that are brought into contact with each other along long side direction X of socket housing 31. This reduces contact resistance while improving contact reliability of the terminals.

Still further, socket-side power supply terminal 33 is provided with a plurality of piece parts 35, 36. Each of the plurality of piece parts 35, 36 is provided with contact part R4. This reduces contact resistance while improving contact reliability of the terminals.

Still further, the plurality of piece parts 35, 36 are flexible, and can flex independently of each other. This reduces contact resistance while further improving contact reliability of the terminals.

Still further, socket-side power supply terminal 33 has the U-shaped part (33*e*, 33*f*, 33*g*, 33*h*, 33*i*, 33*j*). At one end (on 33*j* side) of the U-shaped part (33*e*, 33*f*, 33*g*, 33*h*, 33*i*, 33*j*), the free end part (33*k*, 33*m*) where contact part R4 is provided is continuously provided. The plurality of piece parts 35, 36 are formed at least at the free end part (33*k*, 33*m*). This further improves contact reliability of the terminals.

Still further, recessed part 23*c* is formed at the contact part (contact part R4 of header-side power supply terminal 23), which is one of contact part R4 of socket-side power supply terminal 33 and contact part R4 of header-side power supply terminal 23 being brought into contact with each other. Then, the other contact part (contact part R4 of socket-side power supply terminal 33) is brought into contact at opposite ends in long side direction X (contacts C1, C2) of socket housing 31 in recessed part 23*c*. This further improves contact reliability of the terminals.

Still further, socket-side retainer 34 is disposed in socket housing 31, and at least part (34*a*, 34*c*) of socket-side retainer 34 is exposed along outer surface 31*s* of socket housing 31. This further strongly fixes the socket housing and the socket-side retainer to each other while reducing the socket housing in size.

Still further, socket-side retainer 34 is exposed along at least one of side surface 31*t* and bottom surface 31*u* of socket housing 31. This further strongly fixes the socket housing and socket-side retainer to each other while reducing the socket housing in size.

Still further, socket-side retainer 34 is disposed in socket housing 31 by insert molding. This further strongly fixes the socket housing and the socket-side retainer to each other. In addition, as compared to the case where socket-side retainer 34 is press-fitted into socket housing 31, the contact area relative to the socket housing increases, and therefore heat releasing performance improves.

Still further, socket-side retainer 34 has fixed terminal 34*d* that is soldered to circuit pattern 61 formed at first circuit board 60. Socket-side power supply terminal 33 has root part 33*a* that is soldered to circuit pattern 61 formed at first circuit board 60. Fixed terminal 34*d* and root part 33*a* are soldered to common circuit pattern 61*b*. This allows the circuit pattern to which socket-side retainer 34 is fixed to be also used as a heat releasing plate for heat generated by socket-side power supply terminal 33, and heat releasing performance further improves.

Still further, socket-side retainer 34 and socket-side power supply terminal 33 are disposed adjacent to each other. Thus, not only an improvement in heat releasing performance, but also restriction of complication in the wiring shape of the circuit pattern is achieved.

Still further, fixed terminal 34*d* has first fixed terminal 34*j*, and second fixed terminal 34*k* that is formed separately from first fixed terminal 34*j*. This further strongly fixes socket-side retainer 34 and first circuit board 60 to each other.

Here, soldering first fixed terminal 34*j* and second fixed terminal 34*k* to circuit pattern 61*b* where root part 33*a* is soldered further improves the heat releasing effect.

Further, header-side signal terminal 22 and header-side power supply terminals 23 are disposed along long side direction X of header housing 21. Header-side signal terminal 22 is smaller than header-side power supply terminal 23 in the width in long side direction X of header housing 21. In this manner, formation of dead space is suppressed as compared to the case where a plurality of terminals disposed to be spaced from each other are used in combination as a power supply-use terminal. Accordingly, header 20 can be reduced in size in long side direction X.

Still further, the cross-sectional shape of header-side signal terminal 22 and cross-sectional shape of header-side power supply terminal 23 are substantially identical to each other. Thus, efficiency in components production and efficiency in assembly improve.

Still further, in header housing 21, a plurality of lines of header-side terminal groups G1 are disposed, each of header-side terminal groups G1 being formed by header-side signal terminal 22 and header-side power supply terminals 23 disposed along long side direction X of header housing 21. This increases the cross-sectional area of the terminals, thereby increasing the current-carrying capacity.

Still further, header-side power supply terminal 23 has step-like engaged part 23*e* that is engaged with socket-side power supply terminal 33. Engaged part 23*e* is formed from one end to the other end in long side direction X of header housing 21 in header-side power supply terminal 23. As a result, not only an increase in the locking force, but also resistance to wear under repeated insertion/removal is achieved. Accordingly, an increase in life of the product is achieved.

Still further, header-side power supply terminals 23 are disposed on the outer side in long side direction X of header housing 21 relative to header-side signal terminal 22. Thus, since header-side power supply terminals 23 which generate heat by a greater amount are disposed on the outer side in long side direction X of header housing 21, heat releasing performance further improves.

Still further, header-side retainer 24 is disposed in header housing 21. Header-side retainer 24 has fixed terminal 24*a* that is soldered to circuit pattern 41 formed at second circuit board 40. Further, header-side power supply terminal 23 has root part 23*a* that is soldered to circuit pattern 41 formed at second circuit board 40. Fixed terminal 24*a* and root part 23*a* are soldered to common circuit pattern 41*b*. This allows the circuit pattern to which header-side retainer 24 is fixed to be also used as a heat releasing plate for heat generated by header-side power supply terminal 23, and heat releasing performance further improves.

Still further, header-side retainer 24 and header-side power supply terminal 23 are disposed adjacent to each other. Thus, not only an improvement in heat releasing performance, but also restriction of complication in the wiring shape of the circuit pattern is achieved.

Still further, in fitting header 20 and socket 30 to each other, contact between header-side power supply terminal 23 and socket-side power supply terminal 33 and contact between header-side signal terminal 22 and socket-side signal terminal 32 take place substantially simultaneously. On the other hand, in separating header 20 and socket 30 from each other, contact between header-side power supply terminal 23 and socket-side power supply terminal 33 and contact between header-side signal terminal 22 and socket-side signal terminal 32 are released substantially simultaneously. Thus, in fitting header 20 and socket 30 to each other, an occurrence of solely contact between header-side power supply terminal 23 and socket-side power supply terminal 33, or solely contact between header-side signal terminal 22 and socket-side signal terminal 32 is restricted. This prevents an occurrence of solely contact between the signal-use terminals or between power supply-use terminals, and connection reliability of connector 10 further improves.

Second Exemplary Embodiment

In the following, a description will be given based on that the long side direction of a connector (a header housing and a socket housing) is X direction, the width direction (a short side direction) of the connector (the header housing and the socket housing) is Y direction, and the top-bottom direction of the connector in FIGS. 58 to 61 is Z direction. Further, a description will be given of the socket and the header based on that the top side in the state shown in FIGS. 58 to 61 is the top side in the top-bottom direction (the front surface side), and the bottom side is the bottom side in the top-bottom direction (back surface side).

Firstly, with reference to FIGS. 58 to 61, the overview of connector 10 according to the present exemplary embodiment will be described.

As shown in FIGS. 58 to 61, connector 10 according to the present exemplary embodiment has header 20 and socket 30 that fit to each other. In the present exemplary embodiment, header 20 has header housing 21 in which header-side signal terminals 22 and header-side retainers 25 are disposed. On the other hand, socket 30 has socket housing 31 in which socket-side signal terminals 32 and socket-side retainers 37 are disposed.

Header-side retainers 25 are used for enhancing the strength of header housing 21, and fixing fixed terminals 25*a* of header-side retainers 25 to the above-described second circuit board 40.

On the other hand, socket-side retainer 37 is used for enhancing the strength of socket housing 31, and fixing fixed terminal 37*d* of each socket-side retainer 37 to the above-described first circuit board 60.

Here, in the present exemplary embodiment, header-side retainers 25 function also as header-side power supply terminals, and socket-side retainers 37 also function as socket-side power supply terminals.

That is, header-side retainers 25 serve also as header-side power supply terminals, and socket-side retainers 37 serve also as socket-side power supply terminals.

Fitting header housing 21 and socket housing 31 to each other brings header-side signal terminals 22 and socket-side signal terminals 32 into contact with each other, and brings header-side retainers 25 as header-side power supply terminals and socket-side retainers 37 as socket-side power supply terminals into contact with each other Note that, socket 30 is mounted on second circuit board 40, and header 20 is mounted on first circuit board 60.

Accordingly, fitting header 20 and socket 30 to each other electrically connects second circuit board 40 on which header 20 is mounted and first circuit board 60 on which socket 30 is mounted to each other.

Specifically, mounting header 20 according to the present exemplary embodiment on second circuit board 40 electrically connects header-side signal terminals 22 and header-side power supply terminals 23 to circuit pattern 41 on second circuit board 40. Second circuit board 40 may be a printed circuit board (PCB) or a flexible printed circuit (FPC).

Further, mounting socket 30 according to the present exemplary embodiment on first circuit board 60 electrically connects socket-side signal terminals 32 and socket-side power supply terminals 33 to circuit pattern 61 on first circuit board 60. First circuit board 60 may also be a printed circuit board (PCB) or a flexible printed circuit (FPC).

Note that, connector 10 according to the present exemplary embodiment is similarly assumed to be used for electrically connecting between circuit boards in an electronic device as a mobile terminal such as a smartphone. However, so long as the connector of the present invention is used in an electronic device, the connector may be used for electrically connecting between any components.

Next, with reference to FIGS. 38 to 47, a description will be given of the structure of header 20 used in connector 10.

As described above, header 20 has header housing 21. In the present exemplary embodiment, header housing 21 is molded with insulating synthetic resin to be quadrangular (rectangular) as a whole in a plan view (see FIGS. 38 to 43).

In header housing 21, metal-made header-side signal terminals 22 and metal-made header-side retainers 25 are disposed. Header-side signal terminals 22 are electrically connected to a signal line for transmitting signals. On the other hand, as described above, header-side retainers 25 also serve as header-side power supply terminals, and are electrically connected to a power supply line for supplying power, while enhancing the strength of header housing 21.

In the present exemplary embodiment, a plurality of header-side signal terminals 22 are juxtaposed along one long side of header housing 21 at predetermined intervals. The plurality of header-side signal terminals 22 juxtaposed to each other on one side in width direction (short side direction) Y of header housing 21 form header-side signal terminal group G3.

Further, in the present exemplary embodiment, along one long side of header housing 21, two header-side retainers (header-side power supply terminals) 25 are juxtaposed to one header-side signal terminal group G3 while being spaced apart therefrom. One header-side signal terminal group G3 and two header-side retainers (header-side power supply terminals) 25 juxtaposed to each other on one side in width direction (short side direction) Y of header housing 21 form header-side terminal group G1.

Further, along the other long side of header housing 21 also, a plurality of header-side signal terminals 22 are disposed at predetermined intervals. The plurality of header-side signal terminals 22 juxtaposed to each other on the other side in width direction (short side direction) Y of header housing 21 form header-side signal terminal group G3.

Further, along the other long side of header housing 21, two header-side retainers (header-side power supply terminals) 25 are juxtaposed to one header-side signal terminal group G3 while being spaced apart therefrom. One header-side signal terminal group G3 and two header-side retainers (header-side power supply terminals) 25 juxtaposed to each other on the other side in width direction (short side direction) Y of header housing 21 form header-side terminal group G1.

In this manner, in the present exemplary embodiment, in header housing 21, two lines (a plurality of lines) of header-side terminal groups G1 are disposed, each of header-side terminal groups G1 being formed by header-side signal terminal group G3 and header-side retainers (header-side power supply terminals) 25 disposed in long side direction X of header housing 21.

Further, in header-side terminal group G1 of one line, header-side retainers (header-side power supply terminals) 25 are respectively disposed at the opposite ends of header-side signal terminal group G3. In other words, header-side retainers (header-side power supply terminals) 25 are disposed at opposite ends in long side direction X of header housing 21, and header-side signal terminal group G3 is disposed between header-side retainers (header-side power supply terminals) 25. In this manner, in the present exemplary embodiment, header-side retainers (header-side power supply terminals) 25 are disposed on the outer side in long side direction X of header housing 21 relative to header-side signal terminal group G3 (header-side signal terminals 22).

Figure 41:
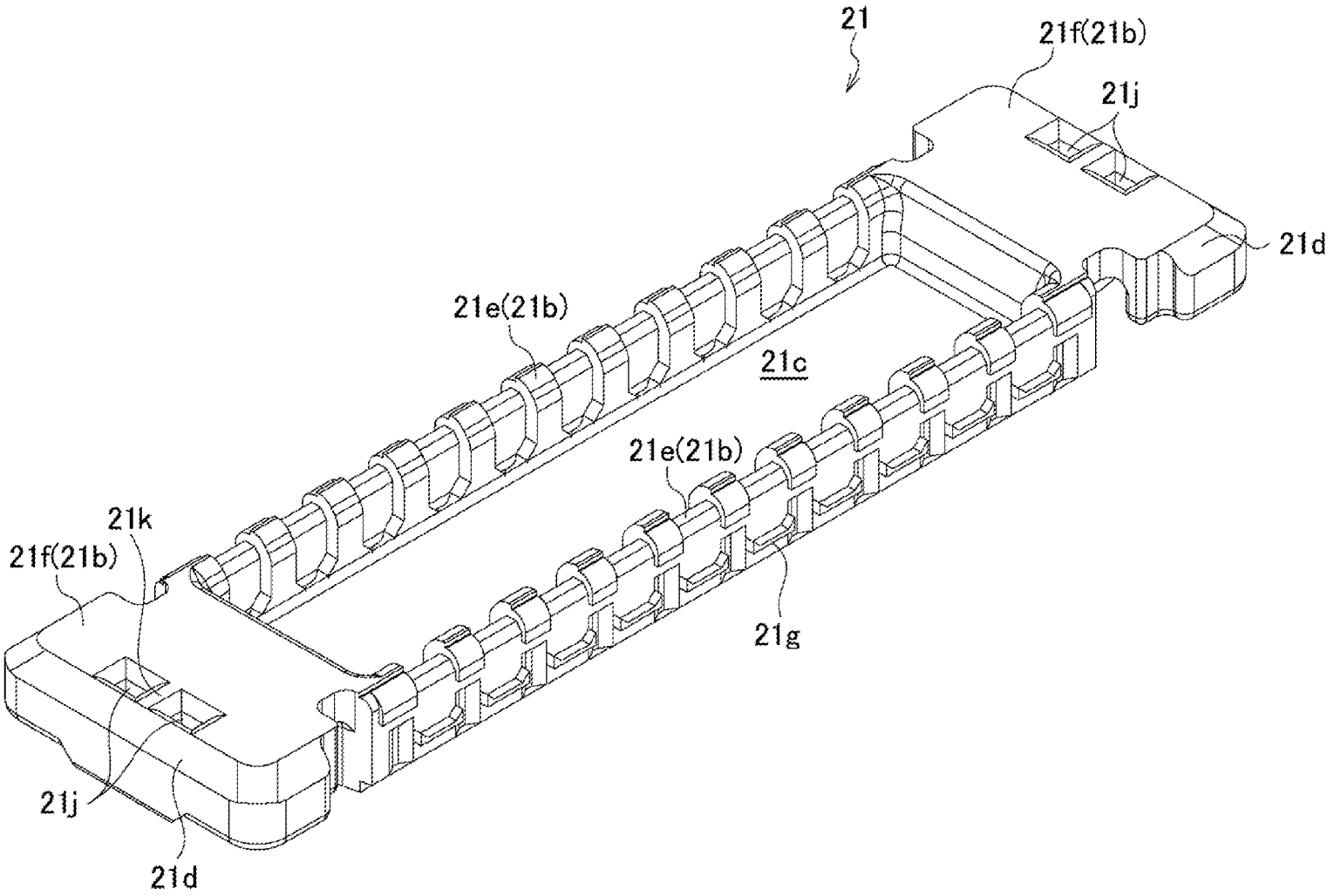
FIG. 41 is a perspective view showing a header housing of the connector according to the second exemplary embodiment of the present invention as seen from the back surface side.

Next, with reference to FIGS. 41 to 43, a description will be given of the structure of header housing 21.

Figure 42:
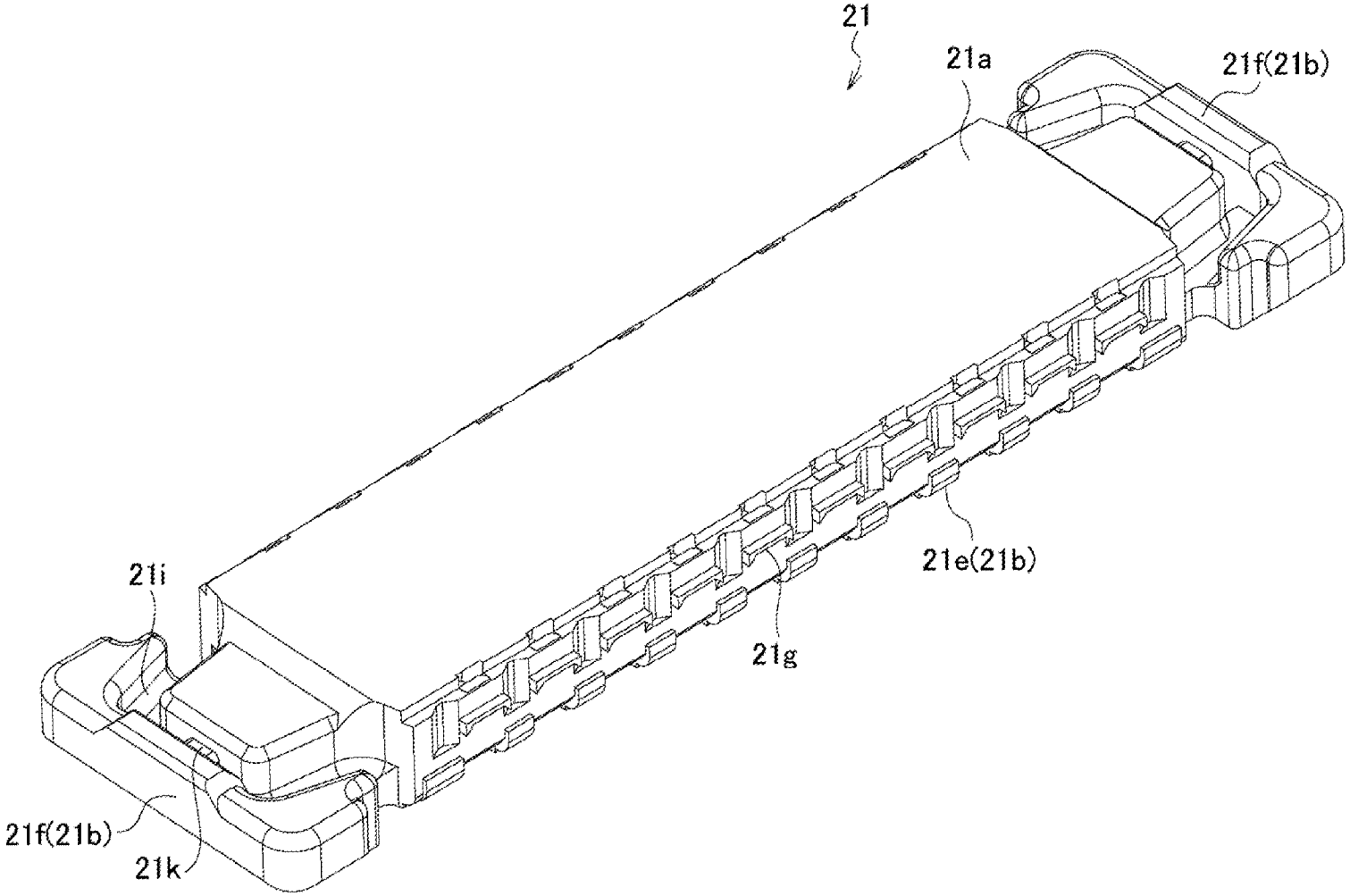
FIG. 42 is a perspective view showing the header housing of the connector according to the second exemplary embodiment of the present invention as seen from the front surface side.
Figure 43:
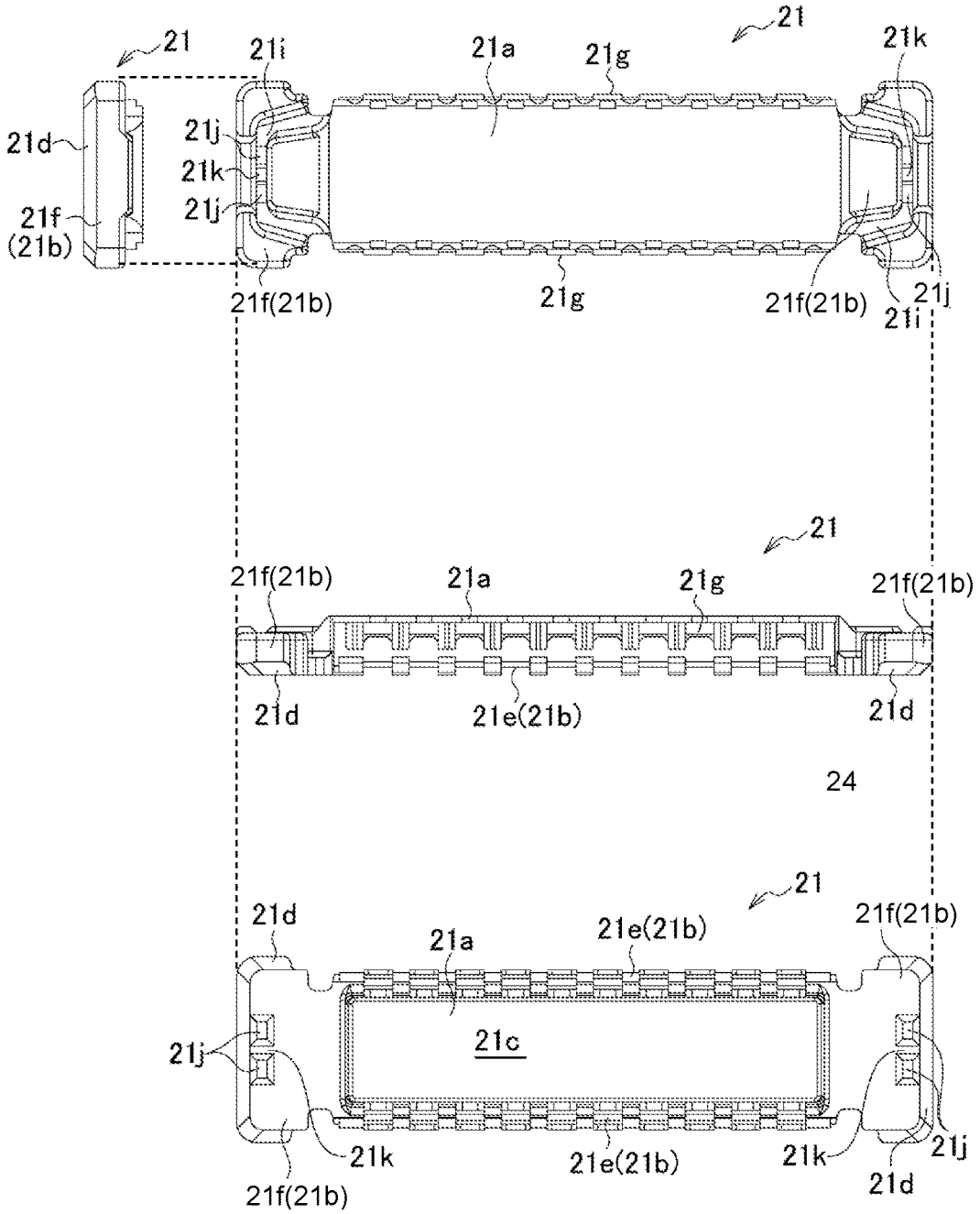
FIG. 43 is a diagram showing the header housing of the connector according to the second exemplary embodiment of the present invention.

Header housing 21 is formed to be substantially box-like with plate-like wall part 21*a* and circumferential wall part 21*b* formed continuously in a substantial rectangular annular shape along the circumference of plate-like wall part 21*a*, so as to open on one side (the bottom side in FIG. 42). On the inner side of circumferential wall part 21*b*, recessed part 21*c* (see FIG. 41) is formed. At the lower end in the outer circumferential side of circumferential wall part 21*b*, tapered parts 21*d* that are inclined to become higher (position toward plate-like wall part 21*a*) as they are positioned outward are formed. Tapered parts 21*d* are formed at opposite ends in the long side direction of long side direction wall parts 21*e* of circumferential wall part 21*b* and entire width direction Y of short side direction wall parts 21*f* of circumferential wall part 21*b*. That is, at the opposite ends in long side direction X of header housing 21, tapered parts 21*d* each being substantially U-shaped in a plan view (as seen from the back surface) are formed by short side direction wall parts 21*f* and the opposite ends in the long side direction of long side direction wall parts 21*e* continuous to the opposite ends in width direction Y of short side direction wall parts 21*f*.

Note that, each circumferential wall part 21*b* between adjacent header-side signal terminals 22 and between header-side signal terminal group G3 and header-side retainer (header-side power supply terminal) 25 is formed to be rounded (inverted U-shaped).

Further, header housing 21 formed so that the length of short side direction wall part 21*f* in width direction Y becomes greater than the distance between two opposite long side direction wall parts 21*e*.

Figure 44A:
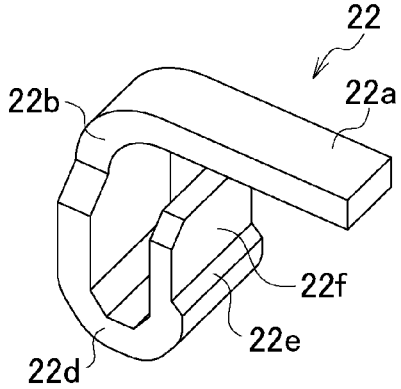
FIG. 44A is a first perspective view of a header-side signal terminal of the connector according to the second exemplary embodiment of the present invention.
Figure 44B:
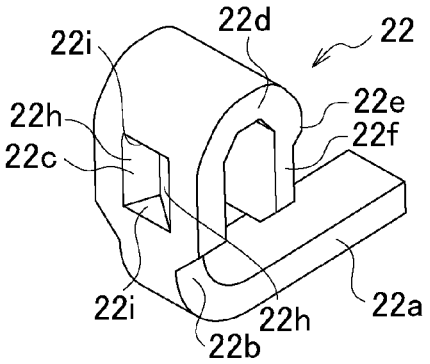
FIG. 44B is a second perspective view of the header-side signal terminal shown in FIG. 44A.
Figure 44C:
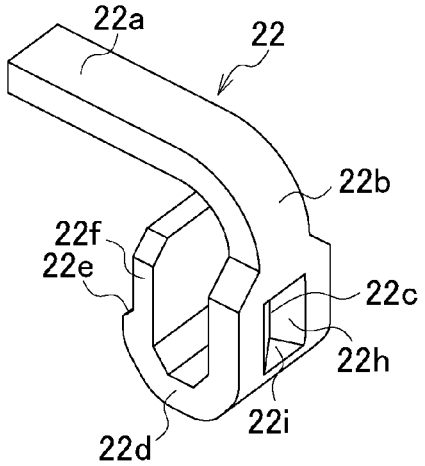
FIG. 44C is a third perspective view of the header-side signal terminal shown in FIG. 44A.
Figure 44D:
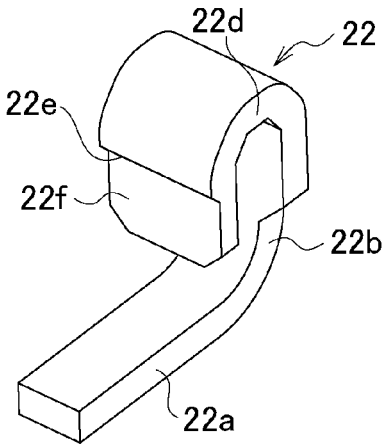
FIG. 44D is a fourth perspective view of the header-side signal terminal shown in FIG. 44A.
Figure 45:
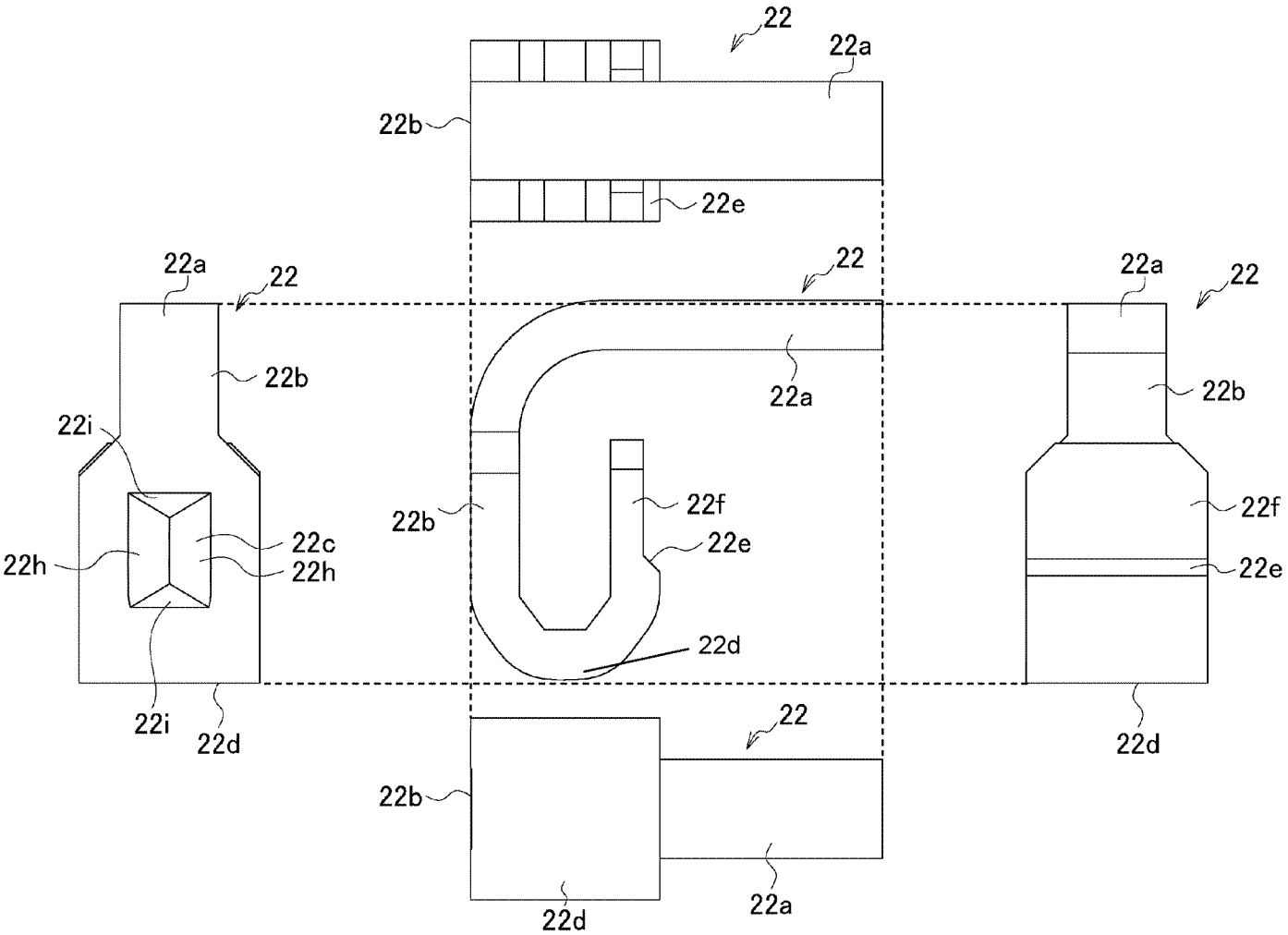
FIG. 45 is a diagram showing the header-side signal terminal of the connector according to the second exemplary embodiment of the present invention.

Next, with reference to FIGS. 44A to 45, a description will be given of the structure of each header-side signal terminal 22.

Header-side signal terminal 22 is fabricated by metal molding, and is an electrically conductive element. Header-side signal terminal 22 has root part 22*a* that projects from the side surface of header housing 21. Root part 22*a* is a site that is fixed to circuit pattern 41 of second circuit board 40 with solder 50. Further, as can be seen from FIG. 58, the upper surface of root part 22*a* extends substantially in parallel to the upper surface of header housing 21 (the outer surface of plate-like wall part 21*a*).

Further, header-side signal terminal 22 has inner side part 22*b* that is continuous to root part 22*a*. Inner side part 22*b* penetrates through the joining part between plate-like wall part 21*a* and long side direction wall part 21*e* of header housing 21 while bending, and extends to the tip part of long side direction wall part 21*e* along the inner surface of long side direction wall part 21*e*.

On the inner surface of inner side part 22*b* of header-side signal terminal 22, recessed part 22*c* is formed. In the present exemplary embodiment, recessed part 22*c* is formed to become substantially triangular prism-like by inclined surfaces 22*h* respectively provided continuously on the opposite sides in long side direction X and inclined surfaces 22*i* respectively provided continuously on the opposite sides in top-bottom direction Z. Into recessed part 22*c*, arc-shaped projecting part 32*k* of socket-side signal terminal 32 which will be described later, fits.

Further, header-side signal terminal 22 has tip part 22*d* that is continuous to one end of inner side part 22*b*. Tip part 22*d* bends along the shape of the tip of long side direction wall part 21*e* of header housing 21.

Header-side signal terminal 22 has engaged part 22*e* that is continuous to tip part 22*d*. In the present exemplary embodiment, engaged part 22*e* is formed from one end to the other end in long side direction X of header housing 21 in header-side signal terminal 22. That is, step-like engaged part 22*e* is formed over the entire width direction of header-side signal terminal 22.

Figure 58:
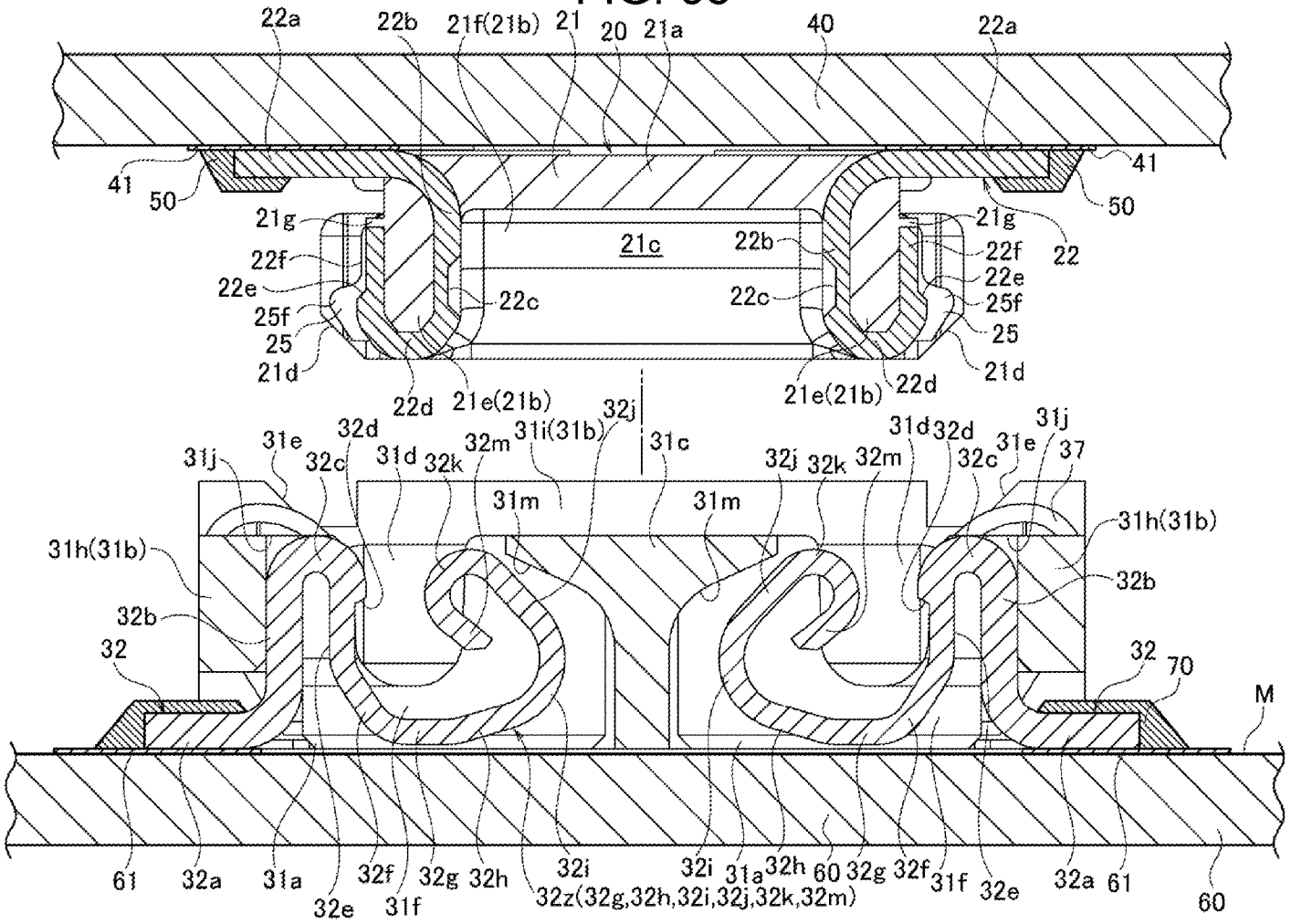
FIG. 58 is a cross-sectional view taken along a site where the header-side signal terminals and the socket-side signal terminals are disposed, showing a state immediately before the header and the socket according to the second exemplary embodiment of the present invention are fitted to each other.
Figure 59:
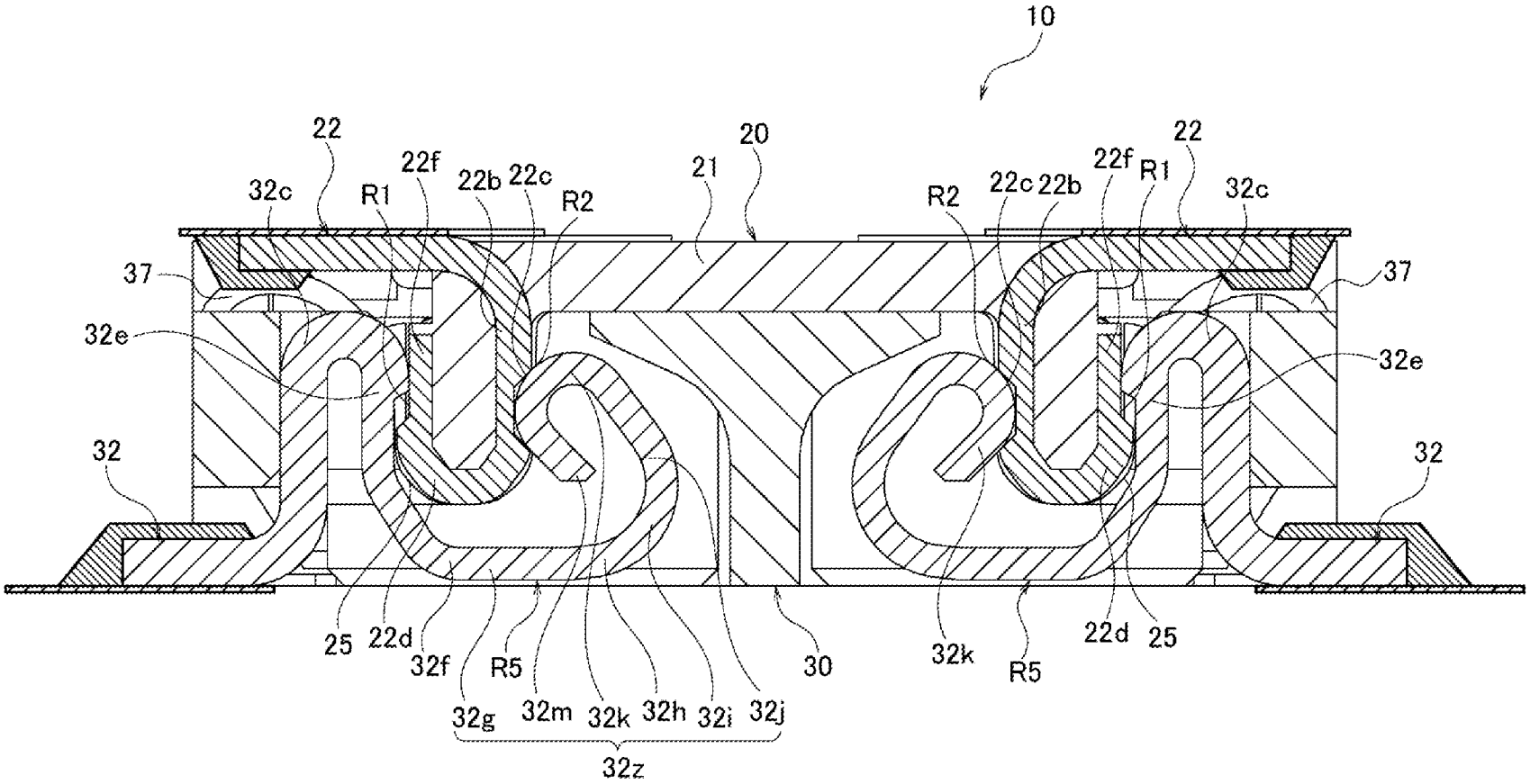
FIG. 59 is a cross-sectional view taken along a site where the header-side signal terminals and the socket-side signal terminals are disposed, showing a state where the header and the socket according to the second exemplary embodiment of the present invention are fitted to each other.

As can be seen from comparison between FIG. 58 and FIG. 59, when header-side signal terminal 22 is fitted into socket-side signal terminal 32, engaged part 22*e* is inserted deeper than engaging part 32*d* as a step part. Accordingly, when header-side signal terminal 22 is pulled out from socket-side signal terminal 32, engaged part 22*e* abuts on engaging part 32*d*. That is, engaged part 22*e* of header-side signal terminal 22 is engaged by engaging part 32*d* of socket-side signal terminal 32. Accordingly, header-side signal terminal 22 is restricted from coming off from socket-side signal terminal 32. That is, header-side signal terminal 22 cannot be pulled out from socket-side signal terminal 32 just by application of external force which is smaller than a predetermined value. On the other hand, header-side signal terminal 22 can be pulled out from socket-side signal terminal 32 by application of external force which is equal to or greater than the predetermined value. That is, engaged part 22*e* of header-side signal terminal 22 and engaging part 32*d* of socket-side signal terminal 32 structure a lock mechanism which is capable of releasing engagement between them by application of external force being equal to or greater than a predetermined value.

Engaged part 22*e* may be formed by rolling of a base material which is performed to partially vary the thickness of header-side signal terminal 22. Alternatively, engaged part 22*e* may be formed by forming to bend the base material of header-side signal terminal 22 in the thickness direction.

Further, header-side signal terminal 22 has outer side part 22*f* that is continuous to tip part 22*d* via engaged part 22*e*, and extends along the outer surface of long side direction wall part 21*e*. In the present exemplary embodiment, projecting wall part 21*g* projecting at the outer circumference of long side direction wall part 21*e* (circumferential wall part 21*b*) positions the tip of outer side part 22*f* of header-side signal terminal 22.

Such header-side signal terminal 22 can be formed by bend-forming a band-like metal member having a predetermined thickness.

Further, in the present exemplary embodiment, header-side signal terminal 22 is disposed in header housing 21 by insert molding. Note that, header-side signal terminal 22 may be disposed in header housing 21 by press-fitting header-side signal terminal 22 into header housing 21.

Figure 46A:
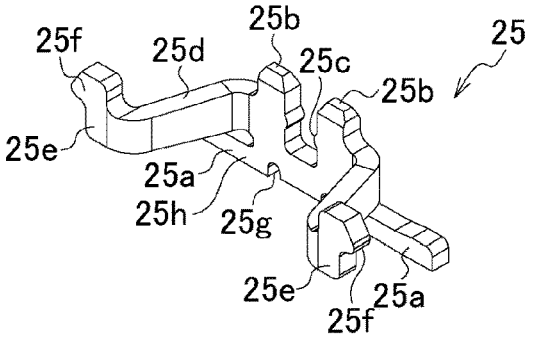
FIG. 46A is a first perspective view of a header-side retainer of the connector according to the second exemplary embodiment of the present invention.
Figure 46B:
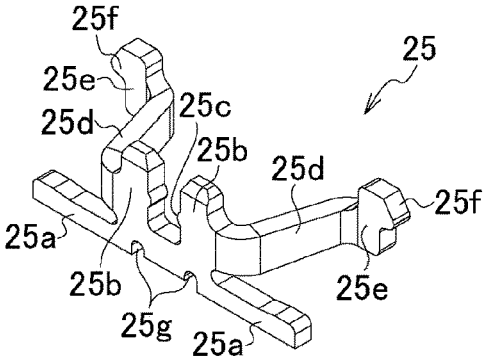
FIG. 46B is a second perspective view of the header-side retainer shown in FIG. 46A.
Figure 46C:
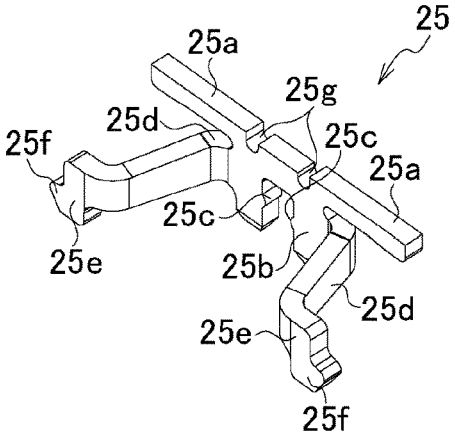
FIG. 46C is a third perspective view of the header-side retainer shown in FIG. 46A.
Figure 46D:
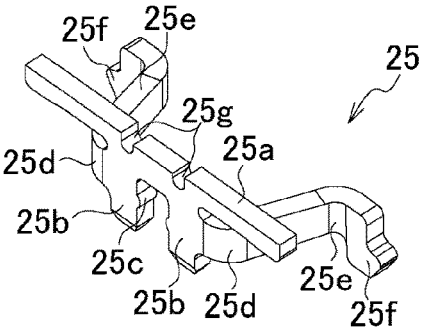
FIG. 46D is a fourth perspective view of the header-side retainer shown in FIG. 46A.
Figure 47:
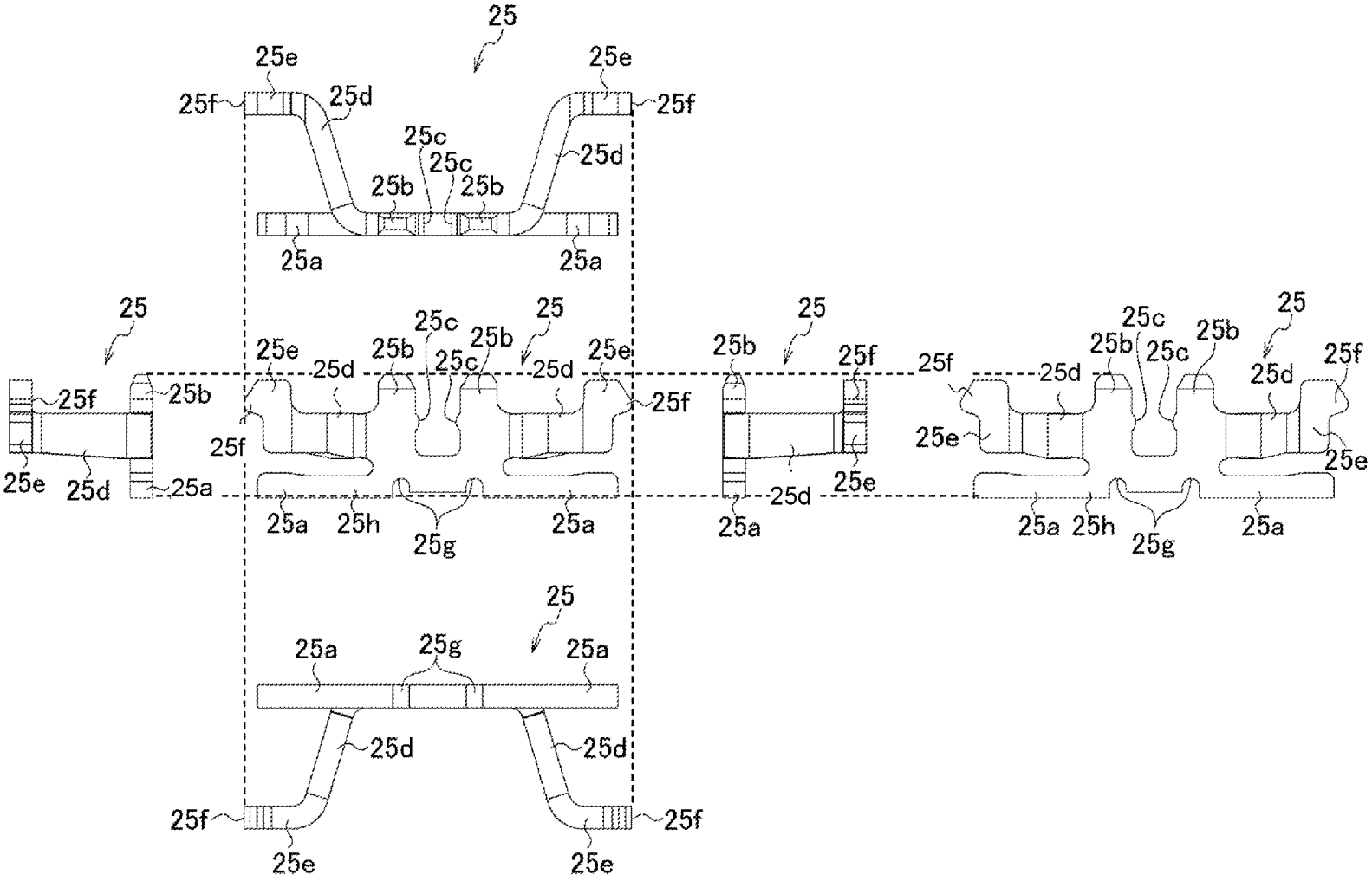
FIG. 47 is a diagram showing the header-side retainer of the connector according to the second exemplary embodiment of the present invention.
Figure 48:
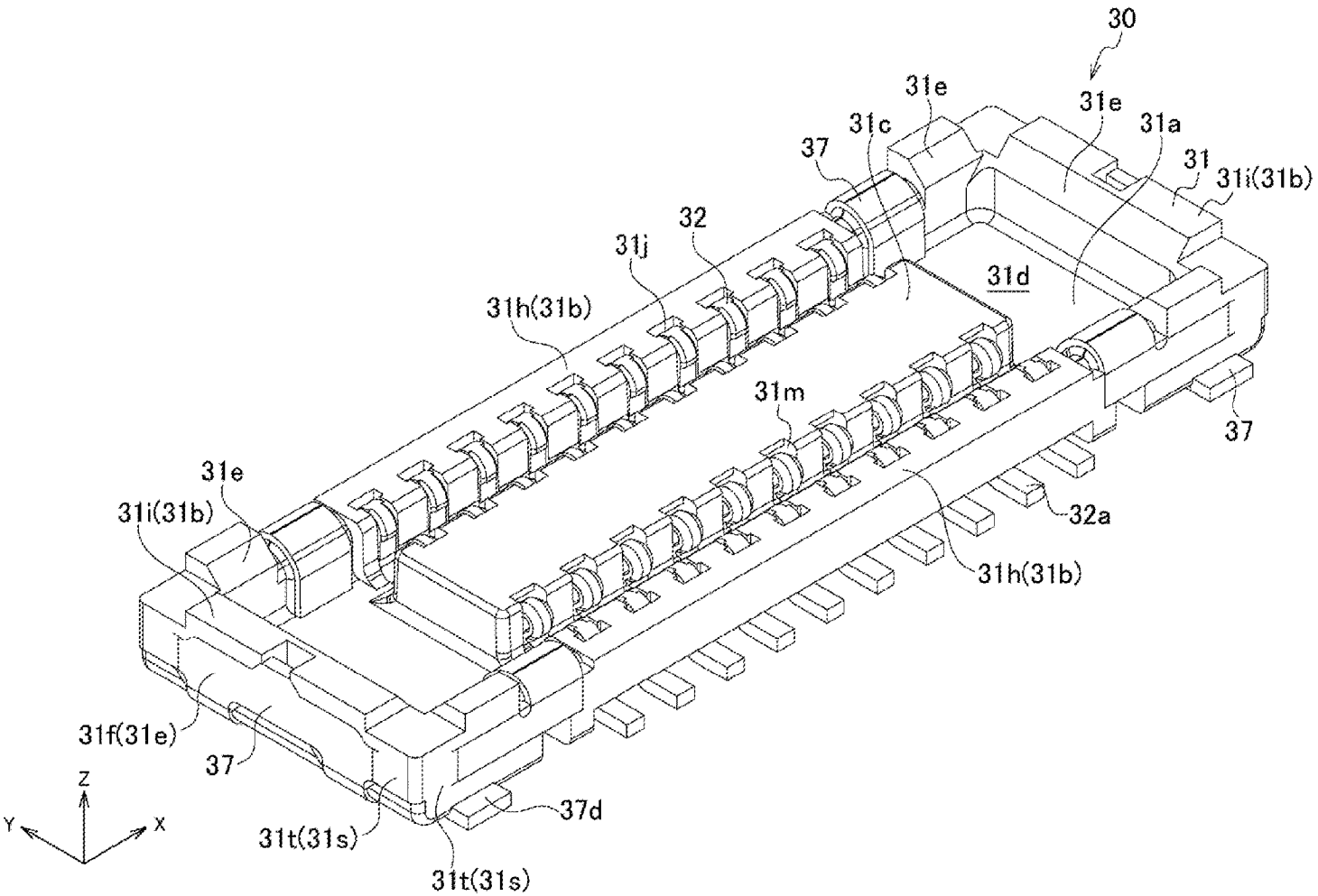
FIG. 48 is a perspective view of a socket of the connector according to the second exemplary embodiment of the present invention as seen from the front surface side.
Figure 49:
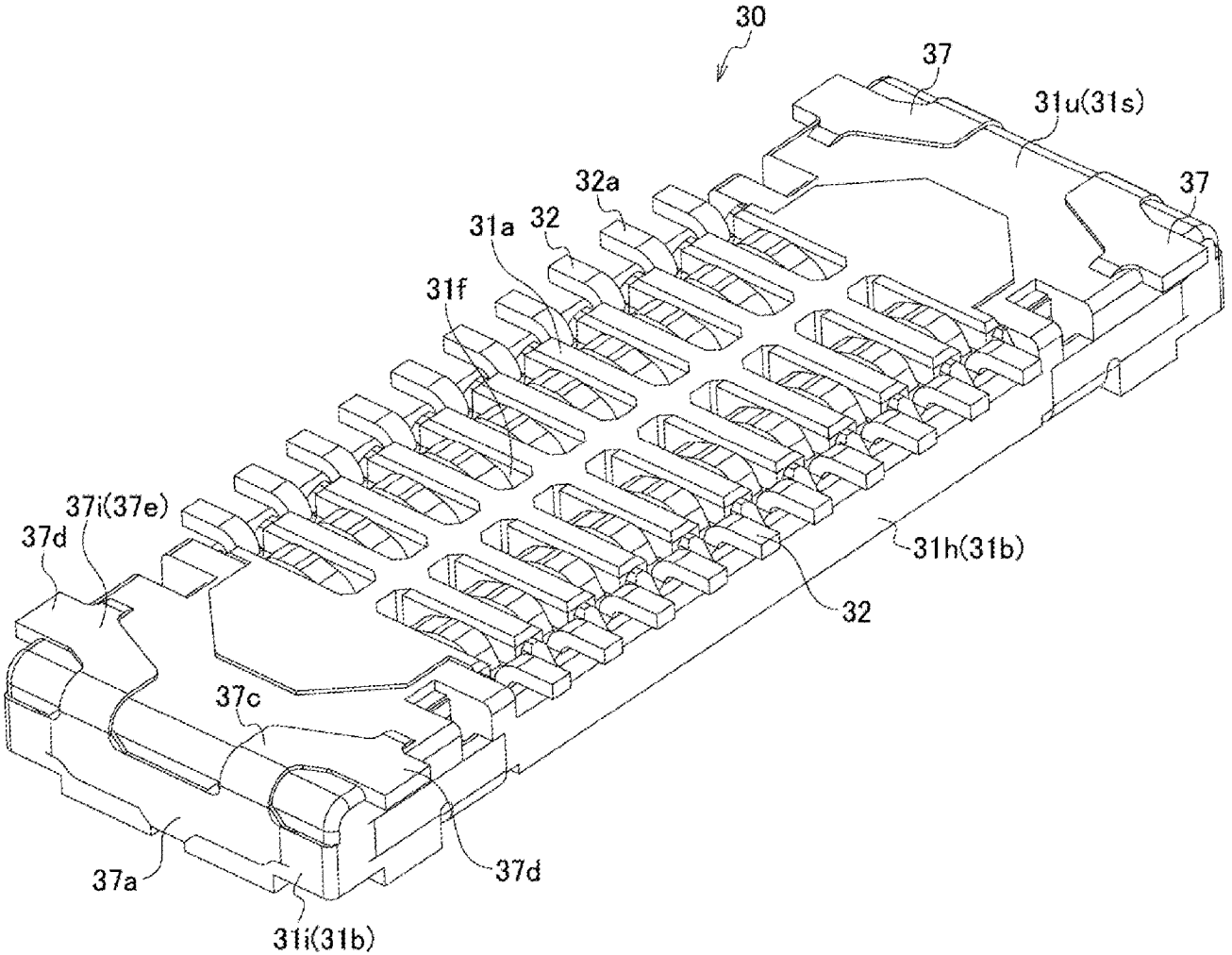
FIG. 49 is a perspective view of the socket of the connector according to the second exemplary embodiment of the present invention as seen from the back surface side.
Figure 50:
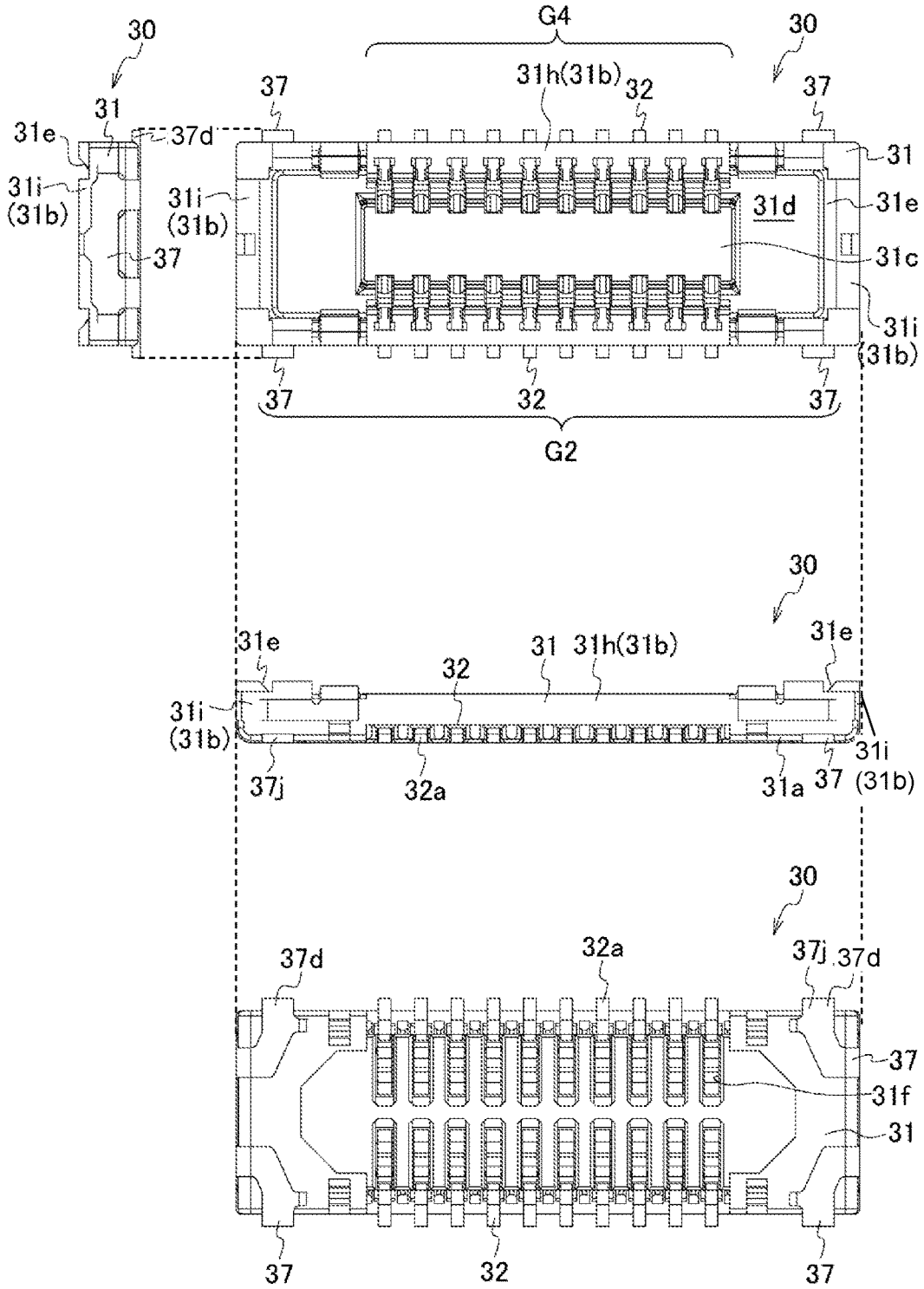
FIG. 50 is a diagram showing the socket of the connector according to the second exemplary embodiment of the present invention.

Next, with reference to FIGS. 46A to 47, a description will be given of the structure of header-side retainer 25.

Header-side retainer 25 is formed by metal molding similarly to header-side signal terminal 22. Header-side retainer 25 can be formed by, for example, bending a retainer plate which is formed by press-molding of a metal plate having a predetermined thickness.

Header-side retainer 25 has a coupling piece part (base part) 25*h* and a pair of projecting piece parts 25*d*, 25*d* that projects from coupling piece part 25*h* to be substantially inverted V-shaped (more specifically, substantially Japanese character "hachi"-shaped). The pair of projecting piece parts 25*d*, 25*d* are provided so as to be capable of elastically deforming in width direction Y with reference to coupling piece part (base part) 25*h*. That is, a pair of projecting piece parts 25*d*, 25*d* are provided to be relatively shiftable in width direction Y of connector 10 relative to coupling piece part (base part) 25*h*.

Then, at each of the opposite ends of coupling piece part (base part) 25*h* in width direction Y, fixed terminal 25*a* that projects from the side surface of header housing 21 is provided. Fixed terminal 25*a* is a site that is fixed to circuit pattern 41 of second circuit board 40 with solder 50. Further, the upper surface of fixed terminal 25*a* also extends substantially in parallel to the upper surface of header housing 21 (the outer surface of plate-like wall part 21*a*).

Further, at the center in width direction Y of coupling piece part 25*h* where fixed terminals 25*a* are provided at the opposite ends in width direction Y, a pair of branching piece parts 25*b*, 25*b* that is bifurcated downward is provided. The branching piece parts 25*b*, 25*b* are respectively provided with step-like projections 25*c*, 25*c* at their facing surfaces.

Still further, in the present exemplary embodiment, at the tips of the pair of projecting piece parts 25*d*, 25*d*, bent pieces 25*e*, 25*e* which are bent outward in width direction Y are formed. The tips of bent pieces 25*e*, 25*e* are contact parts 25*f*, 25*f* that are brought into contact with socket-side retainer 37.

Such header-side retainer 25 is used as being respectively fitted to engaging groove part 21*i* formed at each of opposite ends in long side direction X of header housing 21.

Specifically, in the present exemplary embodiment, engaging groove part 21*i* in which coupling piece part (base part) 25*h* and the pair of projecting piece parts 25*d*, 25*d* are housed is provided at each of the opposite ends in long side direction X of header housing 21.

Further, in header housing 21, branch piece insertion holes 21*j*, 21*j* into which branching piece parts 25*b* are respectively inserted are formed on the opposite sides in width direction Y of central inner wall part 21*k*. Branch piece insertion holes 21*j*, 21*j* are provided so as to penetrate in top-bottom direction Z, and communicate with engaging groove part 21*i*.

Accordingly, by inserting branching piece parts 25*b*, 25*b* respectively into branch piece insertion holes 21*j*, 21*j* from engaging groove part 21*i* side and swaging central inner wall part 21*k* with projections 25*c*, 25*c*, central inner wall part 21*k* is clamped by the pair of branching piece parts 25*b*, 25*b*, and the pair of projecting piece parts 25*d*, 25*d* are housed in engaging groove part 21*i*.

Thus, header-side retainer 25 is fitted to engaging groove part 21*i*.

Further, at the center in width direction Y of coupling piece part 25*h*, recessed parts 25*g* that open upward are formed. Recessed parts 25*g* can house excessive solder when fixed terminals 25*a* are soldered to second circuit board 40. As a result, the solder for mounting is restricted from raising header 20 from second circuit board 40.

Note that, in the present exemplary embodiment, while header-side retainer 25 is disposed in header housing 21 by press-fitting header-side retainer 25 into header housing 21, header-side retainer 25 may be disposed in header housing 21 by insert molding.

Next, with reference to FIGS. 48 to 57, a description will be given of the structure of socket 30 used in connector 10.

As described above, socket 30 has socket housing 31. In the present exemplary embodiment, socket housing 31 is molded with insulating synthetic resin to be quadrangular (rectangular) as a whole in a plan view (see FIGS. 48 to 53).

In socket housing 31, metal-made socket-side signal terminals 32 and metal-made socket-side retainers 37 are disposed. Socket-side signal terminals 32 are electrically connected to a signal line for transmitting signals. On the other hand, as described above socket-side retainers 37 serve also as socket-side power supply terminals, and are electrically connected to a power supply line for supplying power while enhancing the strength of socket housing 31.

In the present exemplary embodiment, a plurality of socket-side signal terminals 32 are juxtaposed to each other at predetermined intervals along one long side of socket housing 31. The plurality of socket-side signal terminals 32 juxtaposed to each other on one side in width direction (short side direction) Y of socket housing 31 form socket-side signal terminal group G4.

Further, in the present exemplary embodiment, two socket-side retainers (socket-side power supply terminals) 37 are juxtaposed to one socket-side signal terminal group G4 while being spaced apart therefrom, along one long side of socket housing 31. One socket-side signal terminal group G4 and two socket-side retainers (socket-side power supply terminals) 37 juxtaposed to each other on one side in width direction (short side direction) Y of socket housing 31 form socket-side terminal group G2.

Still further, a plurality of socket-side signal terminals 32 are juxtaposed to each other at predetermined intervals also along the other long side of socket housing 31. The plurality of socket-side signal terminals 32 juxtaposed to each other on the other side in width direction (short side direction) Y of socket housing 31 form socket-side signal terminal group G4.

Still further, two socket-side retainers (socket-side power supply terminals) 37 are juxtaposed to one socket-side signal terminal group G4 while being spaced apart therefrom, along the other long side of socket housing 31. One socket-side signal terminal group G4 and two socket-side retainers (socket-side power supply terminals) 37 juxtaposed to each other on the other side in width direction (short side direction) Y of socket housing 31 form socket-side terminal group G2.

In this manner, in the present exemplary embodiment, in socket housing 31, two lines (a plurality of lines) of socket-side terminal groups G2 are disposed, each of socket-side terminal group G2 being formed by socket-side signal terminal group G4 and socket-side retainers (socket-side power supply terminals) 37 disposed along long side direction X of socket housing 31.

Further, in socket-side terminal group G2 of one line, socket-side retainers (socket-side power supply terminals) 37 are respectively disposed at the opposite ends of socket-side signal terminal group G4. In other words, socket-side retainers (socket-side power supply terminals) 37 are disposed at opposite ends in long side direction X of socket housing 31, and socket-side signal terminal group G4 is disposed between socket-side retainers (socket-side power supply terminals) 37. In this manner, in the present exemplary embodiment, socket-side retainers (socket-side power supply terminals) 37 are disposed on the outer side in long side direction X of socket housing 31 relative to socket-side signal terminal group G4 (socket-side signal terminals 32).

Note that, socket-side signal terminals 32 and socket-side retainers (socket-side power supply terminals) 37 are disposed in socket housing 31 so as to be brought into contact with corresponding header-side signal terminals 22 and header-side retainers (header-side power supply terminals) 25 when header 20 and socket 30 are fitted to each other.

Next, with reference to FIGS. 51 to 53, a description will be given of the structure of socket housing 31.

Figure 51:
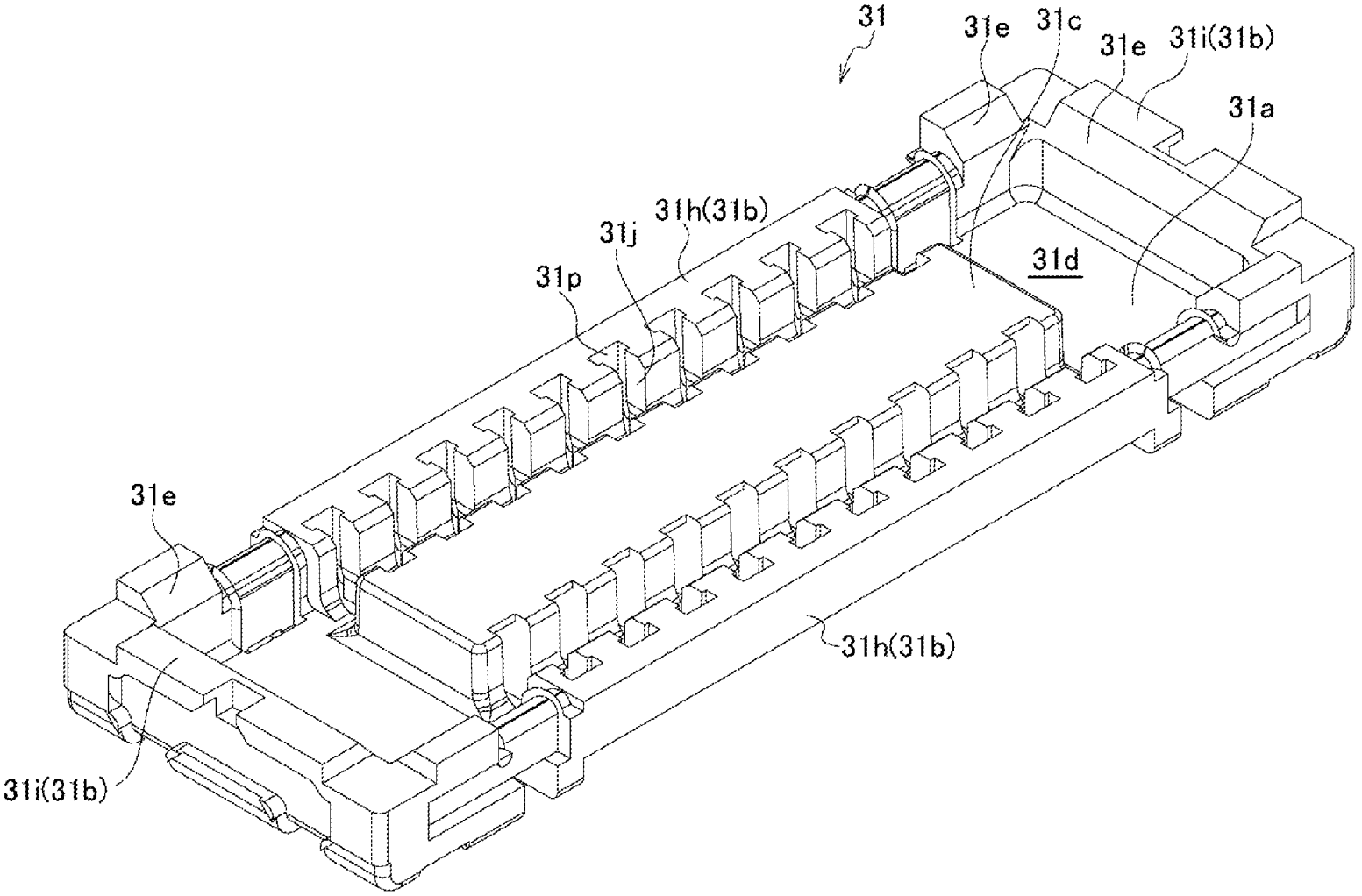
FIG. 51 is a perspective view of a socket housing of the connector according to the second exemplary embodiment of the present invention as seen from the front surface side.

Socket housing 31 is formed to be substantially box-like with plate-like wall part 31*a* and circumferential wall part 31*b* formed continuously in a substantial rectangular annular shape along the circumference of plate-like wall part 31*a*, so as to open on one side (the top side in FIG. 51). Further, in the present exemplary embodiment, substantially quadrangular island part 31*c* is formed at the center of plate-like wall part 31*a*, with a predetermined distance from circumferential wall part 31*b*. Between circumferential wall part 31*b* and island part 31*c*, substantially frame-like fitting groove part 31*d* is formed for circumferential wall part 21*b* of header 20 to be fitted into. Note that, island part 31*c* fits into recessed part 21*c*.

Further, since short side direction wall parts 21*f* and long side direction wall parts 21*e* fit into fitting groove part 31*d*, fitting groove part 31*d* is formed so that its width is slightly greater at the opposite ends in long side direction X.

Still further, in the present exemplary embodiment, at the upper end on the inner circumferential side of circumferential wall part 31*d*, tapered parts 31*e* that are inclined to become lower (position toward plate-like wall part 31*a*) as they are positioned inward are formed. Tapered parts 31*e* are formed at the opposite ends in the long side direction of long side direction wall part 31*h* of circumferential wall part 31*b* and short side direction wall parts 31*i* of circumferential wall part 31*b*.

Further, tapered parts 31*e* are formed also at circumferential wall part 31*b*between adjacent socket-side signal terminals 32 and between socket-side signal terminal group G4 and socket-side retainer (socket-side power supply terminal) 37. In this manner, tapered parts 31*e* are formed over substantially the entire circumference of circumferential wall part 31*b* in the present exemplary embodiment.

Figure 52:
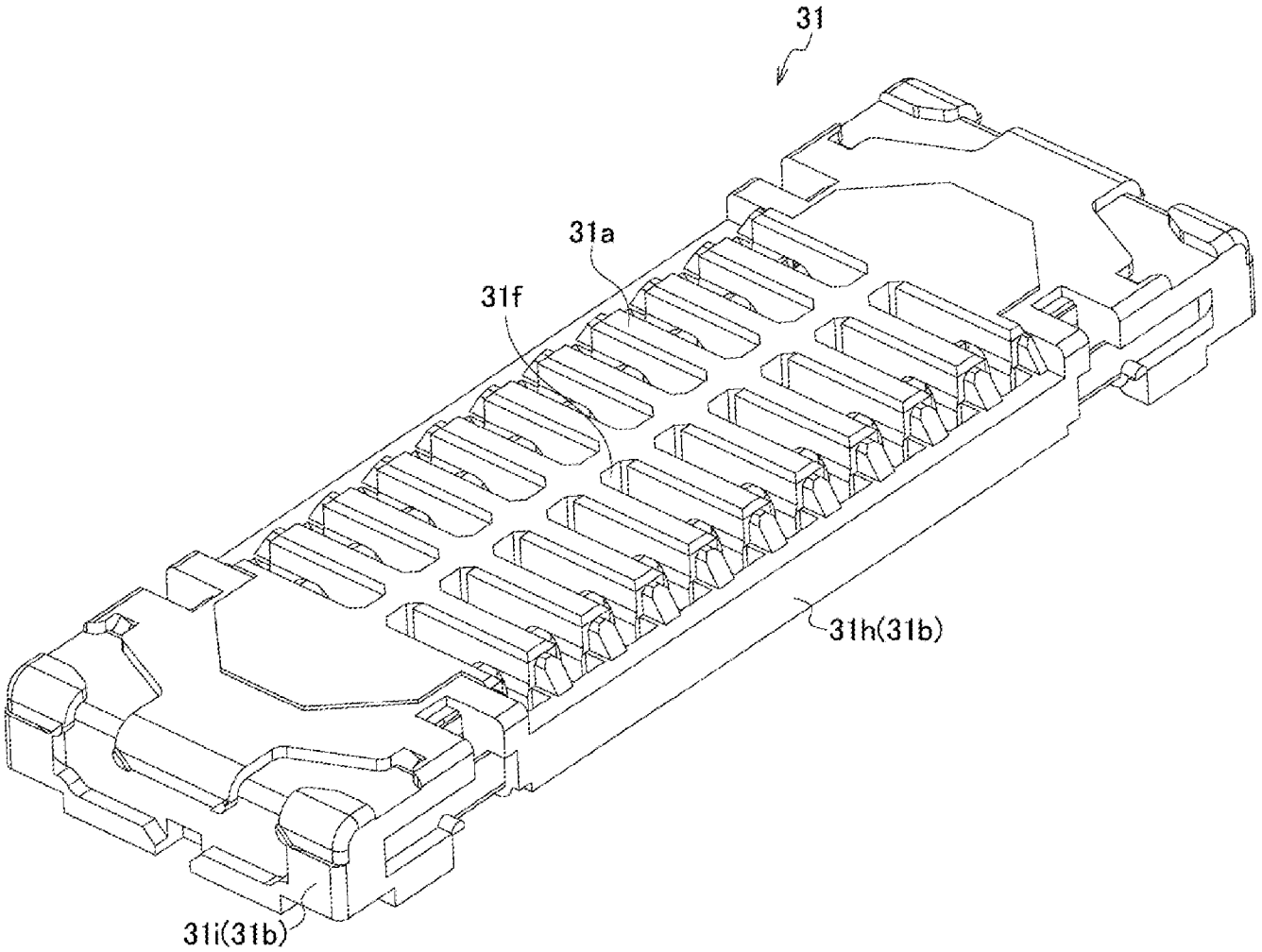
FIG. 52 is a perspective view of the socket housing of the connector according to the second exemplary embodiment of the present invention as seen from the back surface side.
Figure 53:
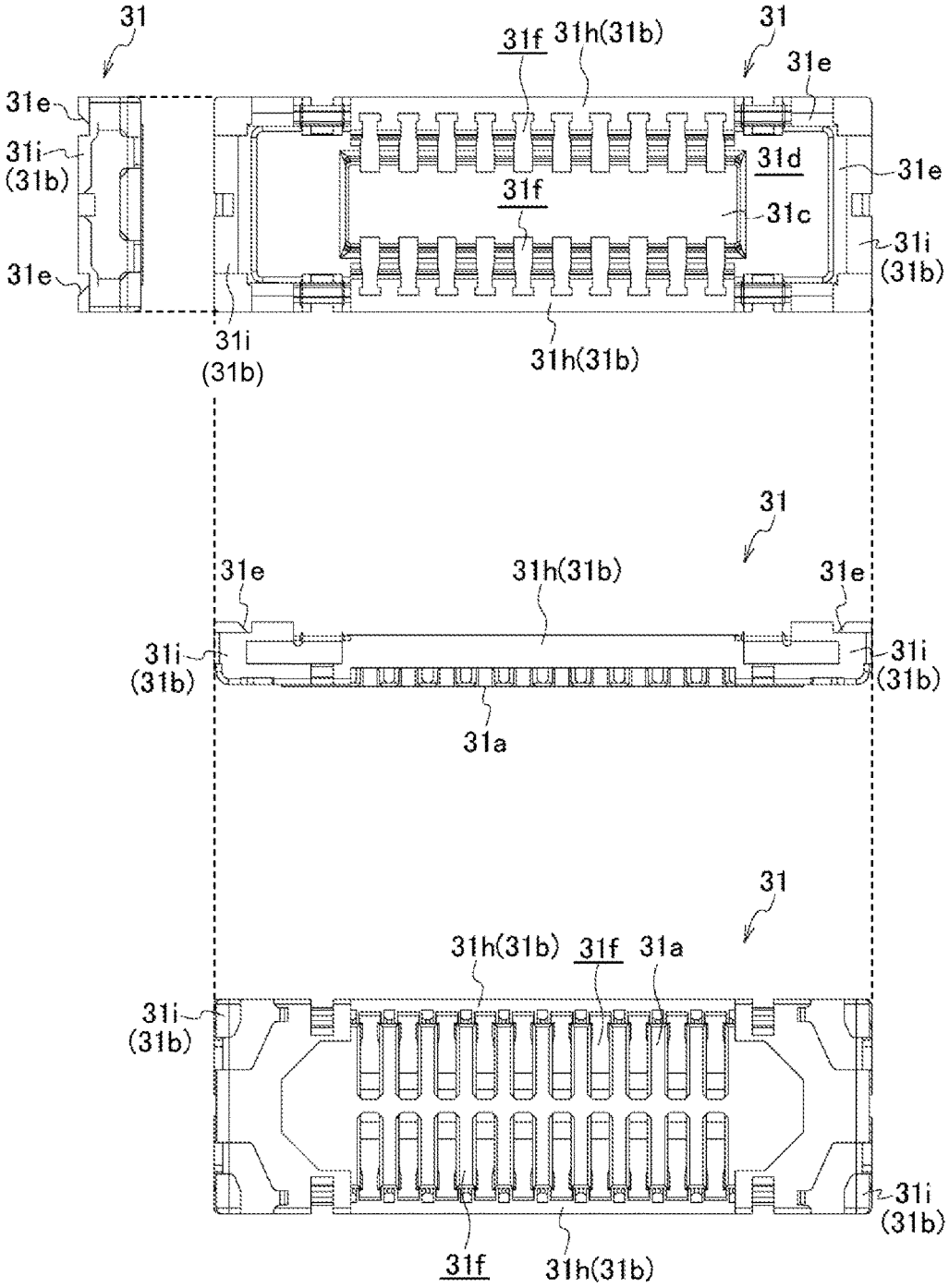
FIG. 53 is a diagram showing the socket housing of the connector according to the second exemplary embodiment of the present invention.

Further, in the present exemplary embodiment, in socket housing 31, socket-side signal terminal housing parts 31*f* that respectively house socket-side signal terminals 32 are formed so as to penetrate through plate-like wall part 31*a* (see FIGS. 51 to 53).

Each socket-side signal terminal housing part 31*f* is formed by forming socket-side signal terminal housing recessed part 31*j* at long side direction wall part 31*h* so as to communicate with fitting groove part 31*d*, and forming socket-side signal terminal housing recessed part 31*m* at island part 31*c* so as to communicate with fitting groove part 31*d*.

The plurality of socket-side signal terminals 32 are respectively press-fitted into socket-side signal terminal housing parts 31*f* from the back surface side of socket housing 31.

Figure 54A:
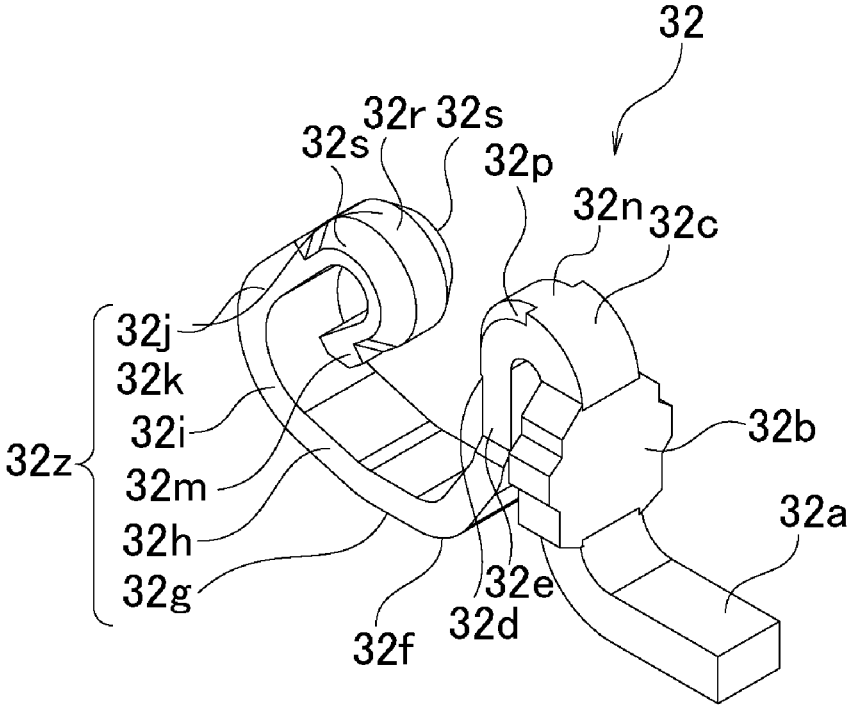
FIG. 54A is a first perspective view of a socket-side signal terminal of the connector according to the second exemplary embodiment of the present invention.
Figure 54B:
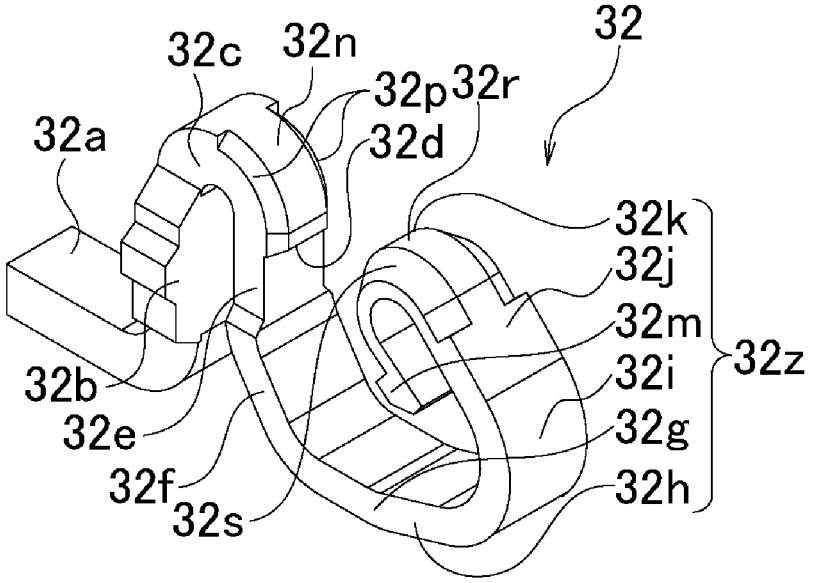
FIG. 54B is a second perspective view of the socket-side signal terminal shown in FIG. 54A.
Figure 54C:
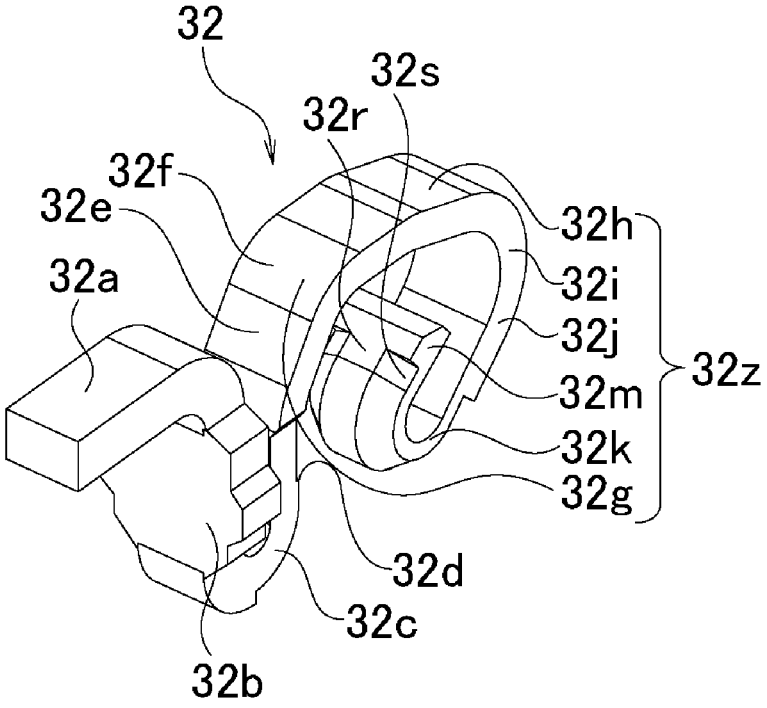
FIG. 54C is a third perspective view of the socket-side signal terminal shown in FIG. 54A.
Figure 54D:
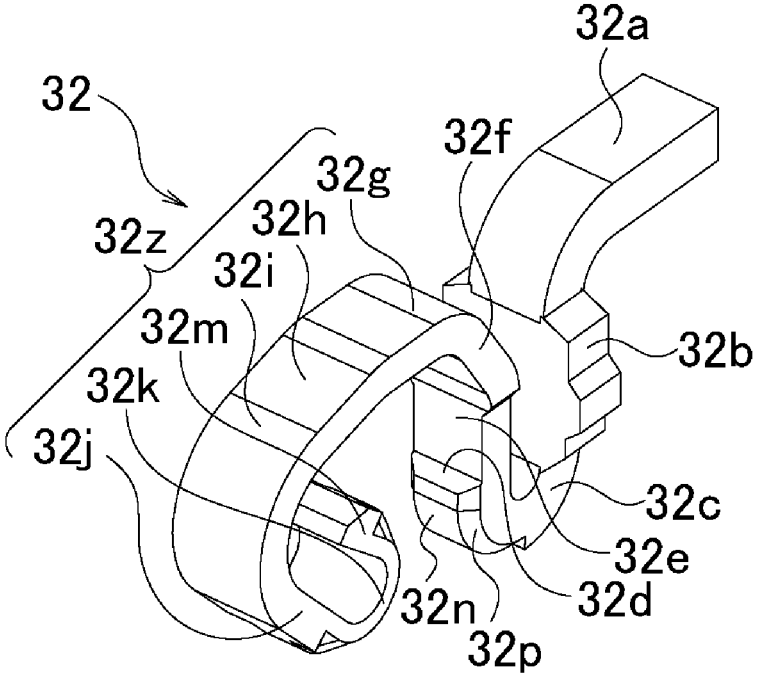
FIG. 54D is a fourth perspective view of the socket-side signal terminal shown in FIG. 54A.
Figure 55:
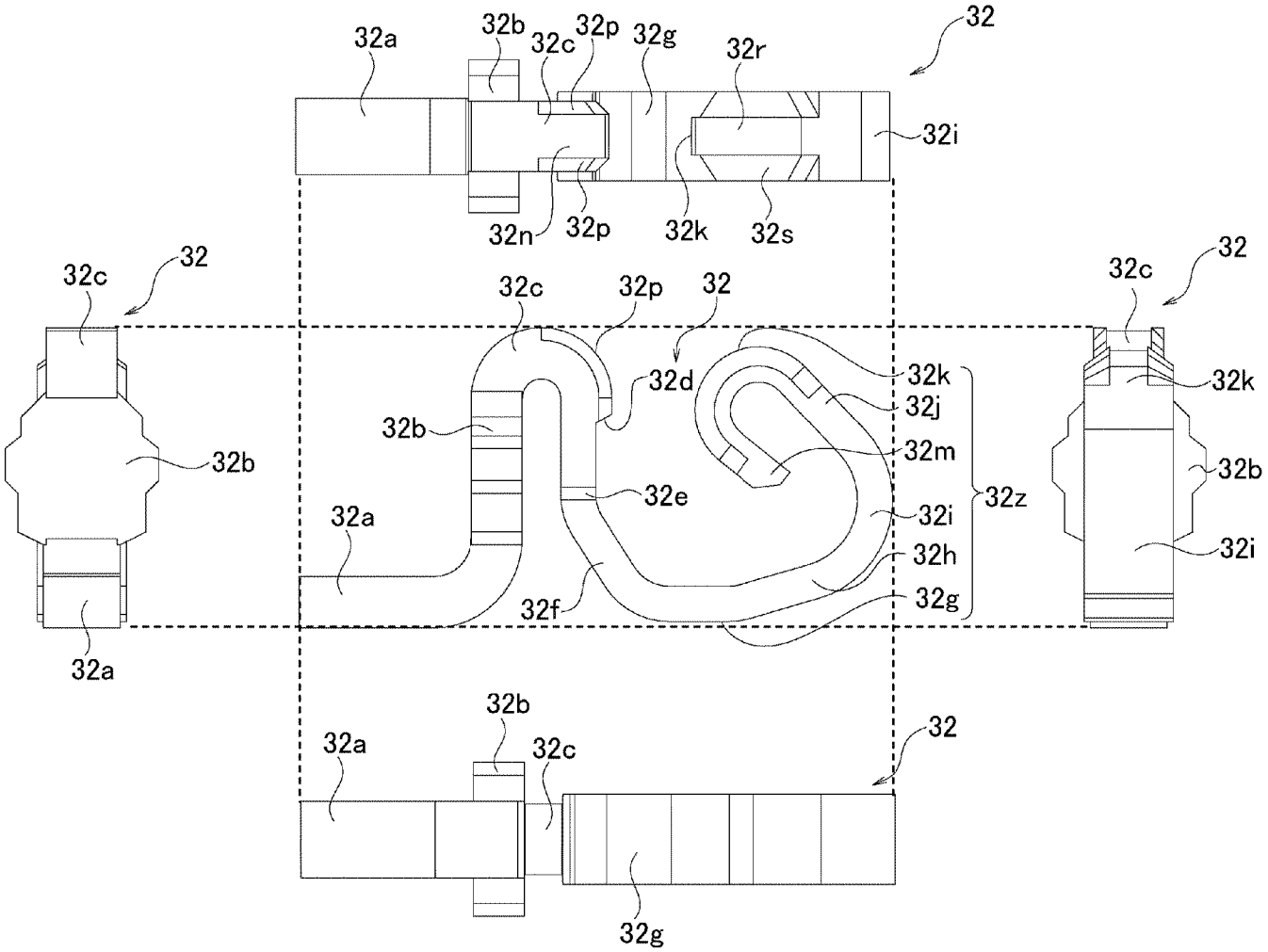
FIG. 55 is a diagram showing the socket-side signal terminal of the connector according to the second exemplary embodiment of the present invention.

Next, with reference to FIGS. 54A to 55, a description will be given of the structure of each socket-side signal terminal 32.

Socket-side signal terminal 32 is fabricated by metal molding, and is an electrically conductive element. Socket-side signal terminal 32 has root part 32*a* that projects from the side surface of socket housing 31. Root part 32*a* is a site that is fixed to circuit pattern 61 of first circuit board 60 with solder 70. Further, the lower surface of root part 32*a* extends along main surface M of first circuit board 60, and is positioned in a plane identical to the bottom surface of socket housing 31 (the back surface of plate-like wall part 31*a*).

Socket-side signal terminal 32 has rising part 32*b* that rises from root part 32*a* and extends away from first circuit board 60. Rising part 32*b* bends from root part 32*a* and enters inside socket-side signal terminal housing recessed part 31*j*, and extends along the inner surface of long side direction wall part 31*h*.

Socket-side signal terminal 32 has inverted U-shaped part 32*c* whose one end is continuous to the upper end of rising part 32*b*. Inverted U-shaped part 32*c* has a shape in which the letter U is inverted upside down. Note that, inverted U-shaped part 32*c* has tip surface 32*n* and inclined surfaces 32*p* respectively provided continuously on the opposite sides in long side direction X of tip surface 32*n*, and formed to be a projection being substantially trapezoidal in a horizontal cross-sectional view.

Socket-side signal terminal 32 has engaging part 32*d* that is continuous to the other end of inverted U-shaped part 32*c*. In the present exemplary embodiment, engaging part 32*d* is formed from one end to the other end in long side direction X of socket housing 31 in socket-side signal terminal 32. That is, step-like engaging part 32*d* is formed over the entire width direction of socket-side signal terminal 32.

As described above, engaging part 32*d* functions as a part that restricts engaged part 22*e* from shifting, when header-side signal terminal 22 is pulled out from socket-side signal terminal 32. That is, engaging part 32*d* of socket-side signal terminal 32 abuts on engaged part 22*e* of header-side signal terminal 22 thereby engaging with engaged part 22*e*. Engaging part 32*d* of socket-side signal terminal 32 and engaged part 22*e* of header-side signal terminal 22 structure a lock mechanism which is capable of releasing engagement between them by application of external force being equal to or greater than a predetermined value.

Engaging part 32*d* may be formed by rolling of a base material which is performed to partially vary the thickness of socket-side signal terminal 32. Alternatively, engaging part 32*d* may be formed by forming to bend the base material of socket-side signal terminal 32 in the thickness direction.

Further, socket-side signal terminal 32 has falling part 32*e* that is continuous to engaging part 32*d* and extends substantially in parallel to rising part 32*b*.

Socket-side signal terminal 32 has first arc-shaped part 32*f* that is continuous to the lower end of falling part 32*e*.

As shown in FIGS. 58 and 59, socket-side signal terminal 32 has facing part 32*z* that is continuous to first arc-shaped part 32*f*. Facing part 32*z* includes flat part 32*g*, first slanting part 32*h*, second arc-shaped part 32*i*, second slanting part 32*j*, arc-shaped projecting part 32*k*, and tip part 32*m* which will be described in the following. Facing part 32*z* is specifically structured as follows.

Facing part 32*z* has flat part 32*g* that is continuous to the lower end of arc-shaped part 32*f*. As shown in FIG. 58, flat part 32*g* extends, away from falling part 32*e*, along main surface M of first circuit board 60. Note that, flat part 32*g* is not necessarily in parallel to main surface M. Flat part 32*g* is provided for increasing the spring length of a spring part, which will be described later.

As shown in FIG. 58, facing part 32*z* has first slanting part 32*h* that is continuous to flat part 32*g* and extends in a slanting direction relative to main surface M of first circuit board 60. First slanting part 32*h* extends to be more distanced from falling part 32*e* as it becomes distanced from first circuit board 60. First slanting part 32*h* is continuous to second arc-shaped part 32*i*. Second arc-shaped part 32*i* is a curved part that projects away from falling part 32*e*. Second arc-shaped part 32*i* is continuous to second slanting part 32*j* extending in a slanting direction relative to main surface M of first circuit board 60. Second slanting part 32*j* extends to be nearer to falling part 32*e* as it is distanced from first circuit board 60. Accordingly, second slanting part 32*j* is positioned above first slanting part 32*h*.

As shown in FIG. 58, facing part 32*z* has arc-shaped projecting part 32*k* whose one end is continuous to the upper end of second slanting part 32*j*. Arc-shaped projecting part 32*k* has tip surface 32*r* and inclined surfaces 32*s* respectively provided continuously on the opposite sides in long side direction X of tip surface 32*r*, and formed to be a projection being substantially trapezoidal in a horizontal cross-sectional view.

As shown in FIG. 58, arc-shaped projecting part 32*k* fits into recessed part 22*c* of header-side signal terminal 22. The other end of arc-shaped projecting part 32*k* is continuous to tip part 32*m*. Tip part 32*m* extends substantially in parallel to second slanting part 32*j*. As can be seen from FIGS. 58 and 59, facing part 32*z* (32*g*, 32*h*, 32*i*, 32*j*, 32*k*, 32*m*) is continuous to the lower end of arc-shaped part 32*f*, and opposite to falling part 32*e* as a whole.

In the present exemplary embodiment, as shown in FIG. 59, when header 20 and socket 30 fit to each other, header-side signal terminal 22 is inserted between inverted U-shaped part 32*c* and arc-shaped projecting part 32*k*. Here, falling part 32*e*, arc-shaped part 32*f*, flat part 32*g*, first slanting part 32*h*, arc-shaped part 32*i*, second slanting part 32*j*, arc-shaped projecting part 32*k*, and tip part 32*m* integrally function as a spring part. The spring part (32*e*, 32*f*, 32*g*, 32*h*, 32*i*, 32*j*, 32*k*, 32*m*) elastically deforms when the protruding part of header-side signal terminal 22 is inserted into the recessed part of socket-side signal terminal 32. This increases the distance from the two parts, namely, falling part 32*e* and inverted U-shaped part 32*c*, to arc-shaped projecting part 32*k*. Here, engaged part 22*e* of header-side signal terminal 22 is inserted into a position lower than engaging part 32*d* of socket-side signal terminal 32. Thus, arc-shaped projecting part 32*k* of socket-side signal terminal 32 fits into recessed part 22*c* of header-side signal terminal 22.

In the state where header-side signal terminal 22 fits to socket-side signal terminal 32, resilience occurs at the spring part that is elastically deforming. With the resilience, arc-shaped projecting part 32*k* presses header-side signal terminal 22 against each of falling part 32*e* and inverted U-shaped part 32*c*. Thus, header-side signal terminal 22 is clamped by socket-side signal terminal 32. Here, header-side signal terminal 22 is brought into contact with each of inverted U-shaped part 32*c*, falling part 32*e*, and arc-shaped projecting part 32*k* of socket-side signal terminal 32.

Specifically, as shown in FIGS. 58 and 59, tip part 22*d* of header-side signal terminal 22 is brought into contact with falling part 32*e* of socket-side signal terminal 32. That is, contact part R1 of socket-side signal terminal 32 and contact part R1 of header-side signal terminal 22 are brought into contact with each other.

Further, recessed part 22*c* of header-side signal terminal 22 is brought into contact with arc-shaped projecting part 32*k* of socket-side signal terminal 32. That is, contact part R2 of socket-side signal terminal 32 and contact part R2 of header-side signal terminal 22 are brought into contact with each other.

In this manner, header-side signal terminal 22 and socket-side signal terminal 32 are brought into contact with each other at a plurality of contacts spaced apart from each other in width direction Y (at contact part R1 and contact part R2). Accordingly, electrical connection between header-side signal terminal 22 and socket-side signal terminal 32 is highly reliable.

Further, in the present exemplary embodiment, recessed part 22*c* is formed at contact part R2 of header-side signal terminal 22, which is one of contact part R2 of socket-side signal terminal 32 and contact part R2 of header-side signal terminal 22 being brought into contact with each other. Then, contact part R2 of socket-side signal terminal 32 which is other one of contact parts is brought into contact at opposite ends in long side direction X of socket housing 31 in recessed part 22*c*.

Specifically, when arc-shaped projecting part 32*k* of socket-side signal terminal 32 fits into recessed part 22*c*, the boundary portions between tip surface 32*r* of arc-shaped projecting part 32*k* and inclined surfaces 32*s* are respectively in contact with inclined surfaces 22*h*. In this manner, in the present exemplary embodiment, contact part R2 of socket-side signal terminal 32 is brought into contact with contact part R2 of header-side signal terminal 22 at two points (contact C1 and contact C2).

Note that, elastic deformation of the spring part may bring the boundary part between flat part 32*g* and first slanting part 32*h* into contact with first circuit board 60 at contact part R5, in addition to contact part R1 and contact part R2.

In this manner, header-side signal terminal 22 and socket-side signal terminal 32 according to the present exemplary embodiment are in contact with each other at a plurality of contacts spaced apart from each other in width direction Y. However, the header-side signal terminal and the socket-side signal terminal of the present invention may be in contact with each other just at a single contact, for example, between the inner side surface of the header-side signal terminal and the facing part of the socket-side signal terminal.

Note that, the spring part (32*e*, 32*f*, 32*g*, 32*h*, 32*i*, 32*j*, 32*k*, 32*m*) is structured by a U-shaped part (32*e*, 32*f*, 32*g*, 32*h*, 32*i*, 32*j*) and a free end part (32*k*, 32*m*) provided continuously on one end (on 32*j* side) of the U-shaped part (32*e*, 32*f*, 32*g*, 32*h*, 32*i*, 32*j*). At arc-shaped projecting part 32*k* of the free end part (32*k*, 32*m*), contact part R2 of socket-side signal terminal 32 is provided.

In this manner, socket-side signal terminal 32 has the U-shaped part (32*e*, 32*f*, 32*g*, 32*h*, 32*i*, 32*j*), and at one end (on 32*j* side) of the U-shaped part (32*e*, 32*f*, 32*g*, 32*h*, 32*i*, 32*j*), the free end part (32*k*, 32*m*) where contact part R2 is provided is continuously provided.

Such socket-side signal terminal 32 can be formed by bend-forming a band-like metal member having a predetermined thickness.

Further, socket-side signal terminal 32 is mounted on socket housing 31 by being inserted (press-fitted) into socket-side signal terminal housing part 31*f* from the back surface side of socket housing 31 (from the bottom side in FIG. 15) during assembly of socket 30.

Note that, socket-side signal terminal 32 may be mounted on socket housing 31 by insert-molding socket-side signal terminal 32 into socket housing 31.

Figure 56A:
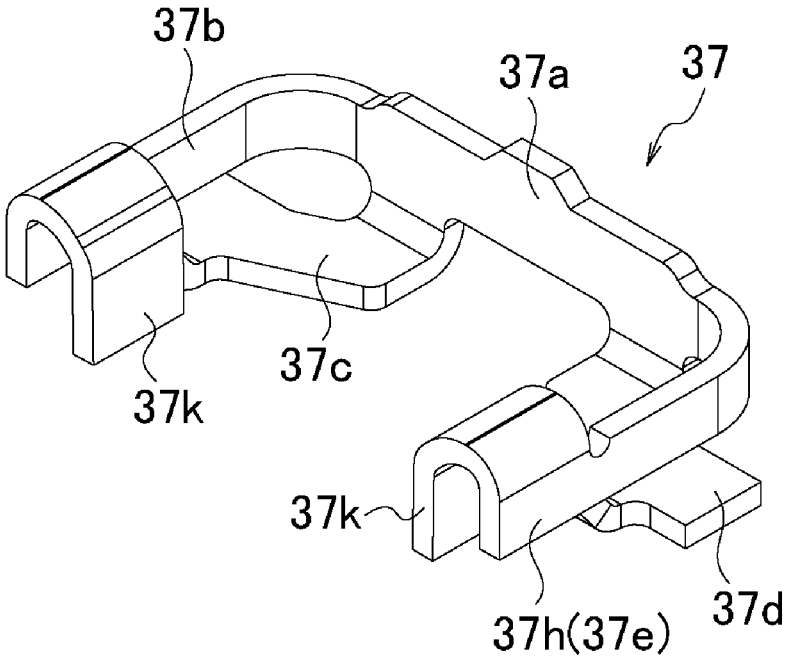
FIG. 56A is a first perspective view of a socket-side retainer of the connector according to the second exemplary embodiment of the present invention.
Figure 56B:
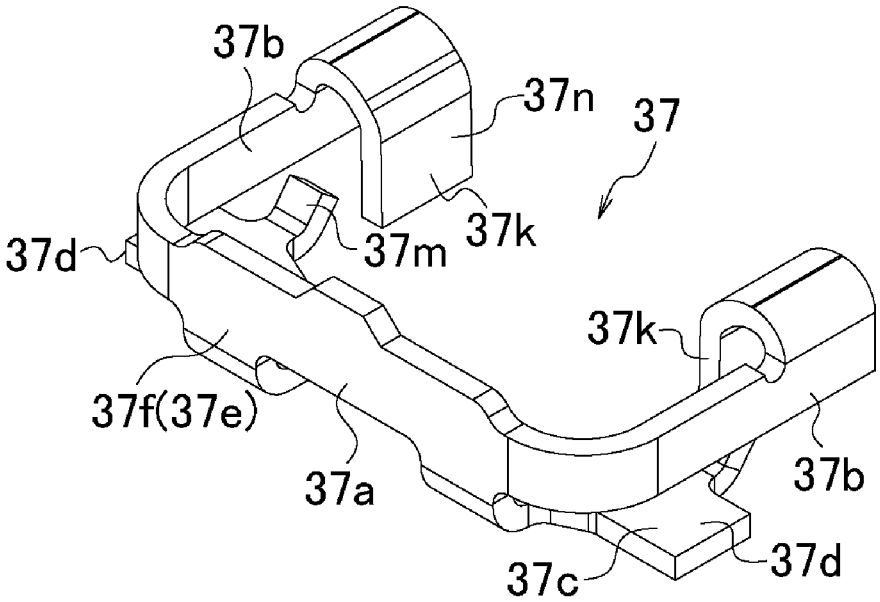
FIG. 56B is a second perspective view of the socket-side retainer shown in FIG. 56A.
Figure 56C:
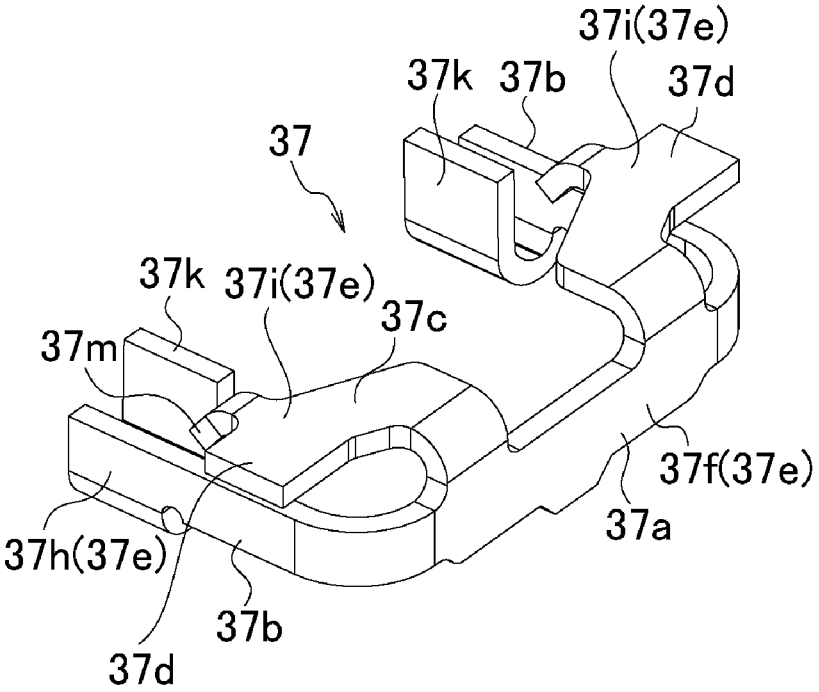
FIG. 56C is a third perspective view of the socket-side retainer shown in FIG. 56A.
Figure 56D:
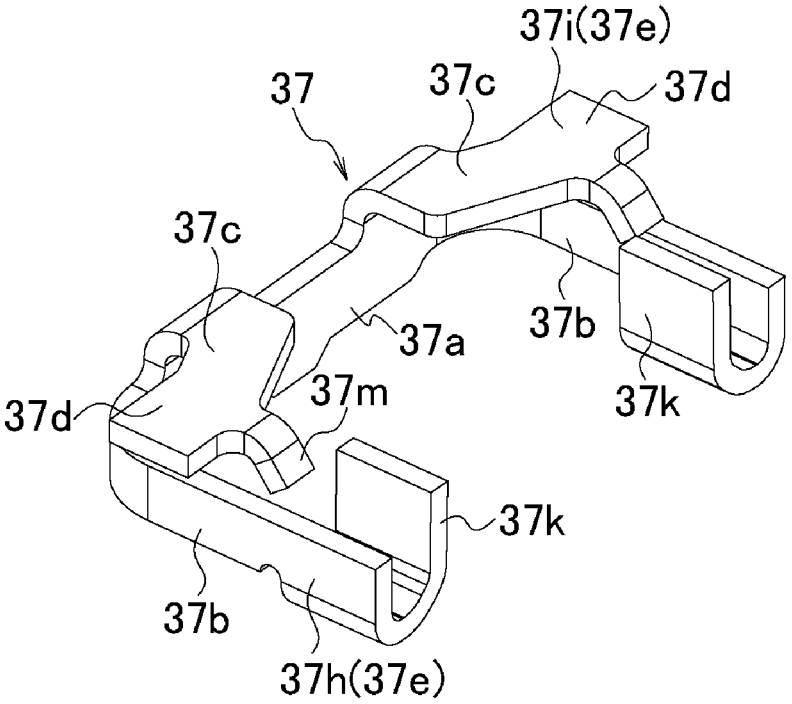
FIG. 56D is a fourth perspective view of the socket-side retainer shown in FIG. 56A.
Figure 57:
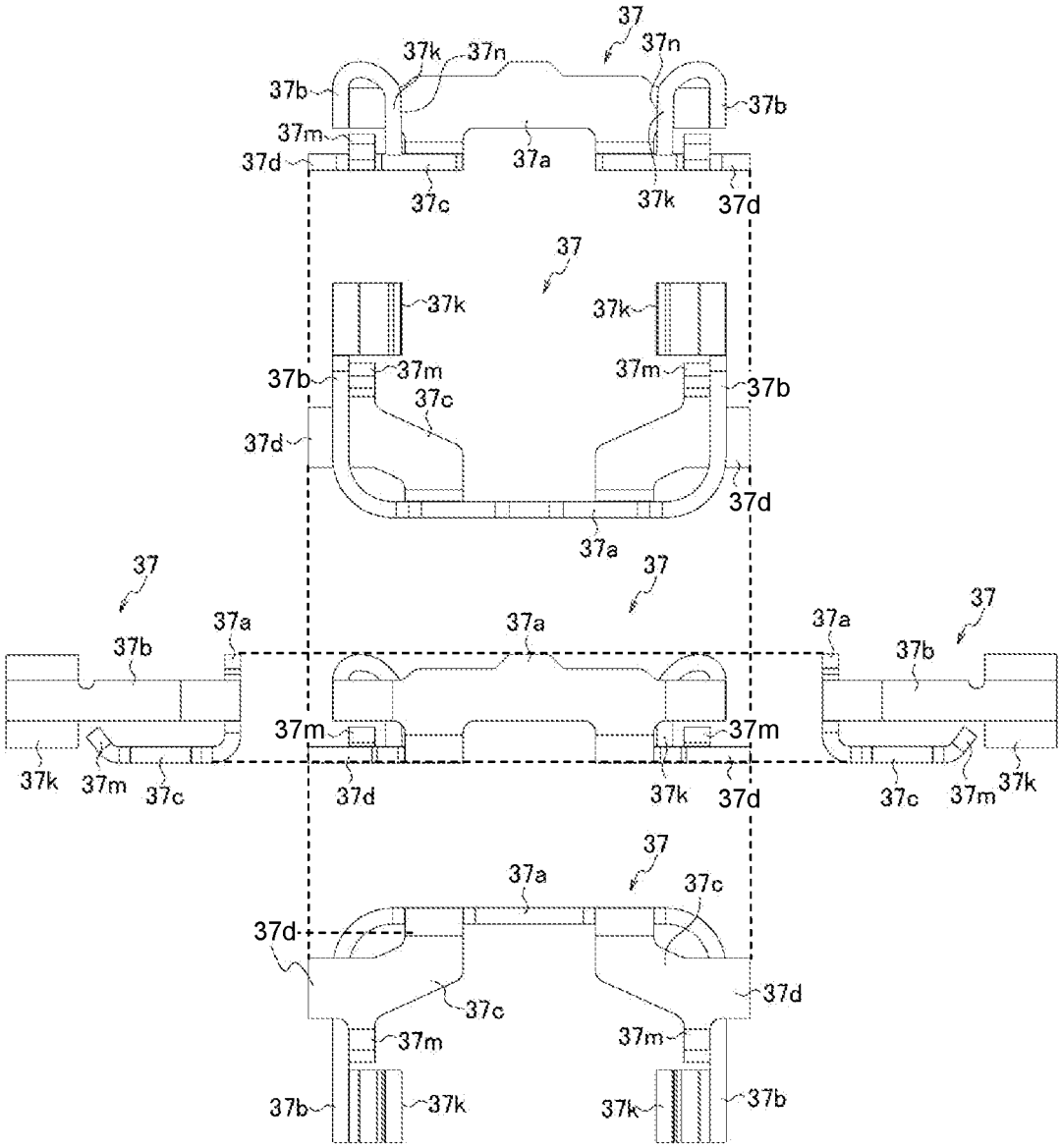
FIG. 57 is a diagram showing the socket-side retainer of the connector according to the second exemplary embodiment of the present invention.

Next, with reference to FIGS. 56A to 57, a description will be given of the structure of socket-side retainer 37.

Socket-side retainer 37 can be formed by bending a retainer plate which is formed by press-molding of a metal plate having a predetermined thickness. Socket-side retainer 37 has side plate part 37*a* extending in width direction Y of connector 10, and bottom plate parts 37*c* which are formed by bending the lower side of side plate part 37*a* toward the center in long side direction X substantially at right angles. By causing the opposite ends of bottom plate part 37*c* to project outward from the opposite side in width direction Y of connector 10, fixed terminals 37*d* are formed.

Further, on the inner side in X direction (the long side direction) of bottom plate parts 37*c*, anchor parts 37*m* extending inward and upward are formed, for preventing socket-side retainer 37 from coming off from socket housing 31. Note that, the shape or projecting direction of the anchor parts may be in various modes. Further, the anchor parts may not be provided.

At the opposite ends in width direction Y of side plate part 37*a*, extending parts 37*b* are formed by bending opposite ends in width direction Y of side plate part 37*a* toward the center of long side direction X of connector 10 substantially at right angles. At a terminating part in the extending direction of each of extending parts 37*b*, substantially inverted U-shaped claw part 37*k* is provided.

The tip end side (on the inner side in X direction) of claw part 37*k* is flat surface 37*n*. In the state where header 20 fits into socket 30, by contact parts 25*f*, 25*f* of header-side retainer 25 being in contact with flat surfaces 37*n*, header-side retainer 25 and socket-side retainer 37 are engaged with each other. In the present exemplary embodiment, one socket-side retainer 37 is provided with a pair of claw parts 37*k*, 37*k*. Flat surfaces 37*n*, 37*n* of respective pair of claw parts 37*k*, 37*k* are opposite to each other in width direction Y.

The claw part 37*k* is formed so that its width along long side direction X becomes greater than the width of socket-side signal terminal 32 along long side direction X. In this manner, in the present exemplary embodiment also, socket-side retainer 37 as a socket-side power supply terminal is formed so that its width along long side direction X of socket housing 31 becomes greater than the width of socket-side signal terminal 32 along long side direction X. Note that, in the present exemplary embodiment, every socket-side signal terminal 32 is smaller than claw part 37*k* of socket-side retainer 37 as a socket-side power supply terminal in the width in long side direction X of socket housing 31.

Further, in the present exemplary embodiment, socket-side retainer 37 is mounted (disposed) on socket housing 31 by insert molding. Here, at least part of socket-side retainer 37 is exposed along socket housing 31.

That is, at least part of socket-side retainer 37 is exposed along outer surface 31*s* of socket housing 31.

Further, in the present exemplary embodiment, part of outer surface 31*s* of circumferential wall part 31*b* and plate-like wall part 31*a* and part of outer wall surface 37*e* of socket-side retainer 37 are substantially flush with each other. In other words, socket-side retainer 37 is integrated with socket housing 31, so that part of outer wall surface 37*e* of socket-side retainer 37 is exposed at outer surface 31*s* of circumferential wall part 31*b* as being substantially flush with each other.

Specifically, the upper part of outer surface 37*f* of side plate part 37*a* is exposed while being flush with side surface (end surface in the long side direction) 31*t* that extends to the outermost end in X direction (the long side direction) of socket housing 31. Further, outer surface 37*h* of extending part 37*b* is exposed while being flush with the outer surface of circumferential wall part 31*b* (outer surface 31*s* of long side direction wall part 31*h*).

In this manner, in the present exemplary embodiment, socket-side retainer 37 is exposed at least along one of side surface 31*t* and bottom surface 31*u* of socket housing 31.

Note that, though outer surface 37*i* of bottom plate part 37*c* is exposed while not being flush with bottom surface 31*u* (outer surface 31*s*) of socket housing 31, outer surface 37*i* of bottom plate part 37*c* may be exposed while being flush with bottom surface 31*u* (outer surface 31*s*) of socket housing 31. Further, it is not necessary for outer wall surface 37*e* of socket-side retainer 37 to be exposed at the outer surface of circumferential wall part 31*b* (outer surface 31*s* of short side direction wall part 31*i*). In the case where outer wall surface 37*e* is exposed also, it is not necessary for outer wall surface 37*e* to be exposed while being flush with the outer surface of circumferential wall part 31*b* (outer surface 31*s* of short side direction wall part 31*i*).

Further, socket-side retainer 37 may be mounted on socket housing 31 by press-fitting or the like.

Figure 61:
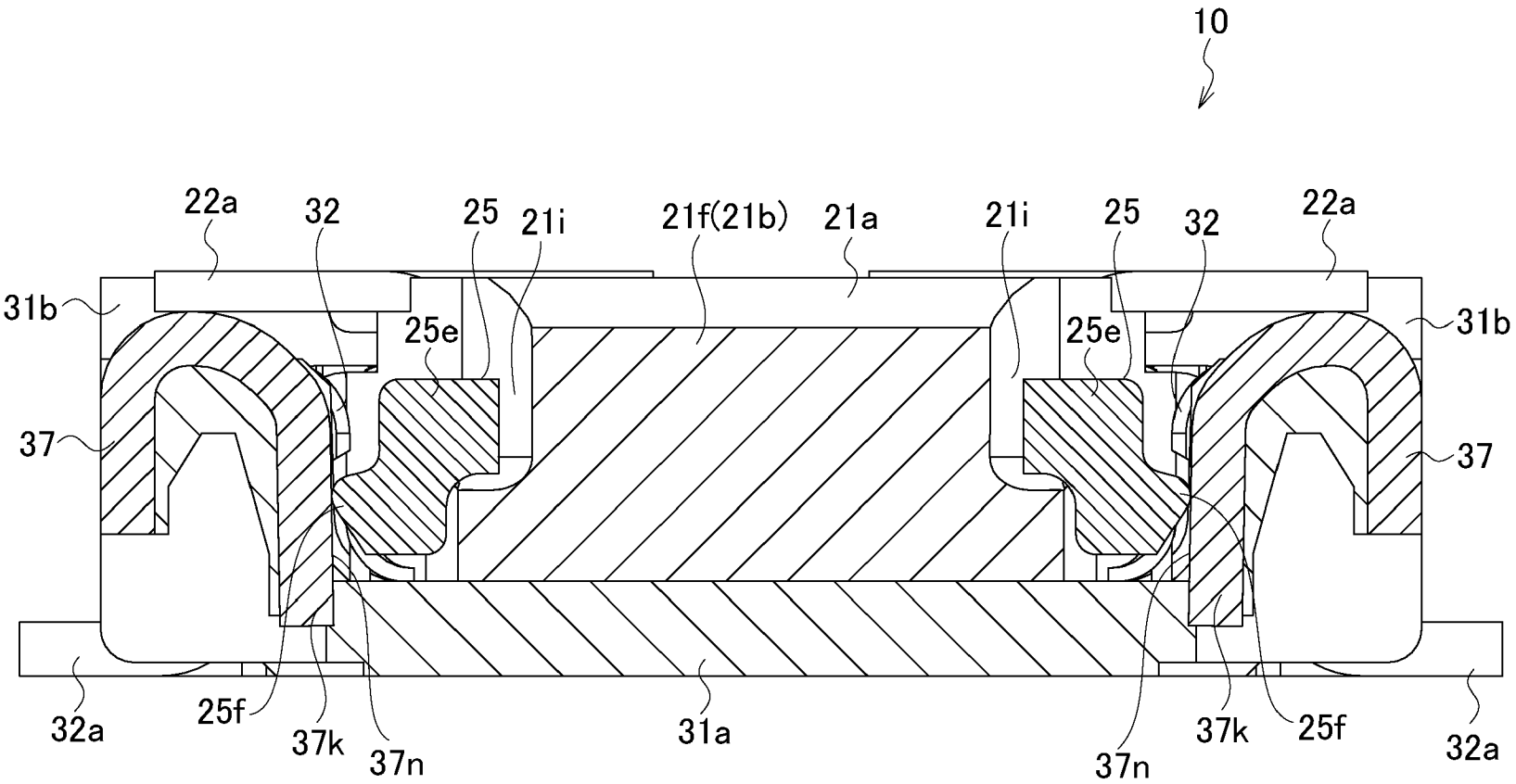
FIG. 61 is a cross-sectional view taken along a site where the header-side retainers and the socket-side retainers are disposed, showing a state where the header and the socket according to the second exemplary embodiment of the present invention are fitted to each other.

As shown in FIGS. 59 and 61, inserting and fitting circumferential wall part 21*b* of header housing 21 into fitting groove part 31*d* of socket housing 31 fits header 20 into socket 30.

Note that, in fitting header 20 into socket 30, for example, tapered part 31*e* and tapered part 21*d* formed at the long side portion on one end side in Y direction (a width direction: a short side direction) may be overlaid on each other, and fitted to each other while being displaced toward the other end in Y direction (the width direction: the short side direction). In this manner, tapered part 31*e* and tapered part 21*d* can function as guide parts, and fitting of header 20 into socket 30 is facilitated.

In the state where header 20 fits into socket 30, contact part R1 of socket-side signal terminal 32 and contact part R1 of header-side signal terminal 22 are in contact with each other.

Further, contact part R2 of socket-side signal terminal 32 and contact part R2 of header-side signal terminal 22 are brought into contact with each other.

Contact part R3 of socket-side power supply terminal 33 and contact part R3 of header-side power supply terminal 23 are brought into contact with each other.

Further, contact part R4 of socket-side power supply terminal 33 and contact part R4 of header-side power supply terminal 23 are brought into contact with each other.

As a result, socket-side signal terminal 32 and header-side signal terminal 22 are electrically connected to each other, and socket-side power supply terminal 33 and header-side power supply terminal 23 are electrically connected to each other.

Thus, circuit pattern 61 of first circuit board 60 and circuit pattern 41 of second circuit board 40 are electrically connected to each other.

On the other hand, in disconnecting header 20 and socket 30 from each other, they are removed in the separating direction. Then, while step-like engaging part 32*d* and step-like engaged part 22*e* relatively slide, the spring part (32*e*, 32*f*, 32*g*, 32*h*, 32*i*, 32*j*, 32*k*, 32*m*) of socket-side signal terminal 32 elastically deforms, releasing engagement between engaging part 33*d* and engaged part 23*e*. At this time, fitting of arc-shaped projecting part 32*k* into recessed part 22*c* is also released.

Further, while step-like engaging part 33*d* and step-like engaged part 23*e* relatively slide, the spring part (33*e*, 33*f*, 33*g*, 33*h*, 33*i*, 33*j*, 33*k*, 33*m*) of socket-side power supply terminal 33 elastically deforms, releasing engagement between engaging part 33*d* and engaged part 23*e*. At this time, fitting of arc-shaped projecting part 33*k* into recessed part 23*c* is also released.

Thus, header 20 and socket 30 can be separated from each other.

Further, in the present exemplary embodiment, as described above, header-side retainers 25 as header-side power supply terminals are disposed at the opposite ends in long side direction X of header housing 21, and socket-side retainers 37 as socket-side power supply terminals are disposed at the opposite ends in long side direction X of socket housing 31. Header-side retainers 25 and socket-side retainers 37 are used for enhancing the strength of header housing 21 and socket housing 31, and fixing header housing 21 and socket housing 31 respectively to the circuit boards.

In the present exemplary embodiment, soldering fixed terminal 25*a* of header-side retainer 25 to second circuit board 40 strongly couples header 20 to second circuit board 40.

Further, soldering fixed terminal 37*d* of socket-side retainer 37 to first circuit board 60 strongly couples socket 30 to first circuit board 60.

Such a structure allows header 20 and socket 30, which are respectively strongly coupled to the circuit boards, to fit to each other.

Thus, header-side signal terminal 22 and socket-side signal terminal 32 are electrically connected to each other by being in contact with each other and header-side retainer 25 as a header-side power supply terminal and socket-side retainer 37 as a socket-side power supply terminal are electrically connected to each other by being in contact with each other. Thus, the circuit patterns of respective circuit boards can be electrically connected to each other.

Here, in the present exemplary embodiment, in fitting header 20 into socket 30, contact parts 25*f*, 25*f* of header-side retainer 25 abutting on flat surfaces 37*n* of socket-side retainer 37 engages header-side retainer 25 with socket-side retainer 37.

Specifically, header-side retainer 25 is formed such that, in the free state, the length in width direction Y between contact parts 25*f*, 25*f* becomes slightly longer than the length in width direction Y between flat surfaces 37*n*, 37*n* of socket-side retainer 37.

Accordingly, in fitting header 20 into socket 30, contact parts 25*f*, 25*f* shift to flat surfaces 37*n* while being narrowed by being pressed as they slide along the outer wall inner surfaces of claw parts 37*k*. Thus, contact parts 25*f*, 25*f* press flat surfaces 37*n*, 37*n* outward in width direction Y by resilience, whereby header-side retainer 25 and socket-side retainer 37 are engaged with each other.

Such a structure enables to increase the pressure of contact between contact parts 25*f*, 25*f* and flat surfaces 37*n*, 37*n*. Then, electrical connection reliability between the header-side power supply terminal (header-side retainer 25) and the socket-side power supply terminal (socket-side retainer 37) further improves.

In particular, in the present exemplary embodiment, contact parts 25*f*, 25*f* are formed so as to be capable of expanding and contracting (elastically deformable) in width direction Y of connector 10, and therefore electrical connection reliability further improves by virtue of resilience of contact parts 25*f*, 25*f*.

Figure 60:
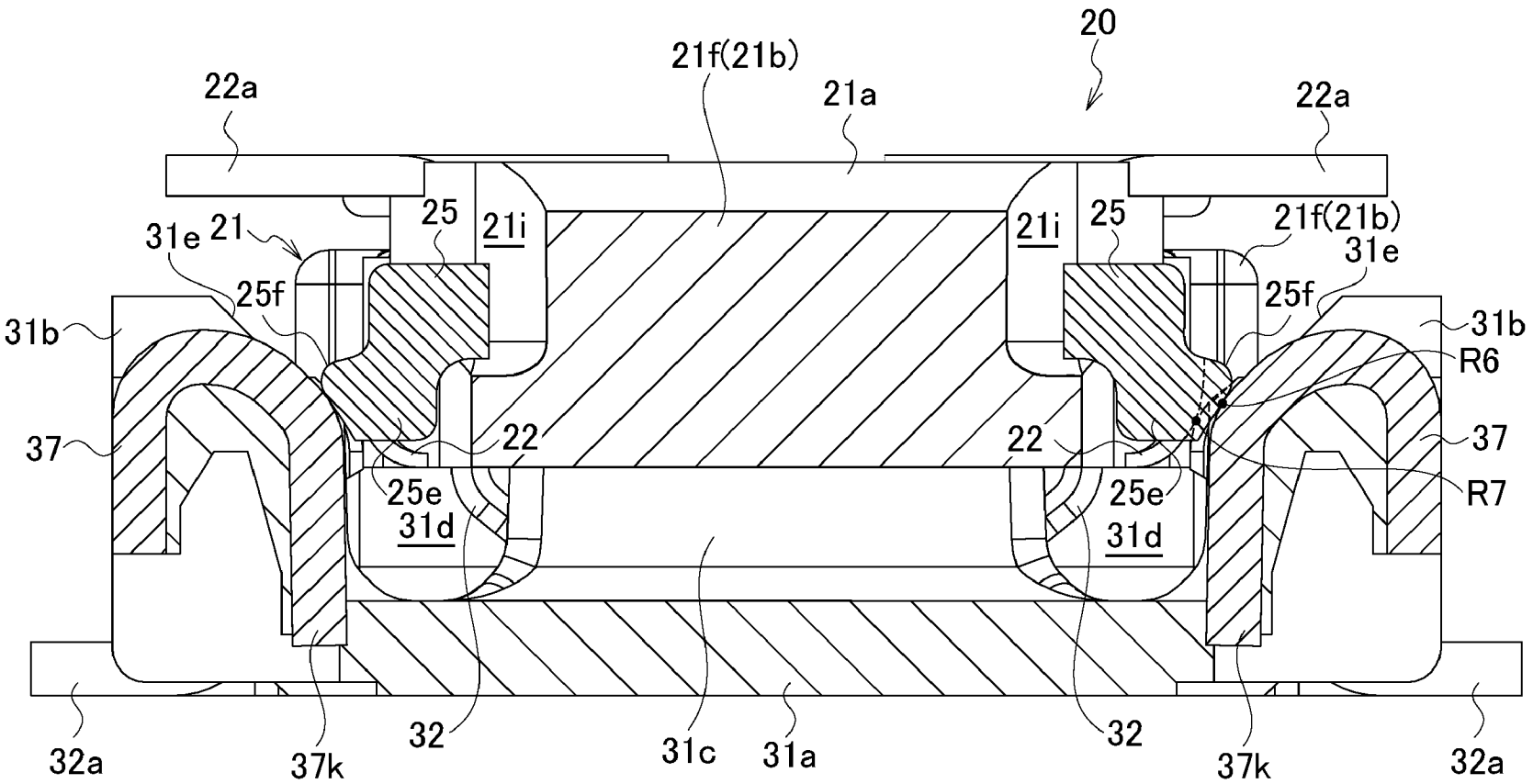
FIG. 60 is a cross-sectional view taken along a site where the header-side retainers and the socket-side retainers are disposed, showing a state immediately before the header and the socket according to the second exemplary embodiment of the present invention are fitted to each other.

Note that, in the present exemplary embodiment also, in fitting header 20 and socket 30 to each other, contact between header-side power supply terminal 23 and socket-side power supply terminal 33 (R6 in FIG. 60) and contact between header-side signal terminal 22 and socket-side signal terminal 32 (R7 in FIG. 60) take place substantially simultaneously (see FIG. 60). Accordingly, in separating header 20 and socket 30 from each other, contact between header-side power supply terminal 23 and socket-side power supply terminal 33 and contact between header-side signal terminal 22 and socket-side signal terminal 32 are released substantially simultaneously.

Note that, the structures for fixing the terminals and the retainers to the circuit patterns may be the structures described in the first exemplary embodiment.

As described above, connector 10 according to the present exemplary embodiment can also exhibit the operation and effect similar to those exhibited by connector 10 according to the first exemplary embodiment.

Further, there is provided socket-side signal terminal group G4 in which a plurality of socket-side signal terminals 32 are disposed along long side direction X of socket housing 31. Thus, provision of socket-side signal terminal group G4 in which a plurality of socket-side signal terminals 32 are disposed along long side direction X of socket housing 31 supports various wiring patterns through use of the plurality of socket-side signal terminals 32 while achieving a reduction in size.

Still further, socket-side retainers 37 as socket-side power supply terminals are disposed on the outer sides in long side direction X of socket housing 31 relative to socket-side signal terminal group G4. In this manner, by disposing the socket-side power supply terminals outside the disposition region of socket-side signal terminal group G4 and at the ends of socket housing 31, an increase in the current to pass can be addressed by an increase in the width of socket-side retainers 37 as socket-side power supply terminals. Thus, a reduction in size can be achieved as a whole.

Still further, when socket-side retainers 37 also serve as socket-side power supply terminals, a further reduction in size of connector 10 can be achieved.

Still further, the opposite ends in short side direction Y (contact parts 25*f*, 25*f*) of header housing 21 in header-side retainer (header-side power supply terminal) 25 are brought into contact with respective parts (flat surfaces 37*n*, 37*n*) of the socket-side power supply terminal facing in short side direction Y of socket housing 31. Thus, contact parts 25*f*, 25*f* are respectively brought into contact on the opposite sides of header-side retainer (header-side power supply terminal) 25, whereby contact reliability between power supply-use terminals is further secured.

Here, when header-side retainer (header-side power supply terminal) 25 is elastically deformable in short side direction Y of header housing 21, contact reliability between power supply-use terminals further improves.

Further, in fitting header 20 and socket 30 to each other, contact between header-side retainer (header-side power supply terminal) 25 and socket-side retainer (socket-side power supply terminal) 37 and contact between header-side signal terminal 22 and socket-side signal terminal 32 take place substantially simultaneously. This prevents an occurrence of solely contact between signal-use terminals or between the power supply-use terminals, and connection reliability of connector 10 improves.

In the foregoing, while a description has been given of suitable exemplary embodiments of the present invention, the present invention is not limited to the exemplary embodiments and can be subjected to various modifications.

For example, in the exemplary embodiments, header 20 is formed point-symmetrically relative to the center of header 20 in a plan view, and socket 30 is formed point-symmetrically relative to the center of socket 30 in a plan view. That is, a connector without polarity is exemplarily shown.

However, the present invention is also applicable to a connector with polarity (a connector that takes a different shape when rotated by 180 degrees).

Further, it is also possible to employ a structure in which, in the state where header 20 and socket 30 are fitted to each other, the header-side retainers and the socket-side retainers engage with each other.

Still further, the header-side power supply terminals or the socket-side power supply terminals may be provided separately from header-side retainers 25 and socket-side retainers 37, and a plurality of header-side signal terminals 22 and socket-side signal terminals 32 may be provided.

Still further, the specification (shapes, sizes, layout and the like) of the socket housing, the header housing, and other details can be changed as appropriate.

INDUSTRIAL APPLICABILITY

The present invention is useful as a connector of a small size for supplying power and transmitting signals to an electronic device having circuit boards.

The invention claimed is:

1. A connector comprising:

a socket that has a socket-side signal terminal, a socket-side power supply terminal, and a substantially quadrangular socket housing in which the socket-side signal terminal and the socket-side power supply terminal are disposed; and a header that has a header-side signal terminal, a header-side power supply terminal, and a substantially quadrangular header housing in which the header-side signal terminal and the header-side power supply terminal are disposed, wherein, by fitting the socket housing and the header housing to each other, the socket-side signal terminal and the header-side signal terminal are brought into contact with each other and the socket-side power supply terminal and the header-side power supply terminal are brought into contact with each other, the socket-side signal terminal and the socket-side power supply terminal are disposed along a long side direction of the socket housing, in the long side direction of the socket housing, the socket-side signal terminal is smaller than the socket-side power supply terminal in width, the socket-side signal terminal and the socket-side power supply terminal have a substantially identical cross-sectional shape, and the socket-side power supply terminal includes a common portion and a plurality of piece parts extending from the common portion having flexibility, the plurality of piece parts being flexible and being able to flex independently of each other.

2. The connector according to claim 1, wherein, in the socket housing, a plurality of lines of socket-side terminal groups are disposed, each of the socket-side terminal groups being formed by the socket-side signal terminal and the socket-side power supply terminal disposed along the long side direction of the socket housing.

3. The connector according to claim 1, wherein the socket-side power supply terminal is disposed on an outer side in the long side direction of the socket housing relative to the socket-side signal terminal.

4. The connector according to claim 1, wherein the socket-side signal terminal is included in a plurality of socket-side signal terminal groups each disposed along the long side direction of the socket housing.

5. The connector according to claim 4, wherein the socket-side power supply terminal is disposed on an outer side in the long side direction of the socket housing relative to the socket-side signal terminal groups.

6. The connector according to claim 1, wherein each of the socket-side power supply terminal and the header-side power supply terminal is provided with a plurality of contact parts that are brought into contact with each other, along the long side direction of the socket housing.

7. The connector according to claim 6, wherein the plurality of piece parts are respectively provided with the contact parts.

8. The connector according to claim 6, wherein a recessed part is formed at one of the contact part of the socket-side power supply terminal and the contact part of the header-side power supply terminal being brought into contact with each other, and another one of the contact parts is brought into contact with opposite ends of the recessed part in the long side direction of the socket housing.

9. The connector according to claim 1, wherein the socket housing further has a socket-side retainer, and at least part of the socket-side retainer is exposed along an outer surface of the socket housing.

10. The connector according to claim 9, wherein the socket-side retainer is exposed along at least one of a side surface and a bottom surface of the socket housing.

11. The connector according to claim 9, wherein the socket-side retainer is disposed in the socket housing by insert molding.

12. The connector according to claim 9, wherein the socket-side retainer has a fixed terminal capable of being soldered to a circuit pattern formed at a circuit board, the socket-side power supply terminal has a root part capable of being soldered to a circuit pattern formed at the circuit board, and the fixed terminal and the root part are capable of being soldered to a common circuit pattern.

13. The connector according to claim 12, wherein the fixed terminal has a first fixed terminal and a second fixed terminal formed separately from the first fixed terminal.

14. The connector according to claim 9, wherein the socket-side retainer serves also as the socket-side power supply terminal.

15. The connector according to claim 1, wherein opposite ends of the header-side power supply terminal in a short side direction of the header housing are brought into contact with respective parts of the socket-side power supply terminal facing in a short side direction of the socket housing.

16. A connector comprising:

a socket that has a socket-side signal terminal, a socket-side power supply terminal, and a substantially quadrangular socket housing in which the socket-side signal terminal and the socket-side power supply terminal are disposed; and a header that has a header-side signal terminal, a header-side power supply terminal, and a substantially quadrangular header housing in which the header-side signal terminal and the header-side power supply terminal are disposed, wherein, by fitting the socket housing and the header housing to each other, the socket-side signal terminal and the header-side signal terminal are brought into contact with each other and the socket-side power supply terminal and the header-side power supply terminal are brought into contact with each other, the header-side signal terminal and the header-side power supply terminal are disposed along a long side direction of the header housing, in the long side direction of the header housing, the header-side signal terminal is smaller than the header-side power supply terminal in width, the header-side signal terminal and the header-side power supply terminal have a substantially identical cross-sectional shape, and the socket-side power supply terminal includes a common portion and a plurality of piece parts extending from the common portion having flexibility, the plurality of piece parts being flexible and being able to flex independently of each other.

17. The connector according to claim 16, wherein, in the header housing, a plurality of lines of header-side terminal groups are disposed, each of the header-side terminal groups being formed by the header-side signal terminal and the header-side power supply terminal disposed along the long side direction of the header housing.

18. The connector according to claim 16, wherein the header-side power supply terminal is disposed on an outer side in the long side direction of the header housing relative to the header-side signal terminal.

19. The connector according to claim 16, wherein the socket-side power supply terminal and the header-side power supply terminal are provided with a plurality of contact parts that are brought into contact with each other, along a long side direction of the socket housing.

20. The connector according to claim 19, wherein a recessed part is formed at one of the contact part of the socket-side power supply terminal and the contact part of the header-side power supply terminal being brought into contact with each other, and another one of the contact parts is brought into contact with opposite ends of the recessed part in the long side direction of the socket housing.

21. The connector according to claim 16, wherein the header-side power supply terminal is elastically deformable in a short side direction of the header housing.

22. The connector according to claim 16, wherein the socket-side signal terminal and the socket-side power supply terminal are disposed along the long side direction of the socket housing, and in the long side direction of the socket housing, the socket-side signal terminal is smaller than the socket-side power supply terminal in width.

23. The connector according to claim 1, when the header and the socket are fitted to each other, contact between the header-side power supply terminal and the socket-side power supply terminal and contact between the header-side signal terminal and the socket-side signal terminal take place substantially simultaneously.

24. The connector according to claim 1, wherein the socket-side power supply terminal has a step-like engaging part that is engaged with the header-side power supply terminal, and the engaging part is formed entirely from one end to another end of the socket-side power supply terminal in the long side direction of the socket housing.

25. The connector according to claim 16, the header-side power supply terminal has a step-like engaged part that is engaged with the socket-side power supply terminal, and the engaged part is formed entirely from one end to another end of the header-side power supply terminal in the long side direction of the header housing.

26. The connector according to claim 1, wherein the plurality of piece parts extend from the common portion in a same direction.

27. The connector according to claim 16, wherein the plurality of piece parts extend from the common portion in a same direction.

* * * * *